US009679446B2

(12) United States Patent
Weiss et al.

(10) Patent No.: US 9,679,446 B2
(45) Date of Patent: Jun. 13, 2017

(54) GAMING SYSTEM, DEVICE AND METHOD INVOLVING COMPETITIVE ELEMENTS

(71) Applicant: WARR Gaming, LLC, Glencoe, IL (US)

(72) Inventors: Keith H. Weiss, Highland Park, IL (US); Alexander P. Adams, Vernon Hills, IL (US)

(73) Assignee: WARR Gaming, LLC, Glencoe, IL (US)

( * ) Notice: Subject to any disclaimer, the term of this patent is extended or adjusted under 35 U.S.C. 154(b) by 0 days.

(21) Appl. No.: 14/950,088

(22) Filed: Nov. 24, 2015

(65) Prior Publication Data

US 2016/0086452 A1 Mar. 24, 2016

Related U.S. Application Data

(63) Continuation of application No. 14/142,143, filed on Dec. 27, 2013, now Pat. No. 9,218,711, which is a continuation-in-part of application No. 13/606,705, filed on Sep. 7, 2012, now Pat. No. 8,992,296.

(51) Int. Cl.

| | |
|---|---|
| ***G07F 17/32*** | (2006.01) |
| ***G07F 17/34*** | (2006.01) |
| ***A63F 9/04*** | (2006.01) |
| *A63F 3/00* | (2006.01) |

(52) U.S. Cl.

CPC ..... *G07F 17/34* (2013.01); *A63F 9/04* (2013.01); *G07F 17/3218* (2013.01); *G07F 17/3244* (2013.01); *A63F 2003/00164* (2013.01)

(58) Field of Classification Search

CPC ..... G07F 17/32

See application file for complete search history.

(56) References Cited

U.S. PATENT DOCUMENTS

| | | | |
|---|---|---|---|
| 5,513,850 | A | 5/1996 | Vancura |
| 6,364,314 | B1 | 4/2002 | Canterbury |
| 6,508,469 | B2 | 1/2003 | Promutico |
| 6,761,353 | B2 | 7/2004 | Berman et al. |
| 6,896,264 | B1 | 5/2005 | Haber |
| 7,175,526 | B2 | 2/2007 | Moore, Jr. |

(Continued)

FOREIGN PATENT DOCUMENTS

| | | |
|---|---|---|
| WO | 2006012429 | 2/2006 |
| WO | 2012016212 A2 | 2/2012 |

OTHER PUBLICATIONS

Office Football Pool, year 2012 [online]. [retrieved on Jun. 12, 2012]. Retrieved from the Internet: http://www.officefootball.com.

(Continued)

*Primary Examiner* — Omkar Deodhar
(74) *Attorney, Agent, or Firm* — Barclay Damon, LLP

(57) ABSTRACT

A gaming system, device and method are operable upon a wager. The system, in an embodiment, is operable to generate a visual output related to a plurality of competing elements or competitors. The system is operable to receive wager inputs from a plurality of wager submitters and generate a visual output including at least part of a grid. Also, the system is operable to provide a first monetary value based on which competitor wins as well as a second monetary value based on a winning intersection on the grid.

34 Claims, 34 Drawing Sheets

(56) References Cited

U.S. PATENT DOCUMENTS

| | | | | |
|---|---|---|---|---|
| 7,179,166 | B1 * | 2/2007 | Abbott | G07F 17/3295 273/429 |
| 7,493,396 | B2 | 2/2009 | Alcorn et al. | |
| 8,074,991 | B2 | 12/2011 | Chen et al. | |
| 2003/0176211 | A1 | 9/2003 | Sommerville | |
| 2004/0116179 | A1 | 6/2004 | Nicely et al. | |
| 2005/0146092 | A1 | 7/2005 | Knight | |
| 2005/0253334 | A1 | 11/2005 | Friedman | |
| 2006/0009285 | A1 | 1/2006 | Pryzby et al. | |
| 2006/0073880 | A1 * | 4/2006 | Thomas | G07F 17/32 463/20 |
| 2007/0102877 | A1 | 5/2007 | Personius et al. | |
| 2007/0270202 | A1 | 11/2007 | Vostoris | |
| 2008/0217851 | A1 | 9/2008 | Colton | |
| 2009/0115130 | A1 | 5/2009 | Cacas | |
| 2016/0078729 | A1 | 3/2016 | Maggio | |

OTHER PUBLICATIONS

Roulette, year 2012 [online]. [retrieved on Feb. 11, 2012]. Retrieved from the Internet: http://www.wizardofodds.com/games/roulette/.

Craps Rules & Strategies, year 2012 [online]. [retrieved on Jun. 1, 2012]. Retrieved from the Internet: http://www.gonegambling.com/dice-game-craps-rules/index.html.

How to Play Scossa, year 2012 [online]. [retrieved on Mar. 26, 2012]. Retrieved from the Internet: http://www.brillentertainment.com/HowtoPlayScossa.html.

Squarz, year 2012 [online]. [retrieved on Jun. 11, 2012]. Retrieved from the Internet: http://www.squarz.com/Shop/ProductDetails.aspx?SquarePoolID=10000909.

* cited by examiner

| | COMPETING COLORS | | |
|---|---|---|---|
| | EXAMPLE SIGNAGE | EXAMPLE COLOR OF OUTCOME GENERATOR A | EXAMPLE COLOR OF OUTCOME GENERATOR B |
| 441 | NONE | RED | GREEN |
| 443 | SWORD FIGHT:<br>LORD X (BLUE)<br>VS.<br>SIR Z (GOLD) | BLUE | GOLD |
| 444 | BOXING:<br>FIGHTER A (PURPLE)<br>VS.<br>FIGHTER B (YELLOW) | PURPLE | YELLOW |
| 446 | SPORTS - FOOTBALL:<br>PITTSBURGH STEELERS FOOTBALL TEAM (BLACK & YELLOW)<br>VS.<br>CHICAGO BEARS FOOTBALL TEAM (BLUE & ORANGE) | BLACK & YELLOW | BLUE & ORANGE |

FIG. 29

| COMPETING SYMBOLS | | |
|---|---|---|
| EXAMPLE SIGNAGE | EXAMPLE SYMBOL OF OUTCOME GENERATOR A | EXAMPLE SYMBOL OF OUTCOME GENERATOR B |
| SWORD FIGHT:<br>LORD X<br>VS.<br>SIR Z | X | Z |
| BOXING:<br>FIGHTER A<br>VS.<br>FIGHTER B | A | B |
| SPORTS - FOOTBALL:<br>PITTSBURGH STEELERS FOOTBALL TEAM<br>VS.<br>CHICAGO BEARS FOOTBALL TEAM | Steelers | |

448

450

452

FIG. 30

GAMING SYSTEM, DEVICE AND METHOD INVOLVING COMPETITIVE ELEMENTS

CROSS-REFERENCE TO RELATED APPLICATIONS

This application is a continuation of, and claims the benefit and priority of, U.S. patent application Ser. No. 14/142,143, filed on Dec. 27, 2013, which is a continuation-in-part of U.S. patent application Ser. No. 13/606,705, filed on Sep. 7, 2012. The entire contents of such applications are hereby incorporated by reference.

COPYRIGHT NOTICE

A portion of the disclosure of this patent document contains or may contain material which is subject to copyright protection. The copyright owner has no objection to the photocopy reproduction by anyone of the entire patent document in exactly the form it appears in the Patent and Trademark Office patent file or records, but otherwise reserves all copyrights whatsoever.

BACKGROUND

Many casinos have tables for playing the conventional game of Craps. The conventional Craps game has a game layout with various betting spots and betting chips. The player rolls the dice, and the outcome determines a loss or win. The rules for the conventional Craps game specify the various betting options.

Players are attracted to the conventional Craps game, in part, because they enjoy rolling the dice and the physical interaction with the game. However, many players find it difficult to understand and remember the layout, game rules and betting options. As a result, some of the players only play in a limited capacity by placing limited bets. Other players decline to play at all.

Therefore, there is a need to overcome, or otherwise lessen the effects of, these disadvantages. In particular, there is a need to provide a system for dice-based games and other games, which enables an easier and more intuitive gaming experience. There is also a need to increase the ease of play, excitement and entertainment for gaming players.

SUMMARY

Part I

The gaming system, in one embodiment, includes a game layout which displays a grid. The grid includes a plurality of rows and columns. One of the outer rows displays a plurality of initial outcome symbols, for example, the six values of a blue die. One of the outer columns displays a plurality of initial outcome symbols, for example, the six values of a red die. The central area of the grid displays a plurality of grid outcome symbols, for example, the thirty-six possible values of dice roll outcomes.

In one example, the gaming system includes blue die and red die which are rolled together to determine the initial outcome symbols or values. Before the roll, the player can place a wager on an initial outcome, for example, whether the value of the blue die will be higher than the red die. In addition, the player can select, and place an additional wager on, one of the grid outcome symbols or values.

In this example, the game procedures involve the following steps:

(a) determining whether the initial outcome, wagered upon by the player, occurs;
(b) determining a win evaluation column in line with the determined initial outcome symbol of the outer row;
(c) determining a win evaluation row in line with the determined initial outcome symbol of the outer column;
(d) determining the intersection of the win evaluation column with the win evaluation row;
(e) providing a payout based, at least in part, on whether the initial outcome, wagered upon by the player, occurred; and
(f) providing a payout based, at least in part, on whether the grid outcome symbol at the intersection, is the same as the grid outcome symbol selected by the player.

Part II

In one embodiment, the method for operating the game includes the following steps:

(A) Enabling the player to select a first outcome generator to compete against a second outcome generator, wherein: (i) the first and second outcome generators have identical outcome probabilities; and (ii) the first and second outcome generators differ by at least one visible characteristic;
(B) Receiving a bet from the player, wherein the bet corresponds to a streak quantity for a streak of a designated competition outcome based on multiple competitions between the first and second outcome generators;
(C) Determining whether the designated competition outcome occurs or a non-designated outcome occurs after the first and second outcome generators are operated; and
(D) In response to the occurrence of the designated competition outcome:
  (i) repeating step (C); and
  (ii) providing an award in response to the streak quantity being achieved; and
(E) Ending the game without providing an award in response to the occurrence of the non-designated competition outcome before the streak quantity is achieved.

In one embodiment, the bet includes a base bet, and the method includes the following steps: (a) receiving a bonus bet from the player, wherein the bonus bet corresponds to a streak extension quantity for an extension of the streak, wherein the streak extension quantity comprises at least one; (b) determining whether the streak extension quantity is achieved; and (c) providing a bonus award in response to the streak extension quantity being achieved.

In one embodiment, the first and second outcome generators include dice, and the dice are of a suitable form such as a physical form or a graphical form. In one embodiment, the visible characteristic is a color, a color pattern, a shade, a marking, a symbol, a name, a logo, a sports logo, a team logo, a country symbol, a country flag, a state symbol, a state flag, a city symbol, a city flag, a school logo, a school symbol, a graphical differentiation, a graphical animation, a size, a shape or a material type.

In one embodiment, the gaming system includes a betting area and a plurality of game procedures associated with the betting area. The game procedures are associated with a plurality of different outcome generators. Each one of the outcome generators is operable to indicate one of a plurality of different outcomes. The game procedures include the following:

(a) Receiving a bet, where the bet specifies:
  (i) a win which would occur after one of the outcome generators indicates one of the outcomes which outranks another one of the outcomes indicated by another one of the outcome generators; and (ii) a consecutive quantity of times that the win must occur during a plurality of consecutive operations of the outcome generators;

(b) Operating a plurality of the outcome generators;

(c) Determining whether the win has occurred after the operation stops;

(d) In response to the occurrence of the win, operating a plurality of the outcome generators again; and (e) Providing an award depending, at least in part, upon whether the win has occurred the specified consecutive quantity of times.

In one embodiment, the gaming system has an overlay which displays the betting area. The overlay has a structure selected from the group consisting of a felt material, a layer, and a board. In one embodiment, the gaming system has a table which supports the overlay, and the overlay displays the betting area.

The game procedures, in one embodiment, have a computer-readable form, and the gaming system has: (a) a display device accessible by a processor; and (b) a data storage device which stores the game procedures. The game procedures are executable by the processor to cause the display device to display the betting area, indicate the bet, display the outcome generators, and indicate the award.

The gaming system, in one embodiment, is configured so that the bet specifies at least one additional consecutive time that the win could occur. The game procedures include the step of providing an additional award in response to the win occurring the additional consecutive time. In one embodiment, the outcomes associated with the different outcome generators comprise identical outcome probabilities of occurrence.

In one embodiment, the gaming system has a game layout and a plurality of game procedures associated with the game layout. The game procedures are associated with first and second multi-sided objects. The first and second multi-sided objects differing by at least one characteristic, and each one of the first and second multi-sided objects is rollable to indicate one of a plurality of outcomes. The outcomes include a superior outcome which outranks an inferior outcome. The game procedures include the following:

(A) Receiving at least one of a plurality of bets, where the bets include:

(i) a first bet which can be placed, where the first bet specifies:

(a) a win which would occur after the first multi-sided object indicates the superior outcome and the second multi-sided object indicates the inferior outcome; and (b) a consecutive quantity of times that the win could occur during a plurality of consecutive rolls of the first and second multi-sided objects;

(ii) a second bet which can be placed, where the second bet specifies at least one additional consecutive time that the win could occur;

(B) Rolling a plurality of the multi-sided objects;

(C) In response to the first bet:

(i) determining whether the win has occurred after the rolling stops;

(ii) in response to the occurrence of the win, rolling a plurality of the multi-sided objects again; and (iii) providing a first award depending, at least in part, upon whether the win has occurred the consecutive quantity of times specified for the first bet; and (D) In response to the second bet:

(i) rolling the first and second multi-sided objects again in response to the win occurring the consecutive quantity of times; and (ii) providing a second award in response to the win occurring the additional consecutive time.

In one embodiment, the multi-sided objects include dice, the outcomes include values, and the outranking occurs as a result of one of the indicated values being greater than another one of the indicated values.

In one embodiment, the gaming device or gaming system includes a data storage device. The data storage device stores a plurality of instructions which are executable by a processor to perform the following steps:

(A) Receive a wager input;

(B) Start a game, such as a primary game;

(C) Cause a plurality of reels to rotate during the game;

(D) Determine whether a bonus triggering event occurs;

(E) After the bonus triggering event occurs:

(i) cause a first movement, or first rolling, of first and second dice, wherein:

(a) the first and second dice differ by at least one visible characteristic;

(b) the first die has been selected by the player to compete against the second die;

(ii) cause a second movement, or second rolling, of the first and second die in response to a first win of the first die against the second die; and (iii) provide an award in response to the second movement resulting in a second win of the first die against the second die.

The gaming system, in one embodiment, has a bonus game, a display device and the processor. The processor controls the display device to display the reels and the first and second dice. The processor controls the reels are part of the primary game controlled by the processor. The processor controls the movement or rolling of the first and second dice as part of the bonus game.

In another embodiment, the processor executes the instructions to provide a primary award based on award-winning events in the primary game related to combinations of reel symbols on the reels.

In one embodiment, the processor executes the instructions to cause the display device to display an animation related to the first and second dice. The animation involves a first symbol related to the first die and a second symbol related to the second die. The animation comprises: (a) a first interaction of the first and second symbols after the first movement; and (b) a second interaction of the first and second symbols after the second movement. Depending upon the embodiment, such symbols can include characters or icons.

Additional features and advantages of the present disclosure are described in, and will be apparent from, the following Brief Description of the Drawings and Detailed Description.

BRIEF DESCRIPTION OF THE DRAWINGS

FIG. 29 is a table illustrating competing color examples of one embodiment of the gaming system.

FIG. 30 is a table illustrating competing symbol examples of one embodiment of the gaming system.

DETAILED DESCRIPTION

Part I

Gaming System

Figure 1:
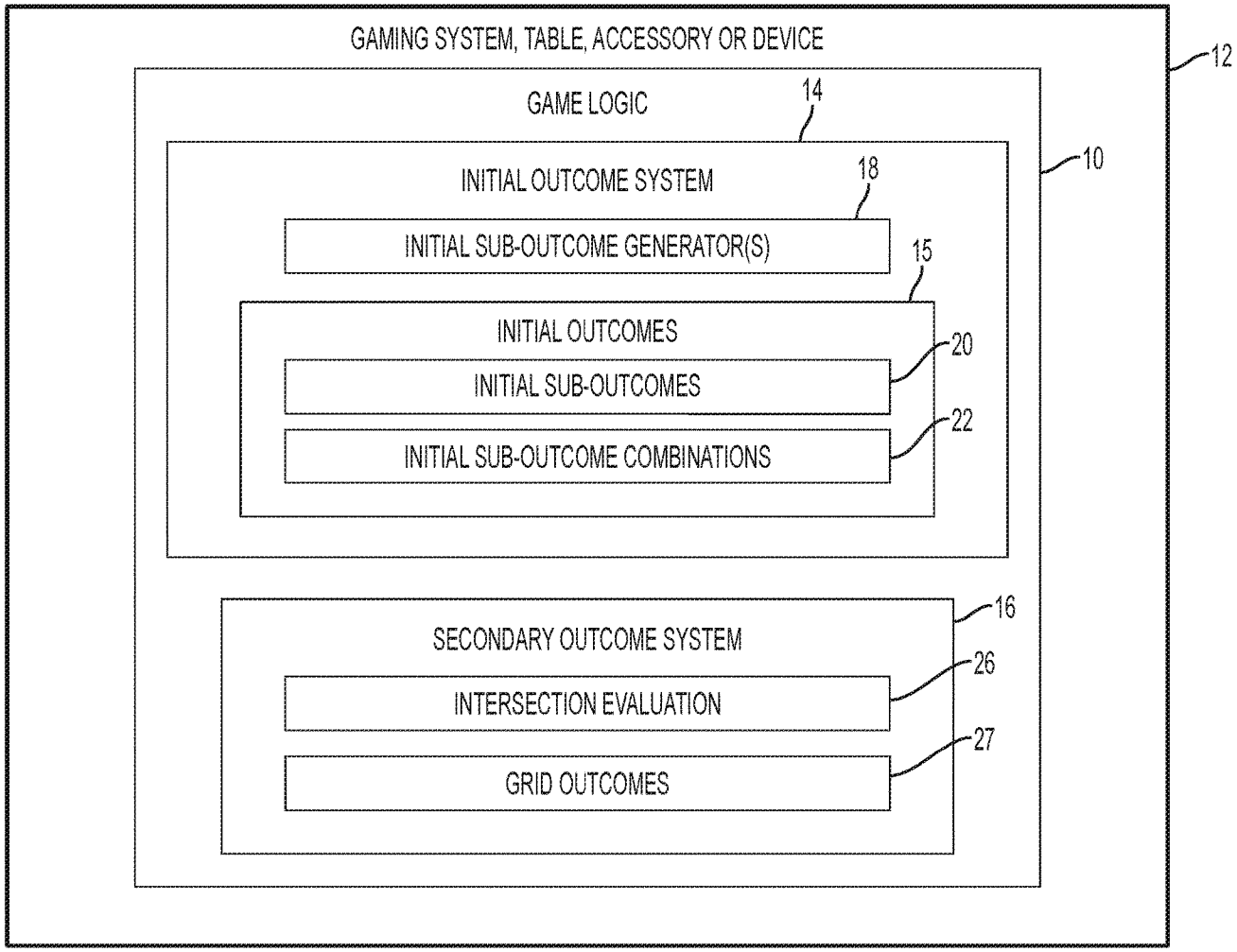
FIG. 1 is a schematic block diagram illustrating one embodiment of the gaming system and device.

Referring to FIG. 1, in one embodiment, the game logic 10 is incorporated into a gaming device or gaming system 12, including, but not limited to, a gaming table, gaming machine, gaming kit with game play instructions or gaming accessory. In one embodiment, the gaming system 12 includes a table which is structurally the same as, or similar to, the structure of a conventional Craps game table as described below. It should be appreciated that the gaming system 12 can include other types of casino gaming tables and gaming surfaces, including, but not limited to, a Roulette table, Blackjack table, Poker table, or Baccarat table. In another embodiment, the gaming system 12 includes a gaming accessory, including, but not limited to, a game play overlay (including, but not limited to, a game layout felt, game layout sticker or label, game layout sheet, game layout template, or other game layout medium) or a game board. Depending upon the embodiment, each of these gaming accessories can be used alone for the operation of the game logic 10 or can be laid on, or attached to, a table or other structure for the implementation and operation of the game logic 10.

As illustrated in FIG. 1, the game logic 10 includes an initial outcome system 14 and a secondary outcome system 16. The initial outcome system 14 generates initial outcomes 15. In one embodiment, the initial outcome system 14 includes one or more initial sub-outcome generators 18. The initial sub-outcome generators 18 are operable to randomly select, determine or otherwise generate a plurality of initial sub-outcomes 20. Depending upon the embodiment, the initial sub-outcome generators 18 can include dice or other multi-sided objects, wheels, a computerized random number generator or other devices as described below. In one example, one of the sub-outcome generators 18 is one color, such as blue, and the other sub-outcome generator 18 is a different color, such as red. The secondary outcome system 16 includes an intersection evaluation 26 and grid outcomes 27 described in detail below.

Figure 2:
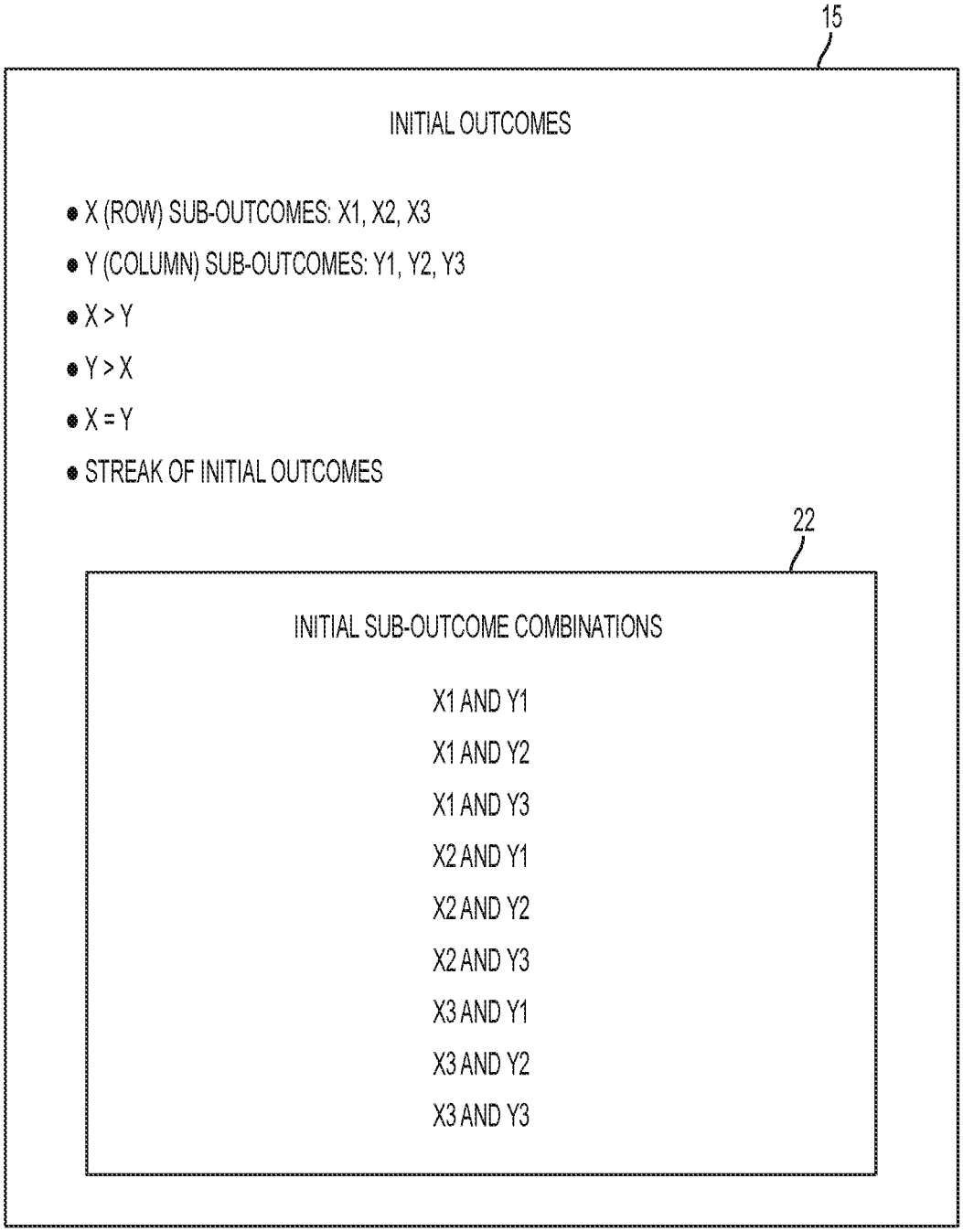
FIG. 2 is a set of tables illustrating one embodiment of the initial outcomes and initial outcome combinations.

In the example illustrated in FIG. 2, the X pool of initial sub-outcomes 20, includes X1, X2 and X3. The Y pool of initial sub-outcomes 20, includes Y1, Y2 and Y3. The X initial sub-outcomes are combinable with the Y initial sub-outcomes to produce a plurality of different, initial sub-outcome combinations 22, as illustrated in FIGS. 1 and 2.

Figure 3:
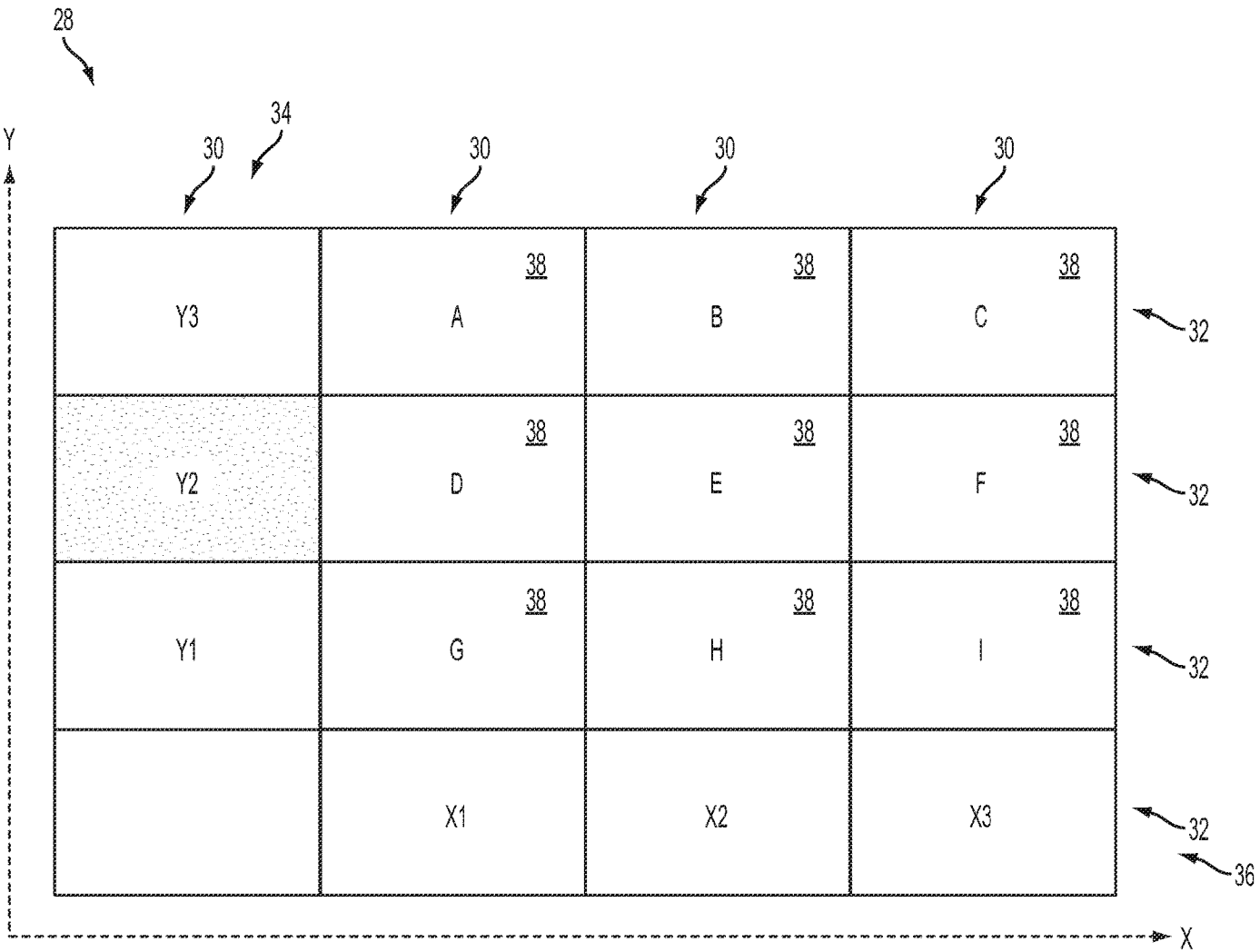
FIG. 3 is a top plan view of one embodiment of the grid.
Figure 4:
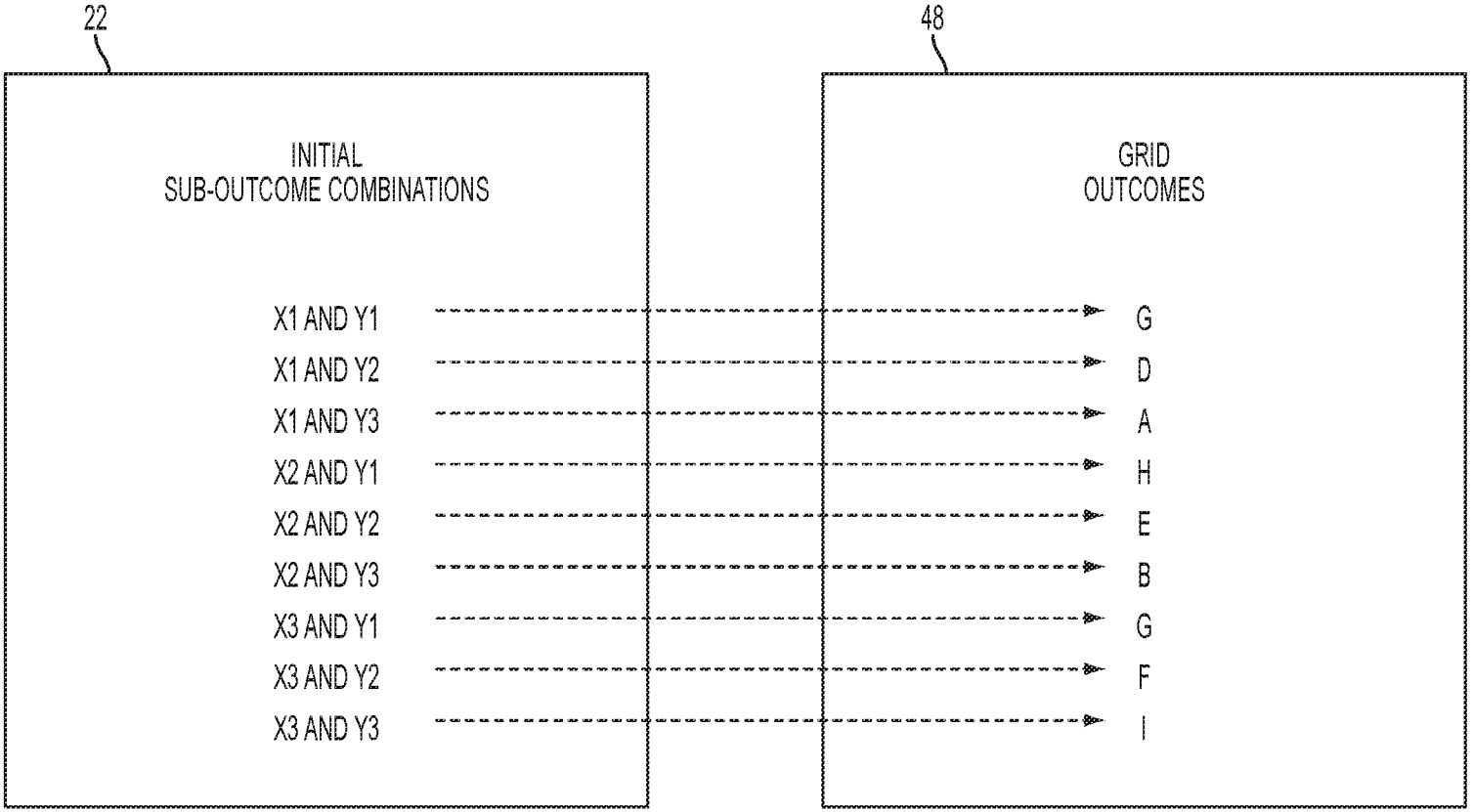
FIG. 4 is a schematic block diagram illustrating the relationship between the initial outcome combinations and grid outcomes in one embodiment.

Referring to FIG. 3, the game logic 10 includes a grid 28 of columns 30 and rows 32, including at least one outer column 34 and at least one outer row 36. The outer column 34 extends parallel to the Y-axis. In the example shown, the outer column 34 provides three initial sub-outcome spaces for the initial sub-outcomes Y1, Y2 and Y3. The outer row 36 extends parallel to the X-axis. In the example shown, the outer row 36 provides three initial sub-outcome spaces for the initial sub-outcomes X1, X2 and X3. The outer column 34 and outer row 36 define a partial boundary for a plurality of centrally-located grid outcome spaces occupied by a plurality of grid outcome symbols 38. In the example shown, the grid outcome symbols 38 include the symbols A, B, C, D, E, F, G, H and I. Each of the initial sub-outcome combinations 22 is associated with one of the grid outcomes 48, as illustrated in FIG. 4.

Though the example grid 28 has four columns and four rows, it should be appreciated that the grid of the game logic 10 can include any suitable quantity of rows and any suitable quantity of columns. Also, depending upon the embodiment, the outer column for the initial sub-outcome spaces, can be located to the far left of the grid (as shown) or to the far right of the grid. In one embodiment, the grid includes both of such outer columns. Depending upon the embodiment, the outer row for the initial sub-outcome spaces, can be located to the far bottom of the grid (as shown) or to the far top of the grid. In one embodiment, the grid includes both of such outer rows.

Figure 5:
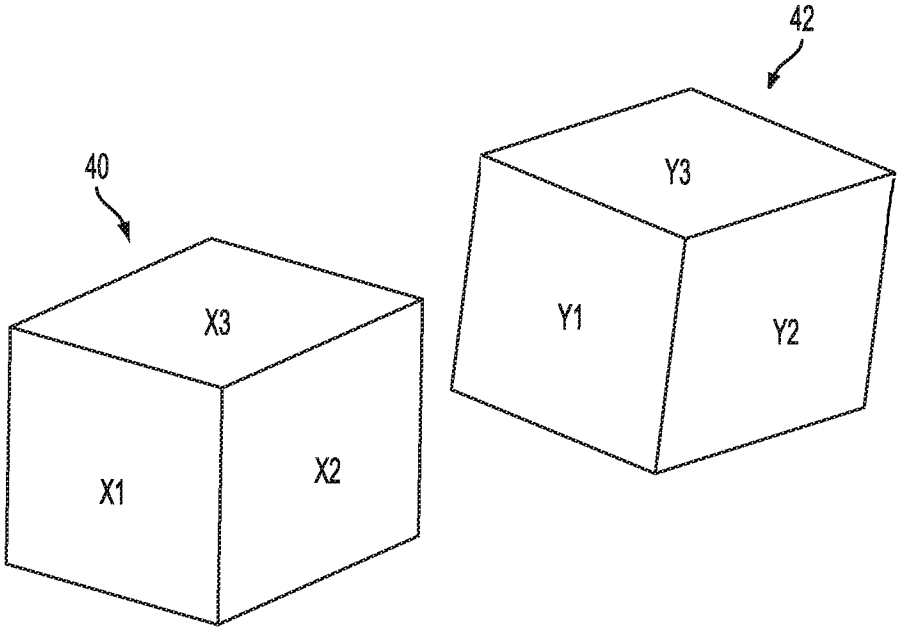
FIG. 5 is an isometric view of one embodiment of the initial outcome generators.

Referring to FIG. 5, the game logic 10, in this example, includes an X die 40 as one initial sub-outcome generator and a Y die 42 as another initial sub-outcome generator. In this example, X die 40 has six faces bearing X1, X1, X2, X2, X3, and X3. Similarly, the Y die 42 has six faces bearing Y1, Y1, Y2, Y2, Y3, and Y3. In one embodiment, the dice 40 and 42 are differently colored as illustrated in FIG. 5. For example, the die 40 can be red, and the die 42 can be blue.

Figure 6:
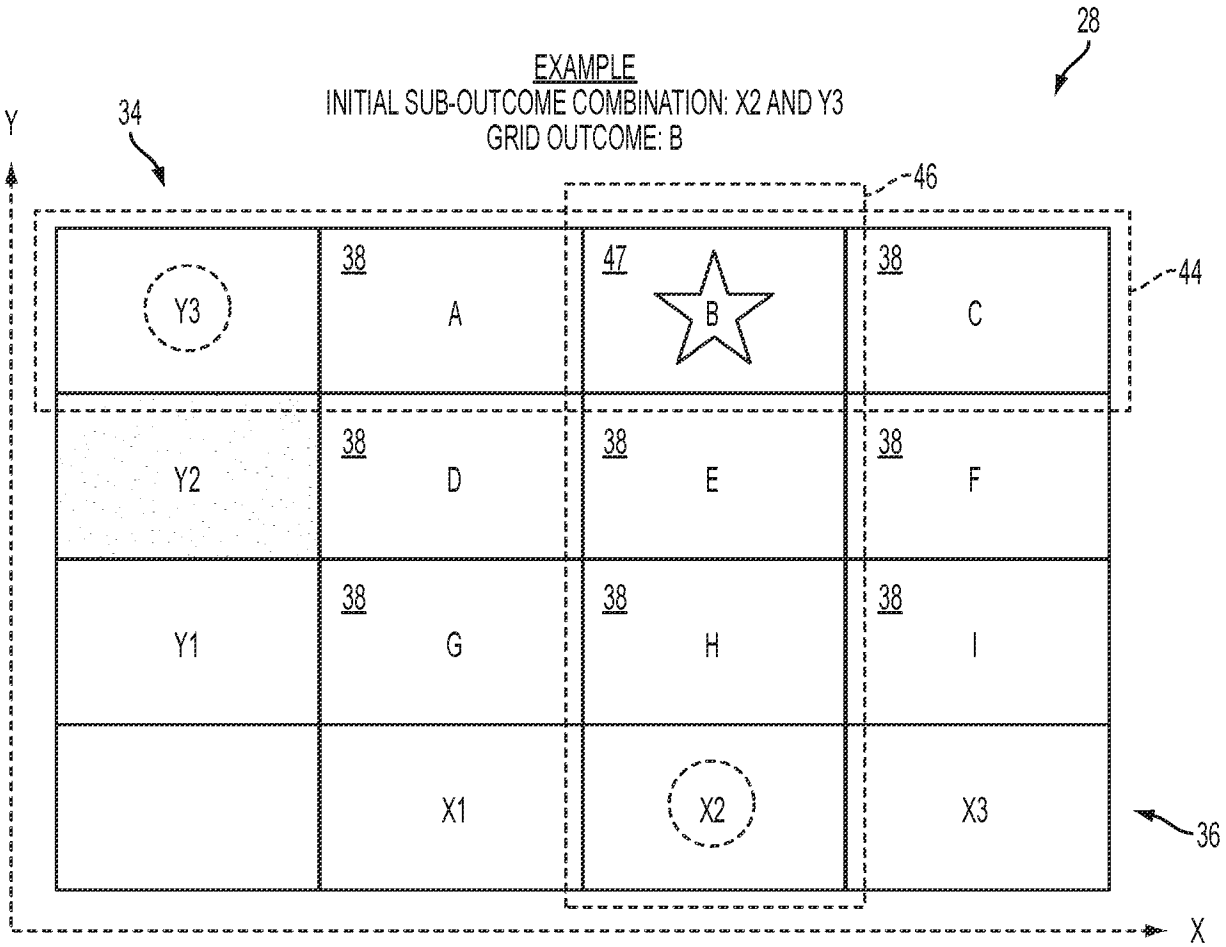
FIG. 6 is a top plan view of one embodiment of the grid, illustrating an example of an initial outcome combination, intersection evaluation and grid outcome.

In the example illustrated in FIG. 6, the player placed an initial wager (not shown), betting that the initial outcome will include sub-outcomes X3 and Y3. The player also placed a grid wager, betting that the grid outcome will be outcome B. For the grid wager, the player exercised his/her judgment by selecting outcome B based on its value and location on the grid. Then, the player tossed or rolled the dice 40 and 42 for the play of the game. The red die 40 landed with X2 face-up, and the blue die 42 landed with Y3 face-up.

The win evaluation row 44 extends across the grid, in line with the Y3 outcome. The win evaluation column 46 extends up the grid, in line with the X2 outcome. The win evaluation row 44 and win evaluation column 46 intersect at the outcome space 47 of the grid outcome B. In this example, the player lost the initial bet on X3, won the initial bet on Y3, and won the grid bet on the grid outcome B.

Depending upon the embodiment, the win evaluation row can be a non-straight line, such as a curved line or a line with bends or steps, extending across different rows in different places. Likewise, the win evaluation column can, depending upon the embodiment, be a non-straight line, such as a curved line or a line with bends or steps, extending across different columns in different places. In this example, the win evaluation row 44 and win evaluation column 46 are indicated by dotted rectangles, the initial outcomes are indicated by dotted circles, and the grid outcome is indicated by a star. These indicators are used for illustrative purposes. It should be understood that, depending upon the embodiment, the game logic 10 may or may not include such indicators.

Figure 7:
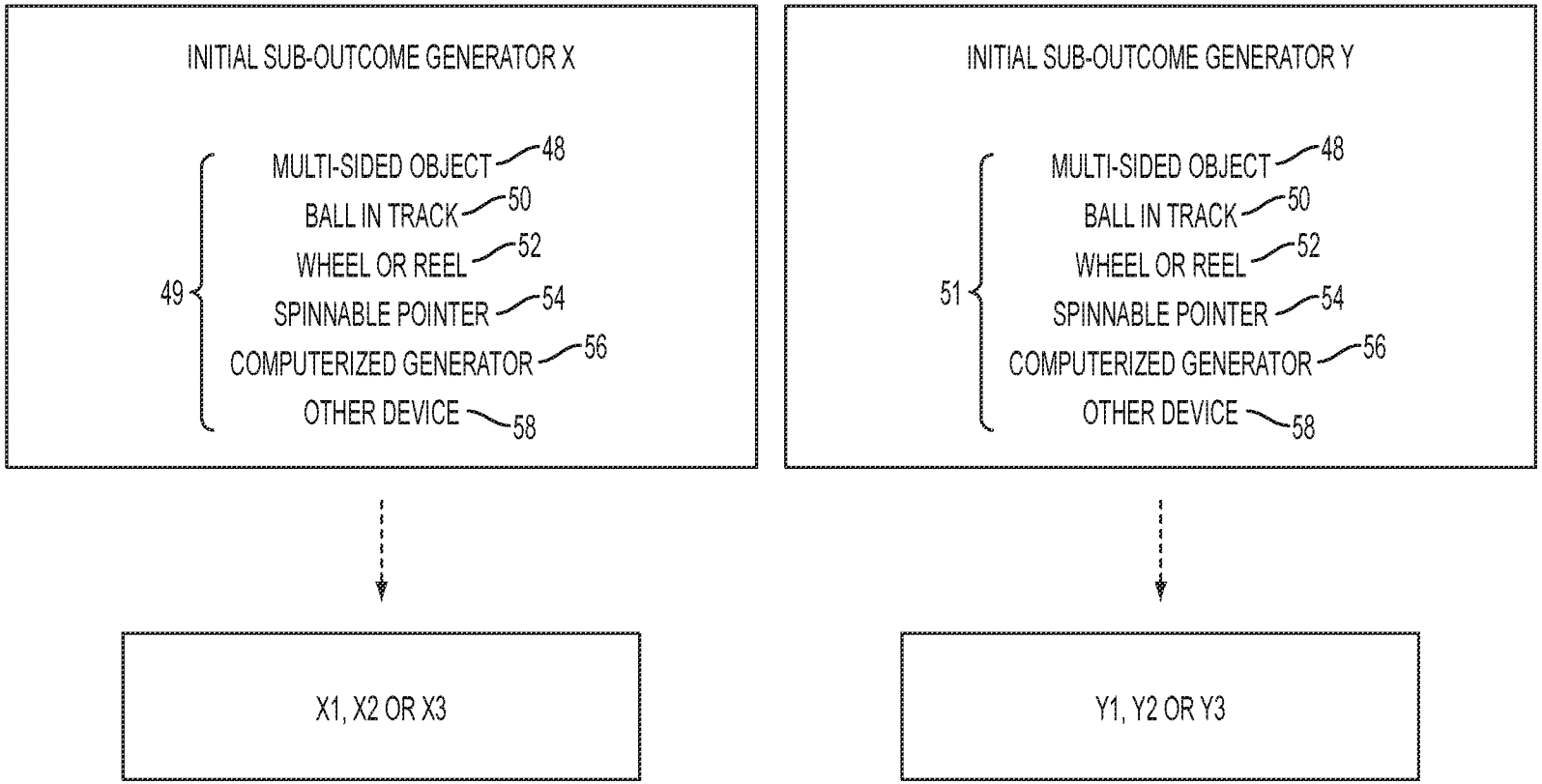
FIG. 7 is a schematic flow diagram illustrating embodiments of the initial outcome generator X and initial outcome generator Y.

Referring to FIG. 7, depending upon the embodiment, the initial sub-outcome generator X and initial sub-outcome generator Y can include a variety of different types of random outcome generators 49 and 51, respectively. In one embodiment, the initial sub-outcome generators include a plurality of multi-sided objects 48, each of which has a plurality of differently-marked faces. The player can toss or roll the multi-sided objects 48, enabling them to land with sides face-up. The face-up values of the objects 48 include, or otherwise form the basis for, the initial outcome of the system.

In one embodiment, the multi-sided object 48 is a conventional, six-sided playing die. The sides are marked with one or more dots to indicate the six different outcomes. In another embodiment, the multi-sided object 48 has a different quantity of sides or sides of different sizes or different shapes.

In another embodiment, each of the initial sub-outcome generators X and Y includes a ball and track assembly 50. The track identifies different ball sub-outcomes adjacent to different positions along the path. The ball rolls in the track, and the stopping position of the ball indicates one of the ball sub-outcomes. The indicated ball sub-outcomes of generators X and Y include, or otherwise form the basis for, the initial outcome of the system.

In one embodiment, each of the initial sub-outcome generators X and Y includes a reel or wheel 52. The wheel 52 displays a plurality of different wheel outcomes. The wheel spins relative to a line or marker. When the wheel stops spinning, the line or marker indicates one of the wheel sub-outcomes. The indicated wheel sub-outcomes of generators X and Y include, or otherwise form the basis for, the initial outcome of the system.

In one embodiment, the initial sub-outcome generator X is one video reel of a slot machine, and the initial sub-outcome generator Y is another video reel of the slot machine. The slot machine has an outcome line which extends through the two video reels. In play, the video reels spin, come to a stop, and display two reel sub-outcomes at the outcome line. The indicated reel sub-outcomes of generators X and Y include, or otherwise form the basis for, the initial outcome of the system.

In another embodiment, each of the initial sub-outcome generators X and Y includes a spinnable pointer 54. Each pointer 54 spins, clockwise or counterclockwise, adjacent to different initial sub-outcome symbols. When each pointer 54 stops spinning, the pointer indicates one of the initial sub-outcome symbols. The indicated spinner sub-outcomes of generators X and Y include, or otherwise form the basis for, the initial outcome of the system.

In one embodiment, where the gaming system 12 is electronic, the initial sub-outcome generator is a computerized sub-outcome generator 56. The computerized sub-outcome generator 56 includes random outcome generator software and associated data which enable a processor to output a plurality of initial sub-outcomes. The random outcome generator software includes a computer program, having one or more algorithms, which is executable by the processor to randomly or pseudo-randomly generate the initial sub-outcomes. It should be appreciated that other suitable devices 58 can be used to generate the initial sub-outcomes of the system.

Figure 8:
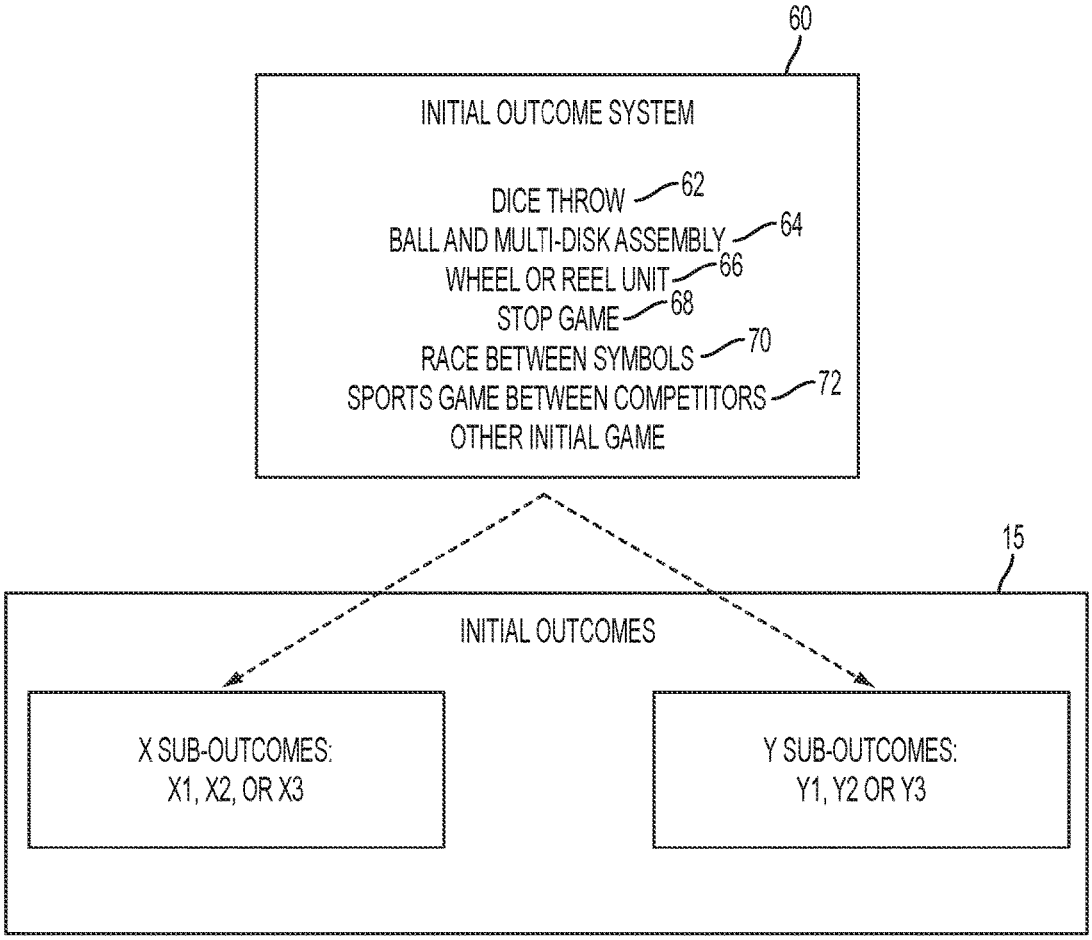
FIG. 8 is a schematic flow diagram illustrating one embodiment of the initial outcome system.

In one embodiment illustrated in FIG. 8, the initial sub-outcomes are the results of the initial outcome system 60. The player plays a game according to the initial outcome system 60, and the end result of the game yields an X sub-outcome and a Y sub-outcome. The X and Y sub-outcomes include, or otherwise form the basis for, the initial outcome of the system.

In the examples illustrated in FIG. 8, the initial outcome system 60 involves a contest or competition between at least two symbols or competitors. For example, in the dice throw game 62, the competitors include dice with different characteristics, such as different colors (i.e., blue and red). The player throws the dice and compares the outcome of one die to the other die. In one embodiment, the comparison between the dice forms the basis for the initial outcome of the system.

In another embodiment, the initial outcome system 60 includes a ball and multi-disk assembly 64. The assembly 64 has a track for a ball and several disks. At least one of the disks rotates independently of the track. Each disk identifies different ball sub-outcomes adjacent to different positions along the track. The ball rolls in the track, and the stopping position of the ball indicates an initial sub-outcome of one disk and an initial sub-outcome of the other disk.

In one embodiment, the initial outcome system 60 includes a wheel or reel unit 66. The wheel or reel unit has a plurality of wheels or reels, each one displaying a plurality of different initial sub-outcomes. The wheels or reels spin relative to a line or marker. When the wheels or reels stop spinning, the line or marker indicates an initial sub-outcome of each of the wheels or reels.

In an alternative embodiment, each wheel 66 has a vertical orientation with a plurality of values on the edge of the wheel as it spins. To start play, the player depresses and holds down an input device, such as a button. This activates the wheel 66, and the wheel spins, increasing in speed until reaching a maximum number of revolutions per minute (RPM) speed. When reaching the maximum RPM, the wheel 66 continues to spin at that speed until the player releases the input device, at which time the wheel gradually slows to randomly designate a particular sub-outcome, as indicated by a pointer or suitable illumination. In one embodiment, once the player releases the input device, the game rules prevent the player from restarting for that betting round.

In another embodiment, the initial sub-outcome system 60 includes a stop game 68. The stop game 68 includes at least two movable symbols or objects which are moving along separate paths. Depending upon the embodiment, the paths can be straight, curved, circular or of any other suitable shape. The stop game 68 displays a plurality of different initial sub-outcome symbols adjacent to each path. When a designated event occurs, such as the player providing a stop input, the moveable symbols begin to gradually stop. The stopping location of the moveable symbols indicates a plurality of the initial sub-outcome symbols.

In one embodiment, the initial outcome system 60 includes a race game 70. The race game 70 includes at least two movable symbols or objects which race against each other along one or more racetracks. Depending upon the embodiment, the racetracks can be straight, curved, circular or of any other suitable shape. The race game 70 has clocks or time displays which display the different race times of the moveable symbols. The race times, winner and loser are the initial sub-outcomes.

In another embodiment, the initial outcome system 60 includes a sports game 72. The sports game 72 includes at least two competing teams, symbols or competitors, including, but not limited to, baseball teams, basketball teams, football teams, soccer teams, golfers, boxers, wrestlers, swimmers, runners or bicyclists. During the sports game 72, the competitors compete. At the end of the game, the sports game displays the final scores of the competitors. The final scores, winner and loser are the initial sub-outcomes. Depending upon the embodiment, the sports game 72 can include a computerized animation or video-based representation displayed by the gaming system 12. It should be appreciated that the initial outcome system 60 can include any other suitable type of initial game.

Figure 9:
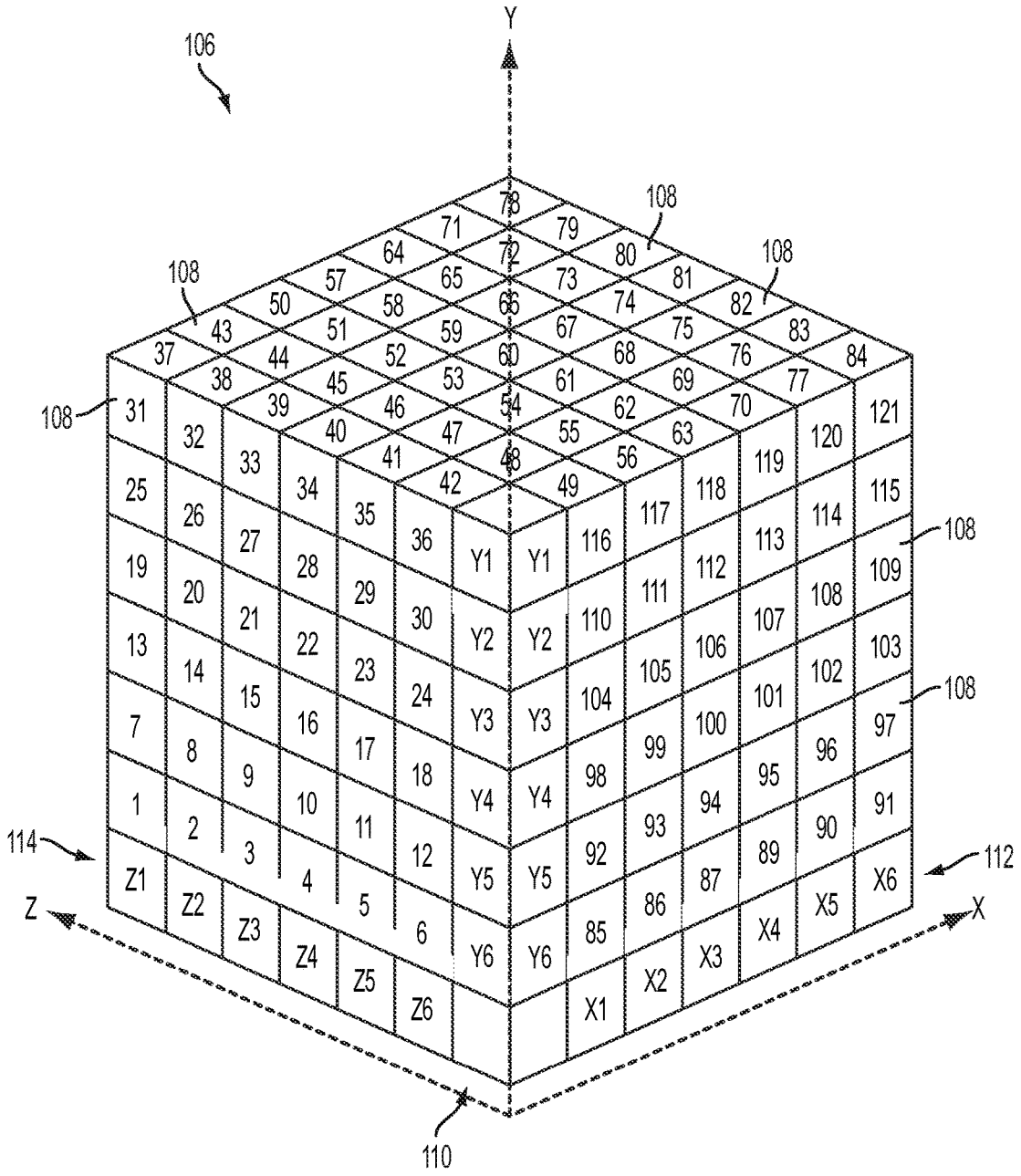
FIG. 9 is an isometric view of one embodiment of the grid cube.

In one embodiment illustrated in FIG. 9, the game logic 10 includes a three-dimensional grid unit or grid cube 106 associated with an X, Y and Z axis. The grid cube 106 includes a plurality of miniature cubes 108. In one embodiment, each of the six faces of the grid cube 106 has forty-nine miniature cubes 108 arranged in a seven by seven grid fashion.

The grid cube 106 includes an outer column 110 displaying initial outcome symbols Y1 through Y6, an outer row 112 displaying initial outcome symbols X1 through X6, and an outer row 114 displaying initial outcome symbols Z1 through Z6. The other miniature cubes 108 of grid cube 106, display grid outcome symbols (not shown). Accordingly, each face of the grid cube 106 displays thirty six different grid outcome symbols. In one example, the six faces of the grid cube 106 display the numerals one through two hundred sixteen as the grid outcome symbols.

For the grid cube 106 embodiment, the game logic 10 includes three dice, for example, an X die, a Y die, and a Z die which are colored red, blue and green, respectively. When the player throws these three dice, the up-facing sides indicate three initial sub-outcomes. These initial sub-outcomes are located on outer row 112, outer row 114 and outer column 110. Similar to the win evaluation method described above with respect to FIG. 6, two win evaluation rows extend across the grid cube in line with the outcomes of the X and Y dice. A win evaluation column extends across the grid in line with the outcome of the Z die. The win evaluation rows and win evaluation column intersect at the space of one of the grid outcome symbols. Such intersection indicates that grid outcome symbol as the grid outcome.

In one example, the grid cube 106 is openable or otherwise provides visibility to the inner faces of the miniature cubes 108. Here, the inner faces also display grid outcome symbols. Depending upon the embodiment, the grid cube 106 can be a structural object or a computerized animation or graphical representation, including, but not limited, to an image generated on a display screen or an image projected in the air or on a surface.

In one embodiment, a three-dimensional (3D) image of the grid cube 106 is generated by a video projector or other suitable image generator. In this embodiment, the 3D image of the grid cube 106 appears to float in the air. The image generator includes one or more light sensors, audio sensors or other suitable input devices which enable the player to rotate the 3D image and manipulate or separate the images of the miniature cubes 108. In this embodiment, the game logic 10 enables the player to wager upon grid outcomes within the grid cube 106.

In one embodiment, the 3D image of the grid cube 106 has a transparent or translucent characteristic. The image generator illuminates the grid outcome wagered upon by the player. In one embodiment, the illumination includes a faint glow of the selected grid outcome or the addition of a translucent color to the selected grid outcome.

In one embodiment, the structure of gaming system 12 includes a conventional, casino-style Craps game table configured to display a plurality of betting areas, as described below. In this embodiment, the image generator produces the 3D image of the grid cube 106 above the table surface.

The game logic 10, combined with the grid cube 106, enables multiple players to wager upon the same grid outcome at the same time. In one example, play of the grid cube 106 is accessible online, over a data network, such as the Internet. Online players may simultaneously wager upon the same or different grid outcomes. In another example, players within the same casino or different casinos may, at different times, progressively wager upon the same or different grid outcomes. This progressive play provides each player with the opportunity of receiving a relatively large progressive award or jackpot payout.

Figure 10:
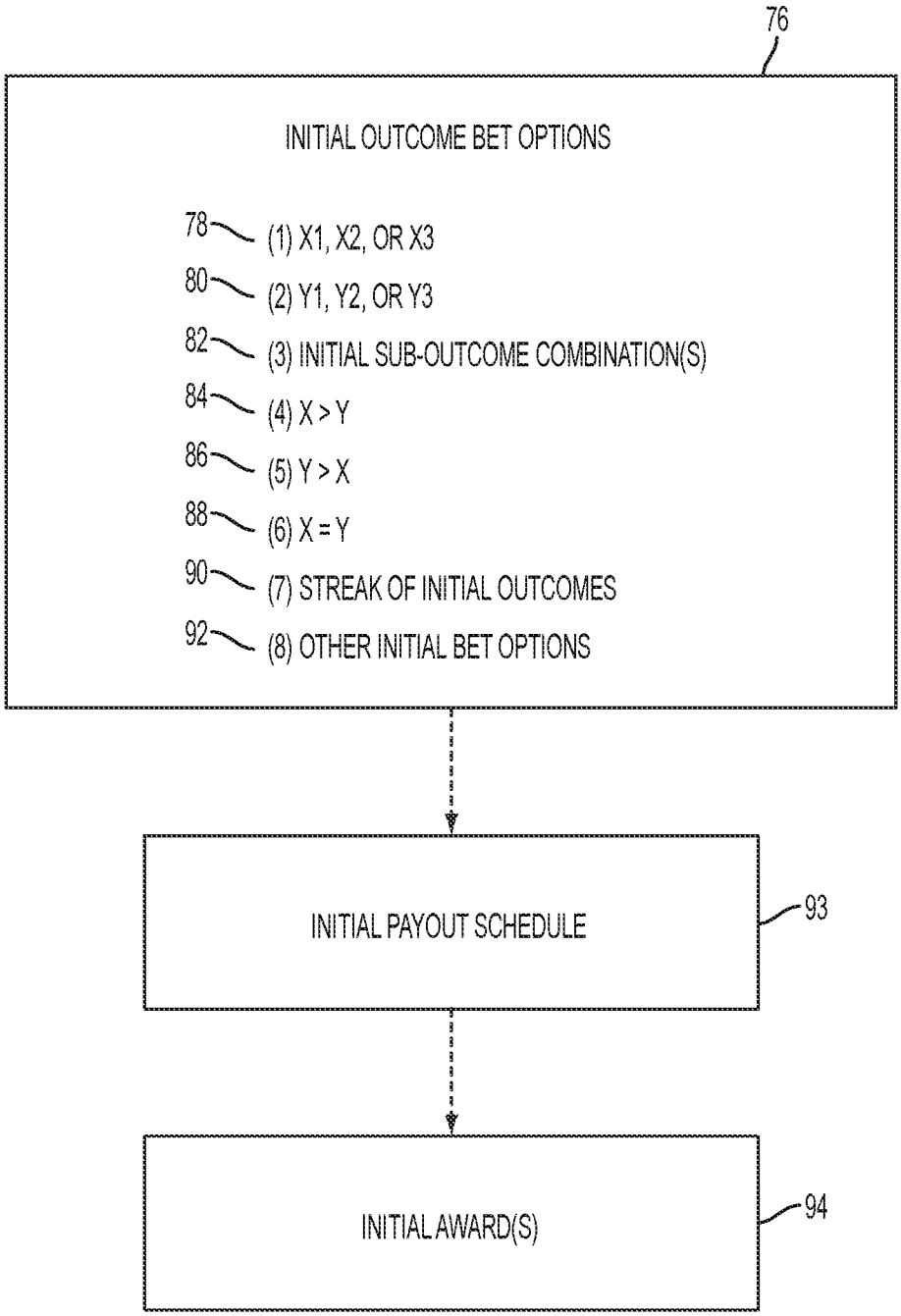
FIG. 10 is a schematic flow diagram illustrating the initial bet options, initial payout schedule and initial awards of one embodiment.

Referring to FIG. 10, the game logic 10 includes a plurality of initial outcome wager options or bet options 76. For example, the game logic 10 enables the player to bet on one, more or all of the initial sub-outcomes 78 and 80. The player may also wager upon one, more or all of the initial outcomes 82, 84, 86, 88, 90 and 92. If the game play results in one of the wagered-upon outcomes, the game logic applies a predetermined initial outcome system payout table or payout schedule 93. The payout schedule 93 includes a plurality of different payout rates, for example, the odds against winning being 1 to 1, 7 to 6, and 9 to 5, associated with different initial bet options 76. Based on the payout schedule 93, the game logic 10 provides, reserves or allocates an initial outcome system award 94 to the player.

Figure 11:
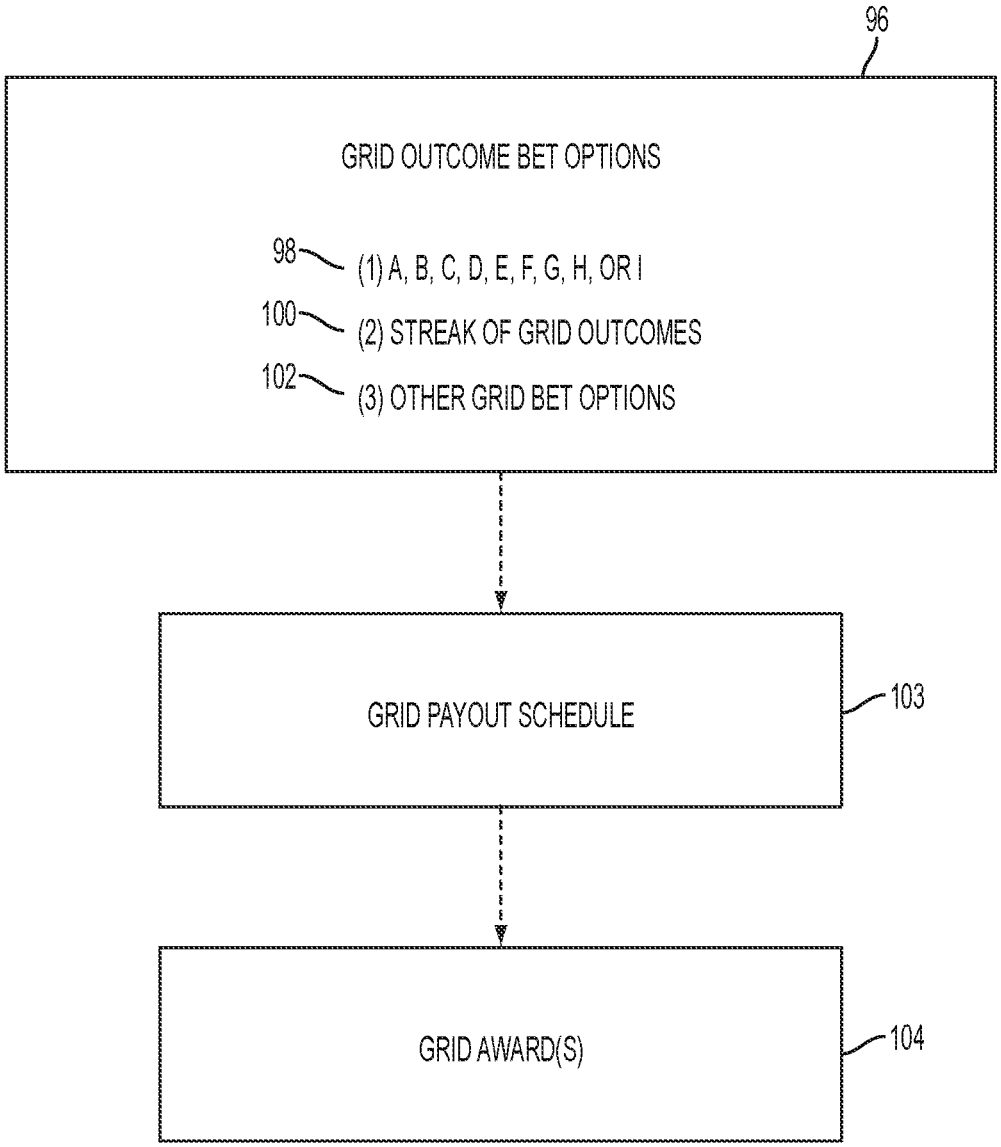
FIG. 11 is a schematic flow diagram illustrating the grid bet options, grid payout schedule and grid awards of one embodiment.

As illustrated in FIG. 11, the game logic 10 includes a plurality of grid outcome wager options or bet options 96. For example, the game logic 10 enables the player to bet on one, more or all of the grid outcomes 98, 100 and 102. If the game play results in one of the wagered-upon outcomes, the game logic applies a predetermined secondary outcome system payout table or payout schedule 103. The payout schedule 103 includes a plurality of different payout rates, for example, the odds against winning being 1 to 1, 4 to 5, 5 to 11 and 7 to 6, associated with different bet options 96. Based on the payout schedule 103, the game logic 10 provides, reserves or allocates a secondary outcome system award 104 to the player.

Figure 12:
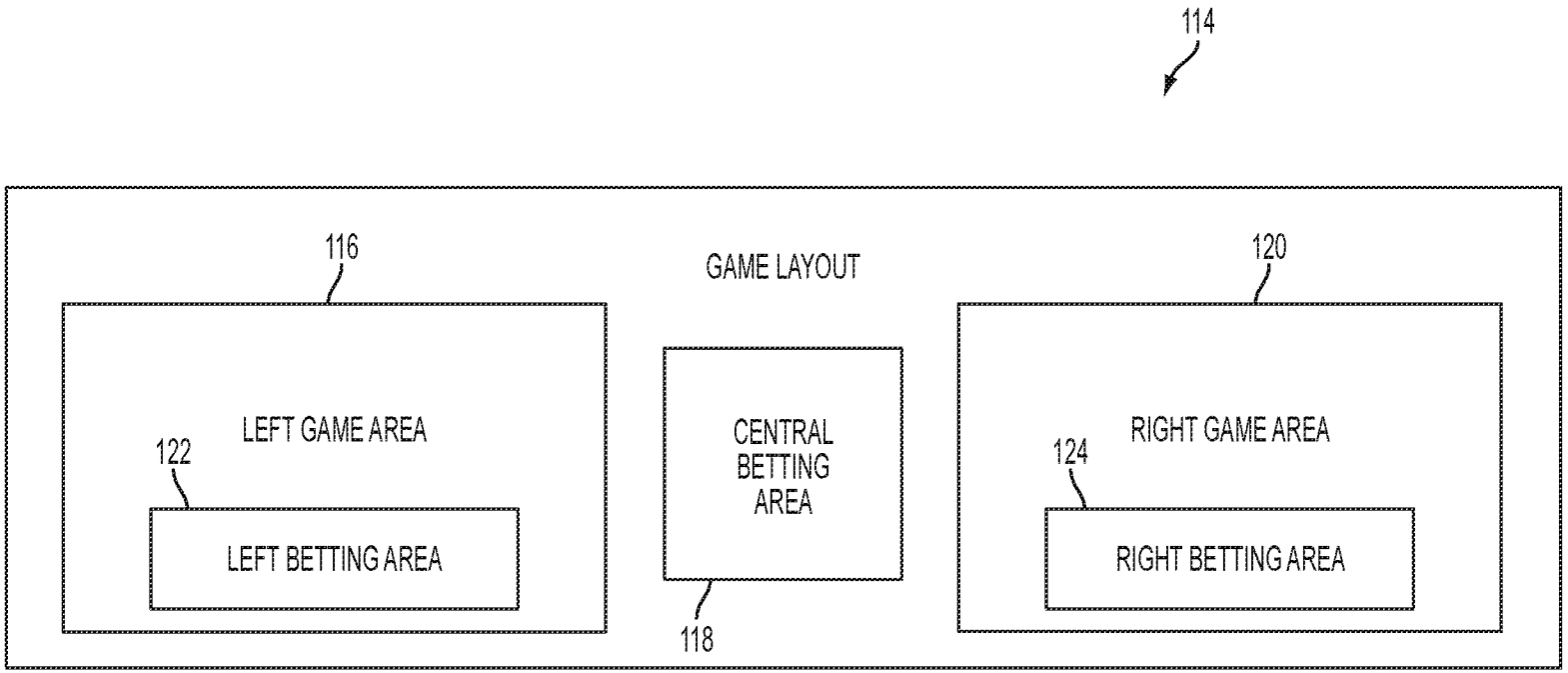
FIG. 12 is a top plan view of the game layout of one embodiment.

In one embodiment illustrated in FIG. 12, the game logic 10 is incorporated into game layout 114. Game layout 114 is configured for the play of the initial outcome system 60 and secondary outcome system 22. The layout 114 includes a left game area 116, a central betting area 118 and a right game area 120. The left game area 116 includes one or more left betting areas, such as left betting area 122. Likewise, the right game area 120 includes one or more right betting areas, such as right betting area 124.

Dice-Based Gaming System

Figure 13:
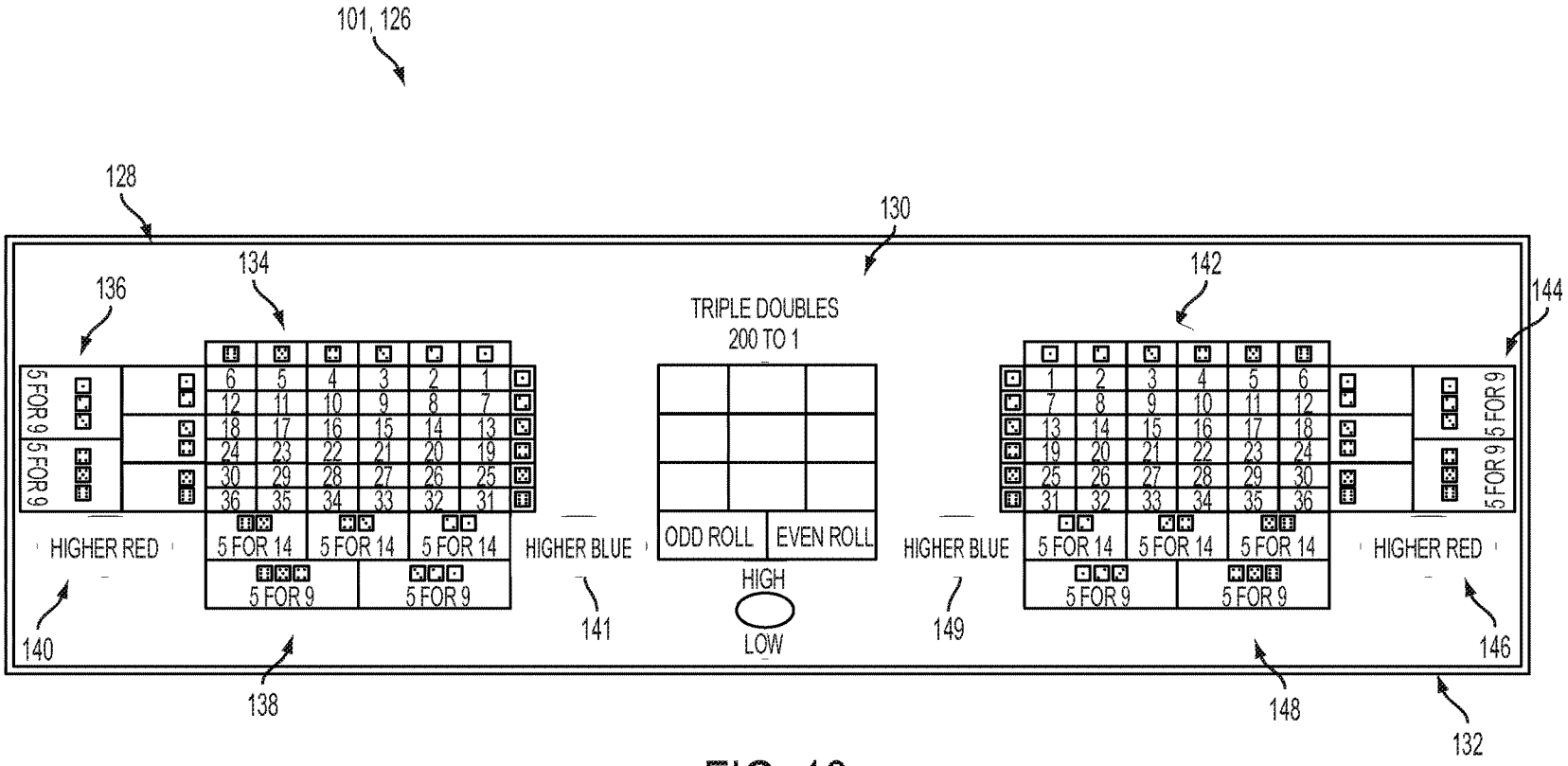
FIG. 13 is a top plan view of the game layout of another embodiment.

In one embodiment illustrated in FIG. 13, the gaming system 101 includes the game layout 126 for playing a dice game based on six-sided playing dice. This dice game includes an initial outcome system and secondary outcome system, which have the logic of the initial outcome system 60 and secondary outcome system 22, respectively, described above. The initial outcome system involves wagering upon the initial outcomes, which include the various outcomes of the dice, for example, odd, even, or doubles. The secondary outcome system involves wagering upon the grid outcomes, which include the values and locations of the dice sum on the grid described below.

The layout 126 includes a left game area 128, a central betting area 130 and a right game area 132. The left game area 128 includes a left game grid 134 and left betting areas 136, 138, 140 and 141. The right game area 132 is the mirror image of the left betting area 128. Likewise, the right game area 132 includes a right game grid 142, and right betting areas 144, 146, 148 and 149.

The central betting area 130 provides proposition bet options for the play of the gaming system 101. The layout 126 is configured with a size which is the same as or similar to the layout size of a full-sized, casino Craps table. Therefore, the left game area 128 enables a group of players to play on the left side of the table, and the right game area 132 enables another group of players to play on the right side of the table.

Figure 14:
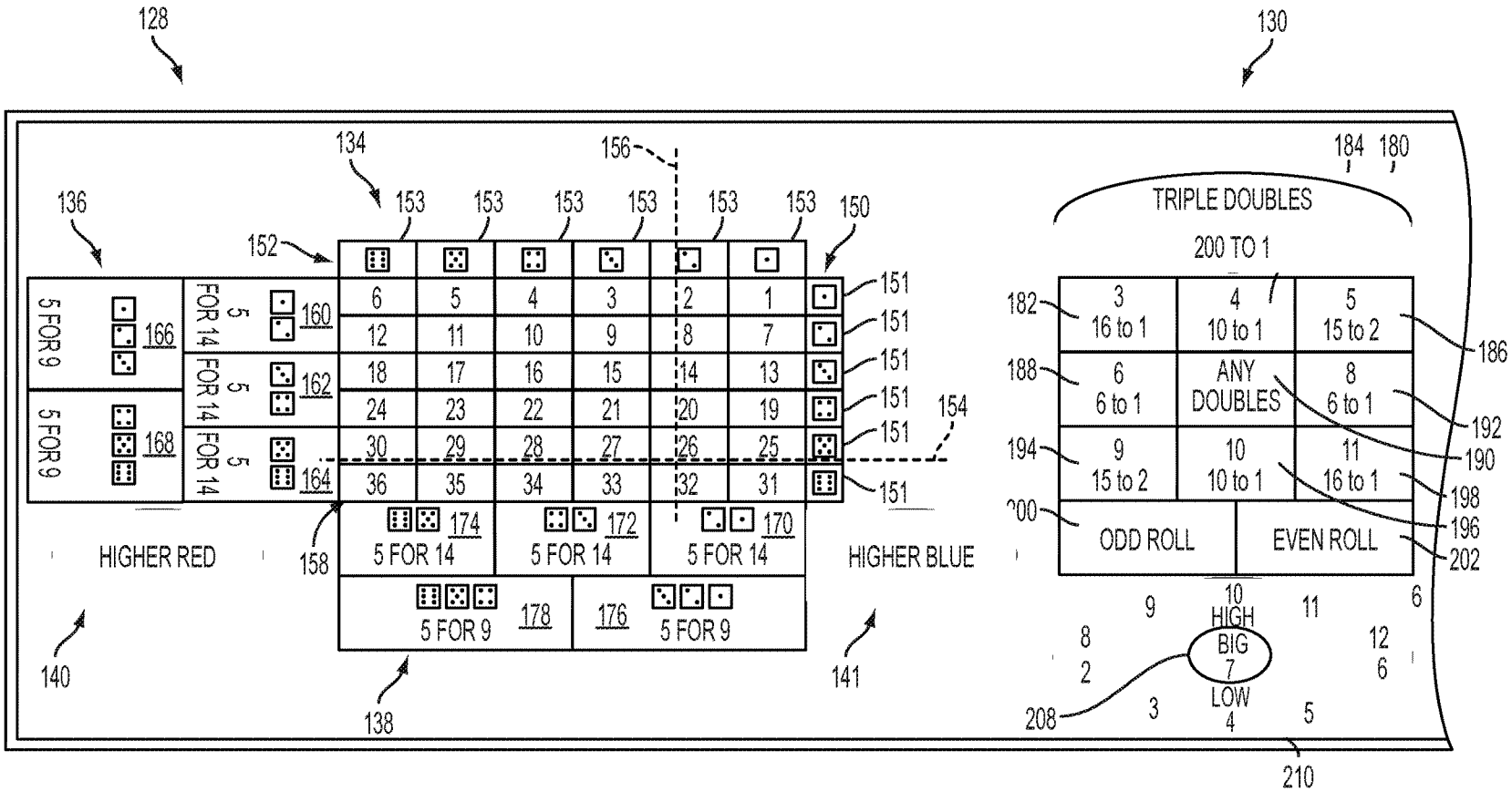
FIG. 14 is an enlarged, fragmentary view of the left side of the game layout of FIG. 13.

Since the right game area 132 is the mirror image of the left game area 128, the following description focuses on the left game area 128 and the central betting area 130. It should be understood that the structure, logic and functionality of the right game area 132 are the same as that of the left game area 128. Referring to FIG. 14, the initial sub-outcome generators of this dice game include a pair of dice for a play of the game. In the example shown, the dice include a red-colored die and a blue-colored die. The left game grid 134 includes a seven by seven grid or matrix, including a right, outer column 150 and an upper, outer row 152. The outer column 150 has a blue color pattern and is associated with the blue die. The outer row 152 has a red color pattern and is associated with the red die. The outer column 150 displays the six initial sub-outcomes 151 associated with the blue die, including face-up values of 1, 2, 3, 4, 5 and 6. The outer row 152 displays the six initial sub-outcomes 153 associated with the red die, including face-up values of 1, 2, 3, 4, 5 and 6. The initial sub-outcome value, 1, of the outer column 150 and outer row 152 are located adjacent to each other. For each of the outer column 150 and outer row 152, the initial sub-outcome values are sequentially ordered by increasing magnitude.

It should be appreciated that any suitable color system can be used for the dice and grid, including, but not limited to, blue and red. Depending upon the embodiment, the dice can be differentiated by characteristics other than color, including, but not limited to, artwork, symbols, texture, shape, size and weight.

The grid outcomes are centrally located below the outer row 152 and to the left of the outer column 150. In this embodiment, each grid outcome is the sum of the face-up value of the blue die and the face-up value of the red die. Since each of the die has six sides, there are thirty-six possible grid outcomes. The central area of the grid 134 displays these grid outcomes, numbered one through thirty-six.

The player places a grid wager upon one of the grid outcomes. For example, the player may place his/her betting chip on the space of the grid outcome, twenty-six. In this example, the blue die lands face-up with a value of five, and the red die lands face-up with a value of two. The win evaluation row, represented by dotted line 154, extends through the blue die value five. The win evaluation column, represented by dotted line 156, extends through the red die value two. Since the grid outcome, twenty-six, is located at the intersection of lines 154 and 156, the player would have won the grid bet. It should be understood that the dotted lines 154 and 156 are shown for illustrative purposes and are not displayed to the players in this embodiment. In this embodiment, the grid 134 is large enough to facilitate the player's evaluation of intersection wins and losses without visual aids.

Because of the arrangement of the initial sub-outcome values 151 and 153 described above, the identical red and blue dice values are the same number of spaces from the associated intersection space. For example, the red die value of three and the blue die value of three correspond to an intersection at grid outcome fifteen. The red die value of three is three spaces from the grid outcome fifteen, and the blue die value of three is three spaces from the grid outcome fifteen. Therefore, the grid 134 is associated with a doubles win diagonal line 158. If the player achieves doubles, the doubles grid outcome is displayed at one of the spaces along the doubles win diagonal line 158.

The left betting area 136, illustrated in FIG. 14, includes a plurality of blue die group betting areas 160, 162, 164, 166 and 168. As provided in the following table, each blue die group betting area displays a group of grid outcomes and the payout rate, or odds against winning, associated with achieving any one of the outcomes in the group, and each of these groups is related to designated rows in the grid as follows:

TABLE A

| Blue Group Betting Area | Related Rows | Blue Group of Grid Outcomes | Payout Rate |
|---|---|---|---|
| 160 | Top two rows of grid outcomes | 1, 2, 3, 4, 5, 6, 7, 8, 9, 10, 11, 12 | 5 to 14 |
| 162 | Middle two rows of grid outcomes | 13, 14, 15, 16, 17, 18, 19, 20, 21, 22, 23, 24 | 5 to 14 |
| 164 | Bottom two rows of grid outcomes | 25, 26, 27, 28, 29, 30, 31, 32, 33, 34, 35, 36 | 5 to 14 |
| 166 | Top three rows of grid outcomes | 1, 2, 3, 4, 5, 6, 7, 8, 9, 10, 11, 12, 13, 14, 15, 16, 17, 18 | 5 to 9 |
| 168 | Bottom three rows of grid outcomes | 19, 20, 21, 22, 23, 24, 25, 26, 27, 28, 29, 30, 31, 32, 33, 34, 35, 36 | 5 to 9 |

The left betting area 138 also includes a plurality of red die group betting areas 170, 172, 174, 176 and 178. As provided in the following table, each red die group betting area displays a group of grid outcomes and the payout rate, or odds against winning, associated with achieving any one of the outcomes in the group, and each of these groups is related to designated columns in the grid as follows:

TABLE B

| Red Group Betting Area | Related Columns | Red Group of Grid Outcomes | Payout Rate |
|---|---|---|---|
| 170 | Right two columns of grid outcomes | 1, 2, 7, 8, 13, 14, 19, 20, 25, 26, 31, 32 | 5 to 14 |
| 172 | Middle two columns of grid outcomes | 3, 4, 9, 10, 15, 16, 21, 22, 27, 28, 33, 34 | 5 to 14 |
| 174 | Left two columns of grid outcomes | 5, 6, 11, 12, 17, 18, 23, 24, 29, 30, 35, 36 | 5 to 14 |
| 176 | Right three columns of grid outcomes | 1, 2, 3, 7, 8, 9, 13, 14, 15, 19, 20, 21, 25, 26, 27, 31, 32, 33 | 5 to 9 |
| 178 | Left three Columns of grid outcomes | 4, 5, 6, 10, 11, 12, 16, 17, 18, 22, 23, 24, 28, 29, 30, 34, 35, 36 | 5 to 9 |

The proposition bets include the bet options displayed in the central betting area 118 as well as the bet options displayed in the left betting area 140. The left betting area 140 provides a space for placing an initial bet that the red die will be higher than the blue die. The right betting area 141 provides a space for placing an initial bet that the blue die will be higher than the red die. Referring to FIG. 14, the central betting area 118 includes areas 180, 182, 184, 186, 188, 190, 192, 194, 196, 198, 200, 202, 206, 208 and 210 for betting on initial outcomes as follows:

TABLE C

| Betting Area | Initial Outcome | Payout Rate |
|---|---|---|
| 180 | Three consecutive doubles outcomes of dice rolls | 200 to 1 |
| 182 | Dice sum: three | 16 to 1 |
| 184 | Dice sum: four | 10 to 1 |
| 186 | Dice sum: five | 15 to 2 |
| 188 | Dice sum: six | 6 to 1 |
| 190 | Any doubles outcome of a dice roll | 5 to 1 |
| 192 | Dice sum: eight | 6 to 1 |
| 194 | Dice sum: nine | 15 to 2 |
| 196 | Dice sum: ten | 10 to 1 |

TABLE C-continued

| Betting Area | Initial Outcome | Payout Rate |
|---|---|---|
| 198 | Dice sum: eleven | 15 to 1 |
| 200 | Dice sum: odd | 15 to 9 |
| 202 | Dice sum: even | 15 to 9 |
| 206 | High: dice sum of eight, nine, ten, eleven, or twelve | Suitable, predetermined rate |
| 208 | Dice sum: seven | 5 to 1 |
| 210 | Low: dice sum of two, three, four, five or six | Suitable, predetermined rate |

In one embodiment, the gaming system 101 includes the following additional proposition bets, each of which is associated with a suitable, predetermined payout rate:

TABLE D

| Initial Outcome | Example |
|---|---|
| Streak of consecutive, identical outcomes of dice rolls | A) Two consecutive rolls of the dice result in red being higher than blue.<br>B) Four consecutive rolls of the dice result in value six of the red die and value six of the blue die. |
| Doubles outcome of a specified value | A roll of the dice results in value four of the red die and value four of the blue die. |

In one embodiment, the gaming system 101 includes the following additional grid bets, each of which is associated with a suitable, predetermined payout rate:

TABLE E

| Grid Outcome | Description |
|---|---|
| Odd Winner | Winning number on the grid will be odd. |
| Even Winner | Winning number on the grid will be even. |
| The Field | Wagering on numbers designated as part of "The Field." |
| Row Combination | Winning number on the grid will be within a selectable combination of rows. |
| Column Combination | Winning number on the grid will be within a selectable combination of columns. |
| Line Wager | Winning number on the grid will be one of several grid numbers which are positioned adjacent to each other, similar to the game of Roulette. The numbers are collectively selectable by placement of a single betting chip on the line that separates the grid numbers. |
| Corner Wager | Winning number on the grid will be one of the four numbers in the four corners of the grid, similar to the game of Roulette. |

In one embodiment, the gaming system includes non-standard, multi-sided dice instead of the standard six-sided dice. For example, each non-standard multi-sided die may have four, six, eight, ten, twelve, twenty or one hundred sides, or any other suitable number of sides. In another embodiment, the gaming system includes dice with different geometries. For example, a green die may have six sides, and a yellow die may have eight sides. In each such embodiment, the layout and grid would be altered to accommodate the outcomes of such non-standard or irregular multi-sided dice. Likewise, the odds and payouts would change accordingly. In one example, the gaming system includes a ten-sided red die and a six-sided blue die. In this example, the grid has ten red columns and six blue rows.

For certain grid outcomes, such as those with relatively low odds of winning, the gaming system includes a progressive award or jackpot award. For example, if the player wagers on a four-time streak of doubles with the value of six, the player may have the opportunity to win a predetermined jackpot award. In one embodiment, the layout of gaming system 101 includes a bonus dollar area (not shown). In this bonus dollar area, each player can make a side bonus bet associated with a particular, and relatively low odds outcome. If such outcome occurs, the gaming system 101 provides an additional payout for the players who placed side bonus bets in the bonus dollar area. In one embodiment, the layout of the gaming system includes a payout table displaying the payout rate for this side bonus bet. In an electronic embodiment, the computer code of the gaming system includes the payout rate associated with the side bonus bet.

It should be understood that the streak quantity can be two, four or any other suitable quantity. In one example, the player places a ten dollar wager on the proposition betting area 180. For the duration of three consecutive rolls of the dice, the player keeps a five dollar wager on the bet of red being higher than blue. The player wins those three wagers, and the gaming system awards the player with a payout based on the five dollar wagers in addition to a payout based on the ten dollar wager.

In one example, several players approach the playing table. The playing table has the same dimensions as a standard casino Craps table, and it has a gaming felt or overlay with the layout 126. The gaming system 101 requires the same number of people running the table as a standard Craps game, that is, two croupiers to assist with betting and providing payouts, a dealer or pitman to make final decisions on rules and standard play, and a stickman or croupier to deliver and clear the dice and to also assist with proposition bets.

At the beginning of a new game, the player begins to place wagers. For example, the player may place an initial wager of five dollars on the "Higher Blue" proposition bet. In this example, the player may place his/her five dollar chip on the "Higher Blue" bet space 204. At the same time, the player may place a grid wager of ten dollars on a desired one of the thirty-six numbers in the grid 134. In this example, the player may place his/her ten dollar chip on the desired number.

After this, the dealer passes a set of six dice to the player, three of blue color and three of red color. In one embedment, it is a requirement that the dice or pips within the dice, or a combination of both characteristics, be of two distinctly different colors as determined by the house. The player selects two of the six dice, one red and one blue. The dealer clears the remaining dice, pulling them back to the table reservoir in front of the dealer, near the house chip stack on the table. The dealer allows for the placing of final wagers, and upon doing so, closes the betting with a sweeping motion of his/her arm and a declaration of "no more bets."

At this time, the player throws or rolls his/her selected dice, aiming to hit, and preferably rebound off of, the bombardment wall at the end of the table furthest from the player. The croupier marks the outcome number with a designated marker placed at the intersection of the X and Y axes. If, in the example set forth above, the outcome were the blue die being higher than the red die, the player would additionally receive a payout based on his/her five dollar "Higher Blue" proposition wager. If the player had wagered upon the outcome number, the player would receive a payout based on his/her ten dollar wager. In this way, the winnings of both the initial wager and secondary, grid wager are determined by a single roll of the dice.

After the player receives his/her payouts, if any, the dealer clears the table and then passes the dice in a clockwise fashion around the table to the next player immediately to the left of the current player. The exception to this rule is if the player rolls a "double," in which case the current player would have the option to maintain control of the dice and make the subsequent roll. Regardless of whether the player rolls a double, he/she has the option of passing the dice to the next player. That player may elect to pass his/her roll on to the next person, rather than take his/her turn at rolling the dice. Once the next player is determined, game play resumes.

Figure 15:
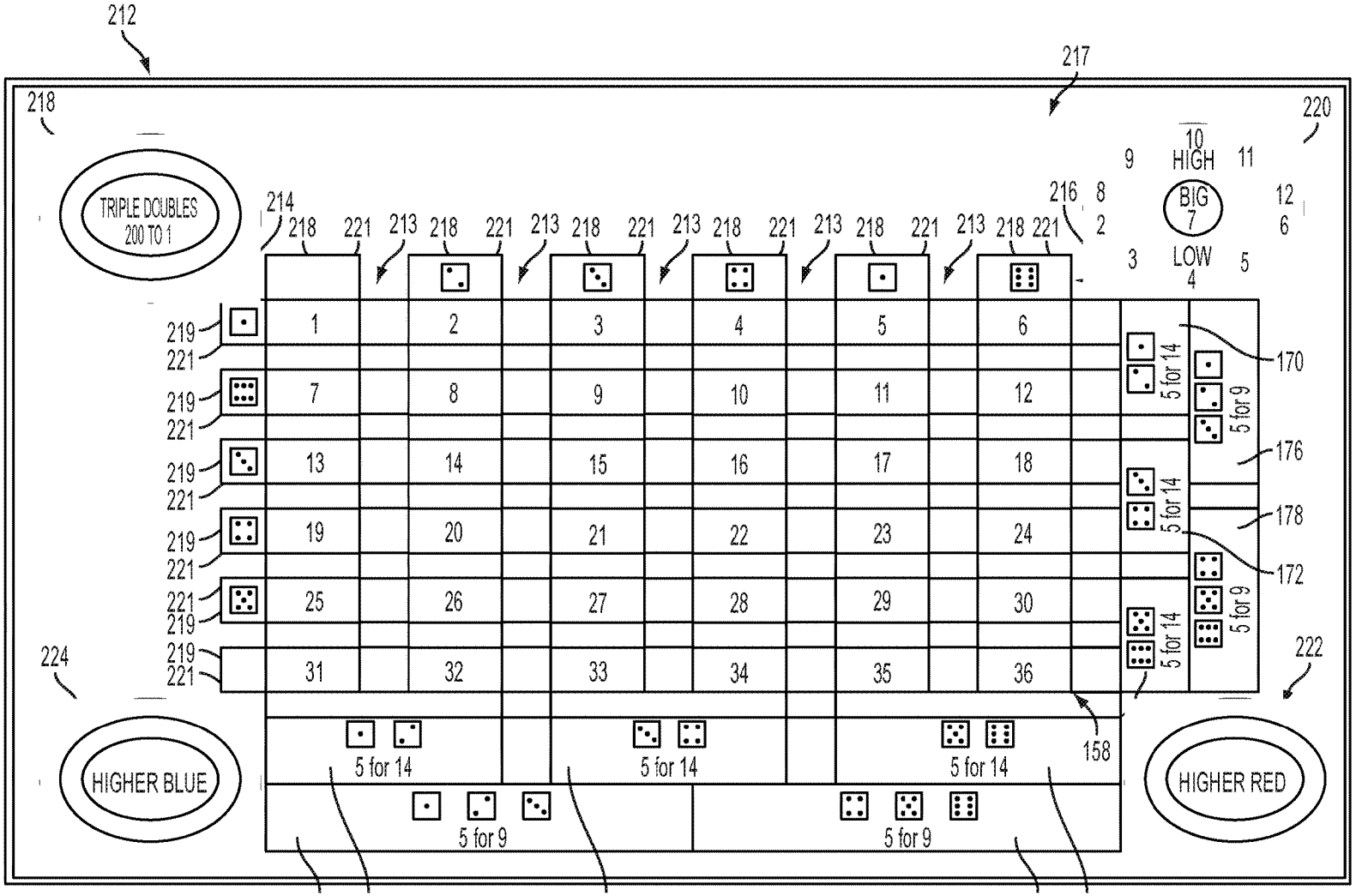
FIG. 15 is a top plan view of one embodiment of the game layout illustrating randomly placed dice on the outer die column and outer die row.

In one embodiment illustrated in FIG. 15, the gaming system 212 includes an electronic display device, a processor which controls the display device, an outer column 214 associated with the blue die, an outer row 216 associated with the red die, and a six by six grid 217, displaying numbers one through thirty-six.

In the configuration of gaming system 212, the columns are approximately twice as wide as the height of the rows. This configuration provides space for the use of standard denominational chips utilized by most casinos. The intermediate space 213 between the numbered rectangles on the playing grid may be used for the placement of line bets and corner bets as in Roulette. The wide columns provide space for chips of multiple players, and the locations of the chips correspond to the positions of the players at the table.

For example, player A is standing to the left of player B. Player A's chip is placed at grid outcome twenty-two. Player B's chip is placed at grid outcome twenty-two, positioned to the right of player A's chip. The wider columns provide the space for this function. This type of player-position wagering, which is similar to the manner in which bets are made in the game of Craps, facilitates the tracking of the players with their bets. In one embodiment, with the benefit of this player-position wagering, the gaming system 212 is operable for multiple players with a single color of chips of the same denomination. In another embodiment, the gaming system 212 has different colored chips of the same denomination for use by multiple players.

The display device of system 212 displays the red initial sub-outcomes or red die values 218. The display device also displays the blue initial sub-outcomes or blue die values 219. In one embodiment, the display device includes one display screen which displays the red die values 218 and the blue die values 219. In another embodiment, the display device includes multiple display screens. One of the screens displays the red die values 218, and another screen displays the blue die values 219. In yet another embodiment, the display device includes six miniature display screens for each of the red die values 218, and the display device includes six miniature display screens for each of the blue die values 219. In this embodiment, the display device has twelve miniature display screens.

Depending upon the embodiment, the display device can include a liquid crystal display (LCD) panel which a backlight, including, but not limited to, a fluorescent light module or a light emitting diode (LED) light module. The LCD panel generates images of dice or die values by activating pixels. Alternatively, the display device can include an array, grid or matrix of relatively small LEDs or light sources. The processor controls the activation and deactivation of the light sources to generate predetermined dots or symbols representing the different die values.

In one embodiment, the screens of the display device are touch-enabled to receive touch inputs from players. The gaming system 212 enables the player to touch and activate the initial sub-outcome spaces 221 of the dice values 218 and 219.

In one embodiment, the gaming system 212 includes a play button or keypad which is operable to receive player inputs for the generation of die values at the initial sub-outcome spaces 221. In one embodiment, the gaming system 212 includes one or more battery-powered, mobile input devices, such as a button module. The mobile input device includes a transceiver operable to wirelessly communicate with the processor of the gaming system 212. The player can hold the mobile input device when pressing the play button. After use, the player or dealer can pass the mobile input device to the next player at the table.

In one embodiment, the play button has a light source and is configured to display different colors at different states of the game. For example, before game play starts, the play button may display a green color indicating a readiness state. After the button is pressed and game play begins, the play button may display a red color indicating an off state.

In one example, the player pushes a play button, and the processor receives a play start signal. In response to the start signal, the processor causes the display device to display the dice values one through six at the initial sub-outcome spaces 221. Depending upon the embodiment, the display device can dynamically display various outcome numbers, randomly or in any suitable order. After a period of time elapses, the processor stops the dynamic display, and the display device displays the blue dice values along the Y-axis and the red die values along the X-axis. In the example shown in FIG. 15, the final, red die values, from left to right, are five, two, three, four, one and six. The final, blue die values, from bottom to top, are two, five, four, three, six, and one. Now that the die values are set, the players are ready to place their wagers.

To facilitate wagering, the gaming system 212 includes a plurality of bet areas for wagering on the initial outcomes, including a doubles streak bet area 218, a high-low bet area 220, a high red bet area 222, and a high blue bet area 224. In the example shown in FIG. 15, the doubles streak area 218 enables the player to place a wager on the following possible outcomes: (a) a doubles of the dice roll; (b) a two-time streak of sequential doubles of the dice roll; and (c) a three-time streak of sequential doubles of the dice roll.

The high-low bet area 220 enables the player to place a wager on the following possible outcomes: (a) the dice sum being high, that is, a value of eight, nine, ten, eleven or twelve; (b) the dice sum being low, that is, a value of two, three, four, five and six; and (c) "big 7," that is, the dice sum being seven.

The high red bet area 222 enables the player to place a wager on the following possible outcomes: (a) the red die value being higher than the blue die value after one roll; (b) the red die value being higher than the blue die value in a streak of two sequential rolls; and (c) the red die value being higher than the blue die value in a streak of three sequential rolls.

The high blue bet area 224 enables the player to place a wager on the following possible outcomes: (a) the blue die value being higher than the red die value after one roll; (b) the blue die value being higher than the red die value in a streak of two sequential rolls; and (c) the blue die value being higher than the red die value in a streak of three sequential rolls.

The gaming system 212 has a plurality of blue die group betting areas 160, 162, 164, 166 and 168 as described above. Gaming system 212 has red die group betting areas 170, 172, 174, 176 and 178 as described above.

Figure 16:
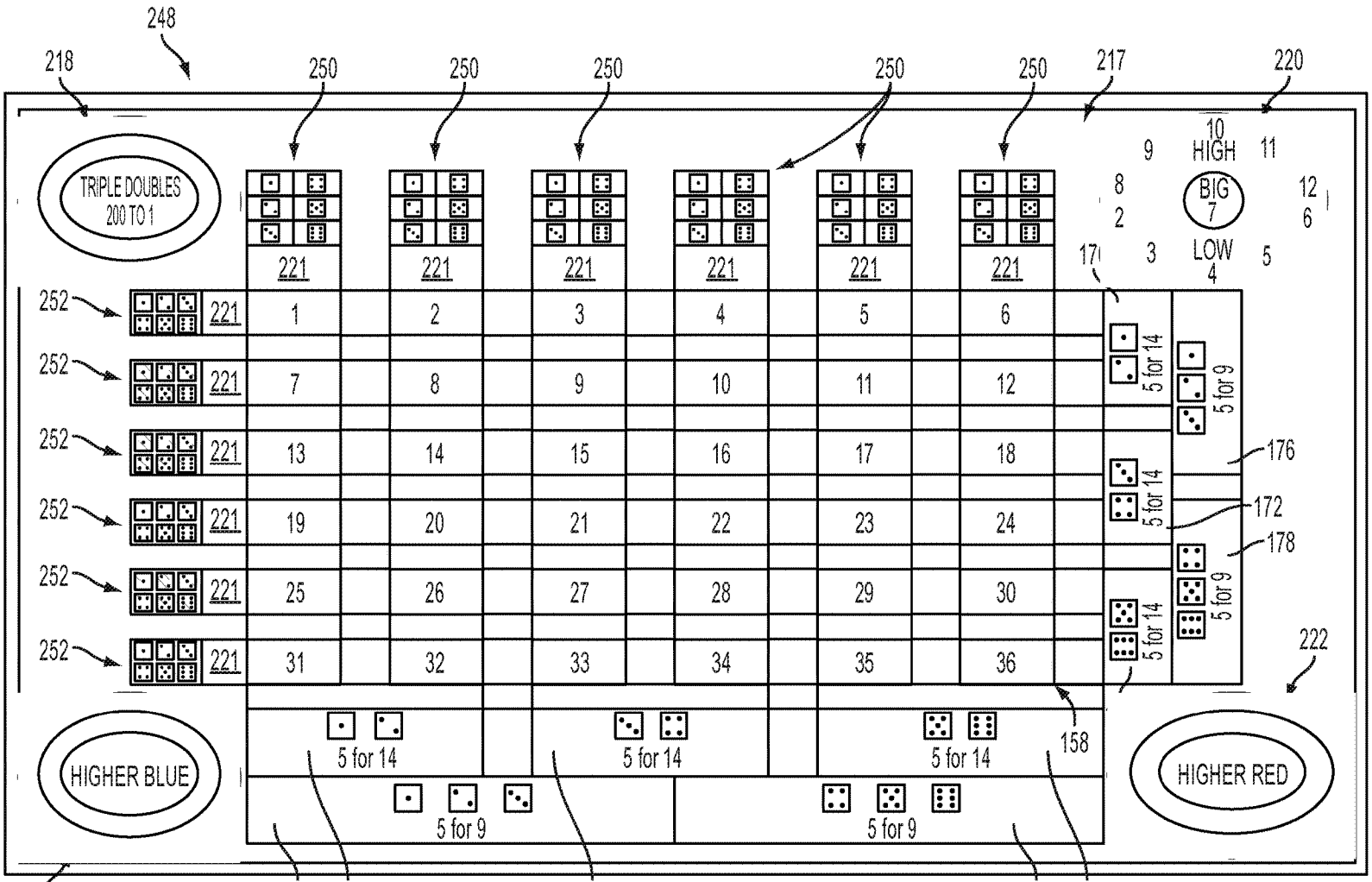
FIG. 16 is a top plan view of one embodiment of the game layout illustrating randomly placed dice on the outer die column and outer die row, further illustrating the dice betting areas for wagering on the randomly placed dice.

In one embodiment illustrated in FIG. 16, the gaming system 248 is the same as gaming system 212 except that gaming system 248 has red initial sub-outcome wager areas 250 and blue initial sub-outcome wager areas 252. Each red initial sub-outcome wager area 250 is located adjacent to one of the sub-outcome spaces 221 at the top of one of the outer columns of grid 217. Each blue initial sub-outcome wager area 252 is located adjacent to one of the outcome spaces 221 the left of one of the rows of grid 217.

In the example illustrated, each of the wager areas 250 and 252 displays or otherwise indicates the six possible outcomes of the roll of a die, that is, the six die values. Each of the wager areas 250 and 252 provides the space for a betting chip or marker associated with a wager. In one embodiment, the wager areas 250 and 252 are images generated by the electronic display device.

In operation of one example, the following steps are performed:

(a) The player places a five dollar chip on the die value, three, of the red initial sub-outcome wager area 250 of the far right column;

(b) The player places a ten dollar chip on the high blue bet area 224;

(c) The player presses a game start button, and the gaming system 248 randomly generates red and blue die values for the grid 217 and displays the die values at the spaces 221;

(d) The player places a twenty dollar chip on the grid outcome, twenty-eight, in the grid 217;

(e) The player rolls the red and blue dice;

(f) If the gaming system 248 generates die value, three, at space 221 of the far right column, the player receives a payout based on the five dollar wager and a suitable payout rate;

(g) If the dice roll results in the blue die being higher in value than the red die, the player receives a payout based on the ten dollar wager and a suitable payout rate; and (h) If the column of the resulting red die and the row of the resulting blue die intersect at the grid outcome, twenty-eight, the player receives a payout based on the twenty dollar wager and a suitable payout rate.

As illustrated by this example, the gaming system 248 provides three levels of wagering. First, the player can wager on which die values will be generated for the outer row along the X-axis and which ones will be generated for the outer column along the Y-axis. Second, the player can wager on the initial outcomes of the dice roll, for example, whether the red die will be higher than the blue die. Third, the player can wager on the grid outcome, for example, whether the row and column of the dice values will intersect at any given grid number.

Figure 17:
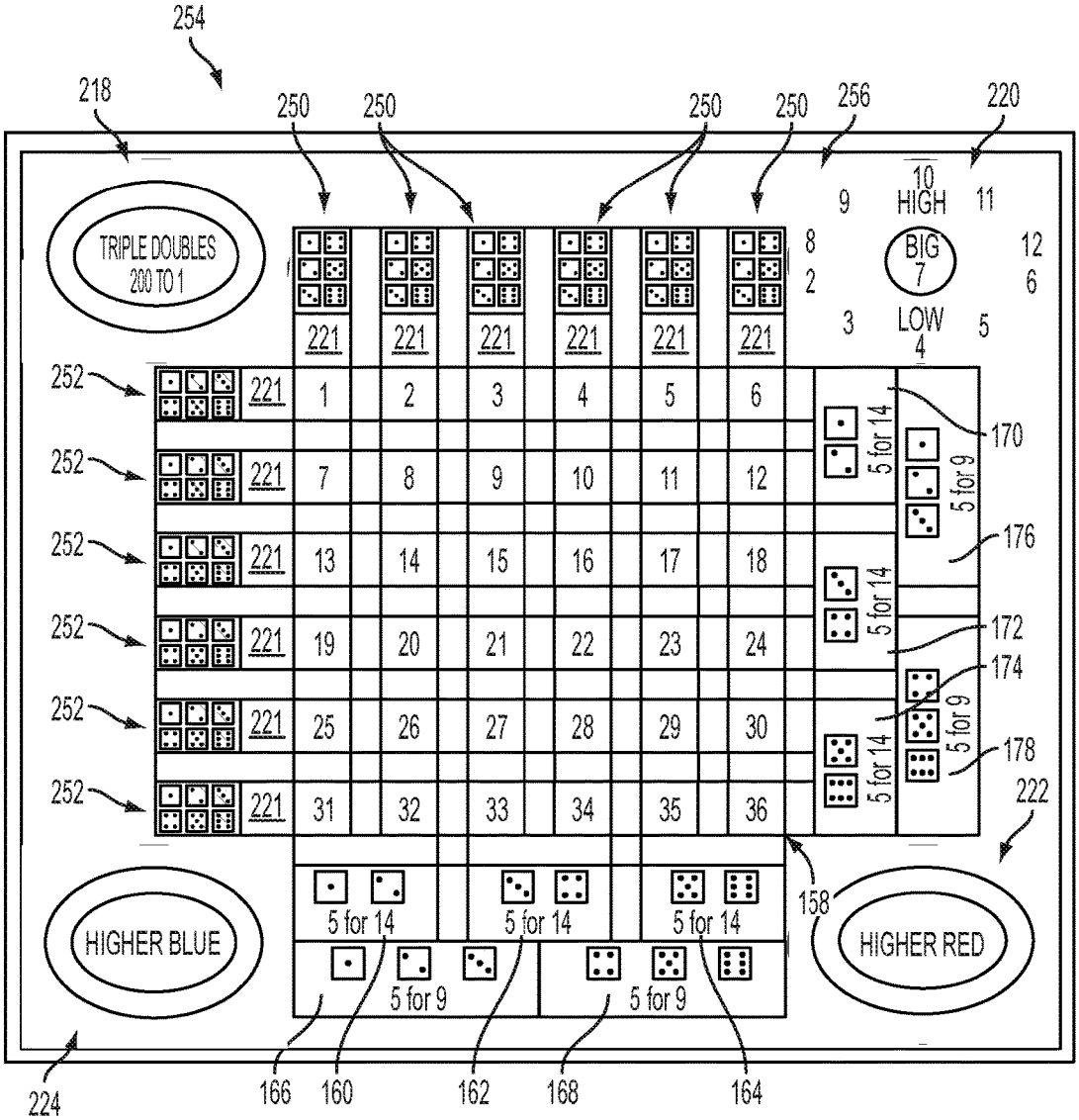
FIG. 17 is a top plan view of one embodiment, which includes a square-shaped version of the game layout of the embodiment of FIG. 16.

In one embodiment illustrated in FIG. 17, the gaming system 254 is the same as the gaming system 248 except that gaming system 254 has a square-shaped grid 256 as opposed to the rectangular-shaped grid 217.

Figure 18:
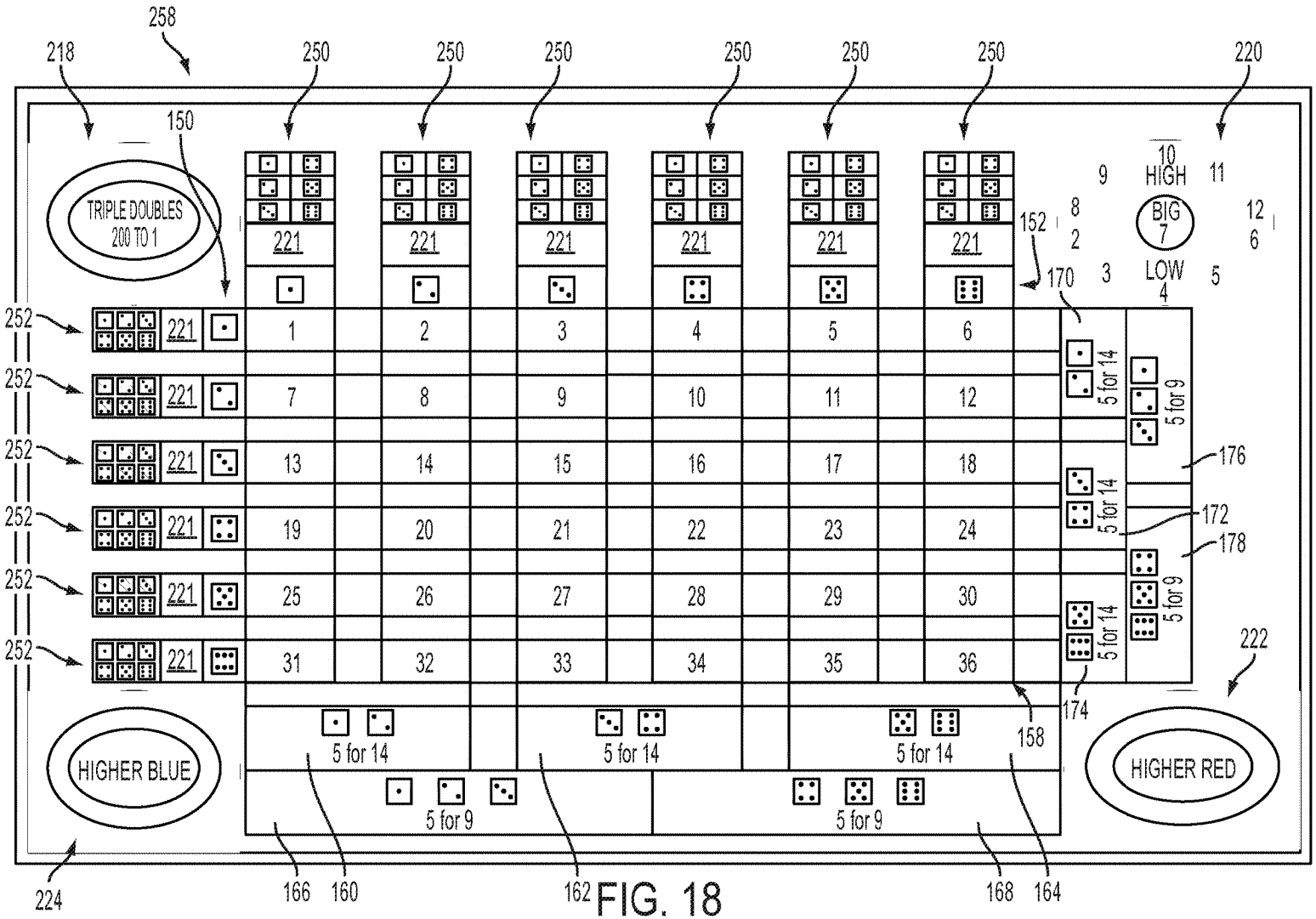
FIG. 18 is a top plan view of one embodiment illustrating randomly placed dice on the outer die column and outer die row, further illustrating the dice betting areas for wagering on the randomly placed dice and static dice arranged in numerical order for the outer die column and outer die row.

In one embodiment illustrated in FIG. 18, the gaming system 258 is the same as the gaming system 248 except that gaming system 258 has the addition of the outer column 150 and outer row 152, as described in FIG. 14 for gaming system 101. The outer column 150 has a blue color pattern and is associated with the blue die. Likewise, the outer row 152 has a red color pattern and is associated with the red die. The outer column 150 displays the six initial sub-outcomes associated with the blue die, including face-up values of 1, 2, 3, 4, 5 and 6. The outer row 152 displays the six initial outcomes associated with the red die, including face-up values of 1, 2, 3, 4, 5 and 6. The initial outcome value, 1, of the outer column 150 and outer row 152 are located adjacent to each other. For each of the outer column 150 and outer row 152, the initial outcome values are sequentially ordered by increasing magnitude.

The die values displayed in outer column 150 and outer row 152 are static in that they remain unchanged before and during game play. Accordingly, the player has the option to play using the static die values for the grid or the dynamically generated die values for the grid. If the player choses to play with the dynamically generated die values, the player presses button, and the processor causes the display device to randomly generate the six dice values at the initial sub-outcome spaces 221.

Gaming Device

In one embodiment, the game logic 10 and each of the gaming systems 101, 212, 248, and 254 can be fully or partially incorporated into one or more devices. In the description provided below, the term "gaming system" may be used to refer to either and each of the game logic 10, gaming system 101, gaming system 212, gaming system 248, and gaming system 254. Likewise, in the description provided below, the term "gaming device" is used to refer to any suitable device, whether structural, electromechanical or electronic, which includes or incorporates part or all of the gaming system.

Figure 19:
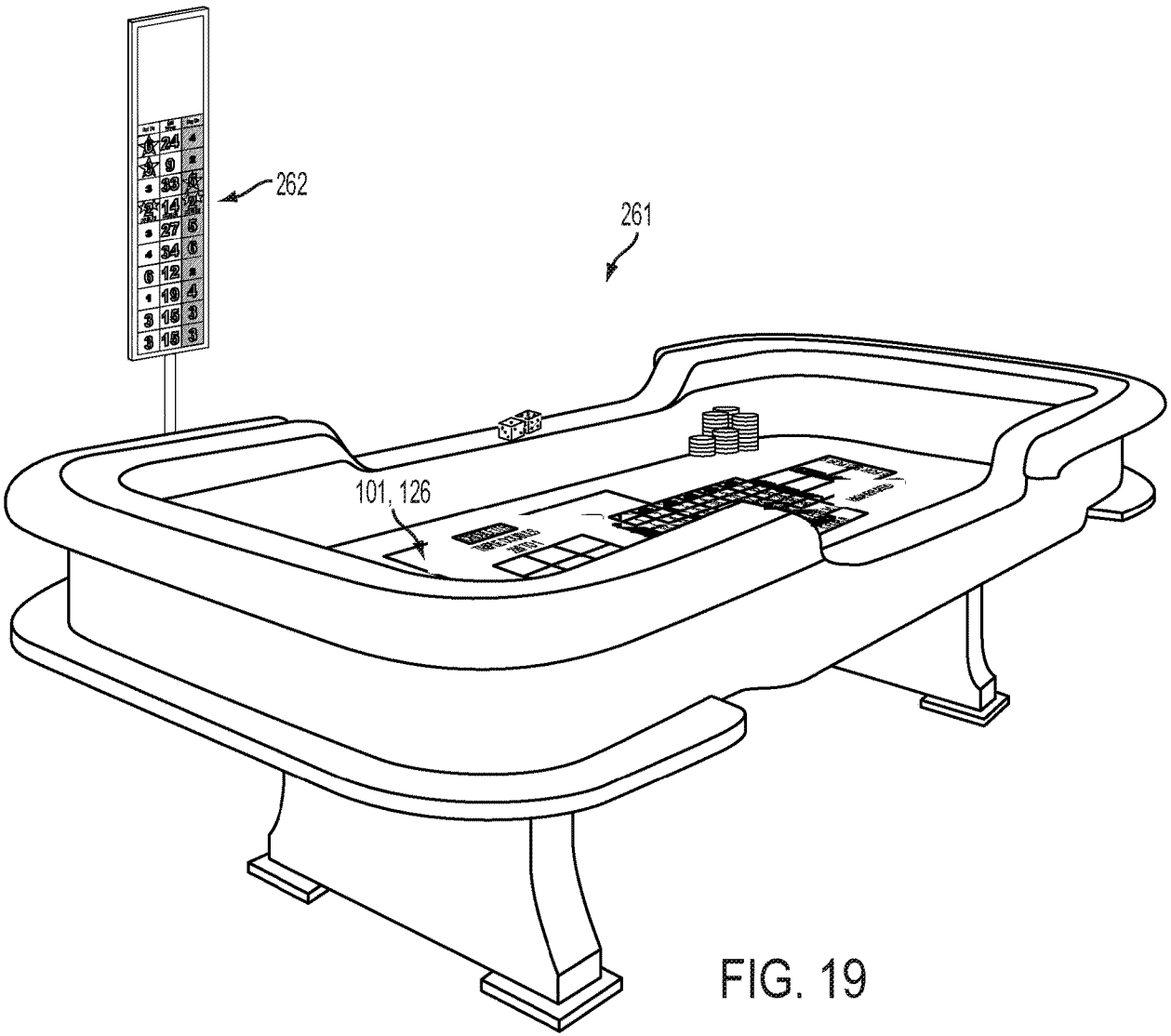
FIG. 19 is an isometric, front view of one embodiment of the gaming table with an attention display device.
Figure 20:
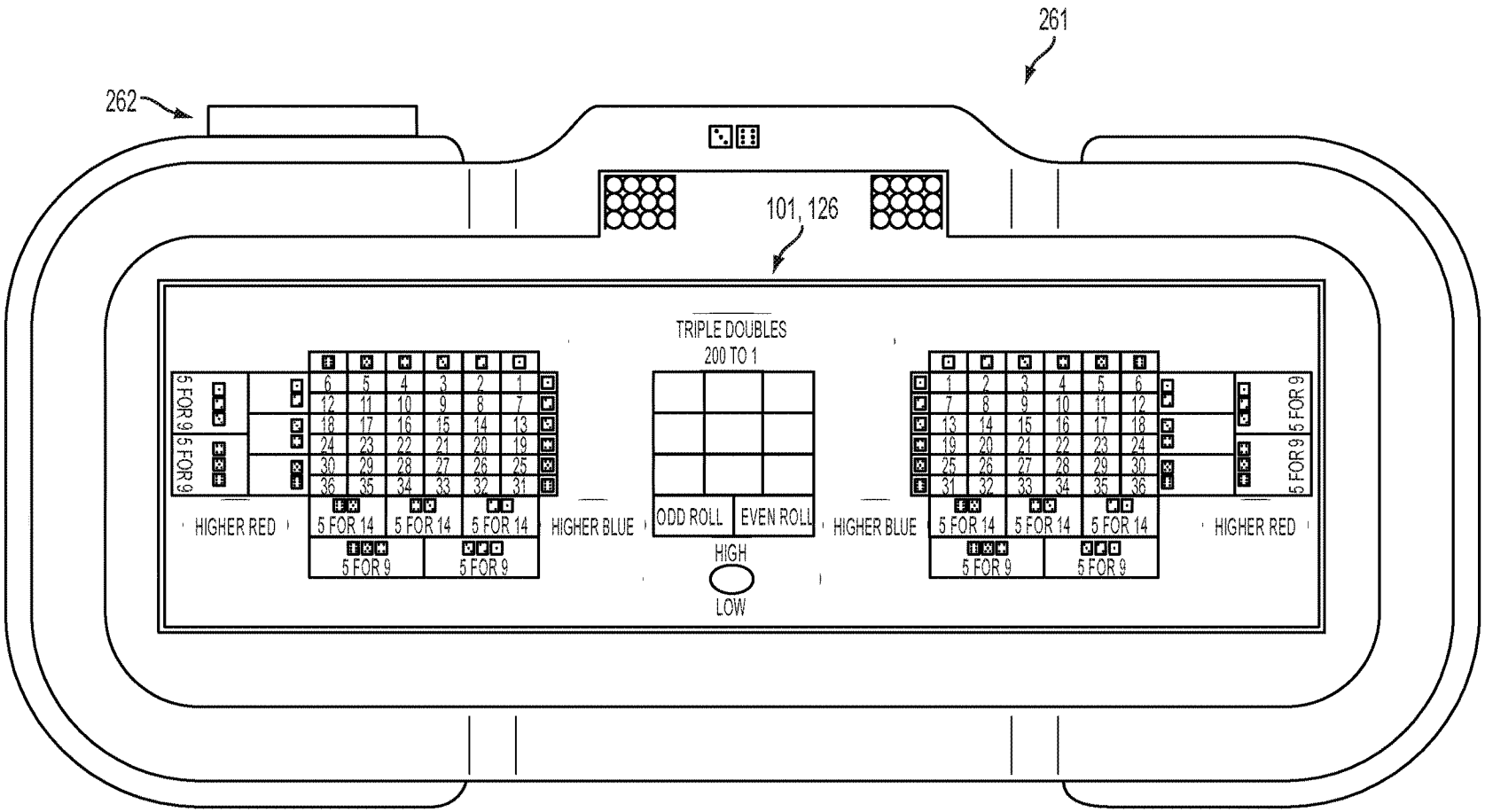
FIG. 20 is a top view of the embodiment of FIG. 19, illustrating the game play overlay or felt.

In one embodiment illustrated in FIGS. 19 and 20, the gaming device 260 includes a table 261, the gaming system and an attention display device 262 mounted to the table 261. The game table 261 has the shape and size of a conventional, casino-type Craps game table.

Figure 21:
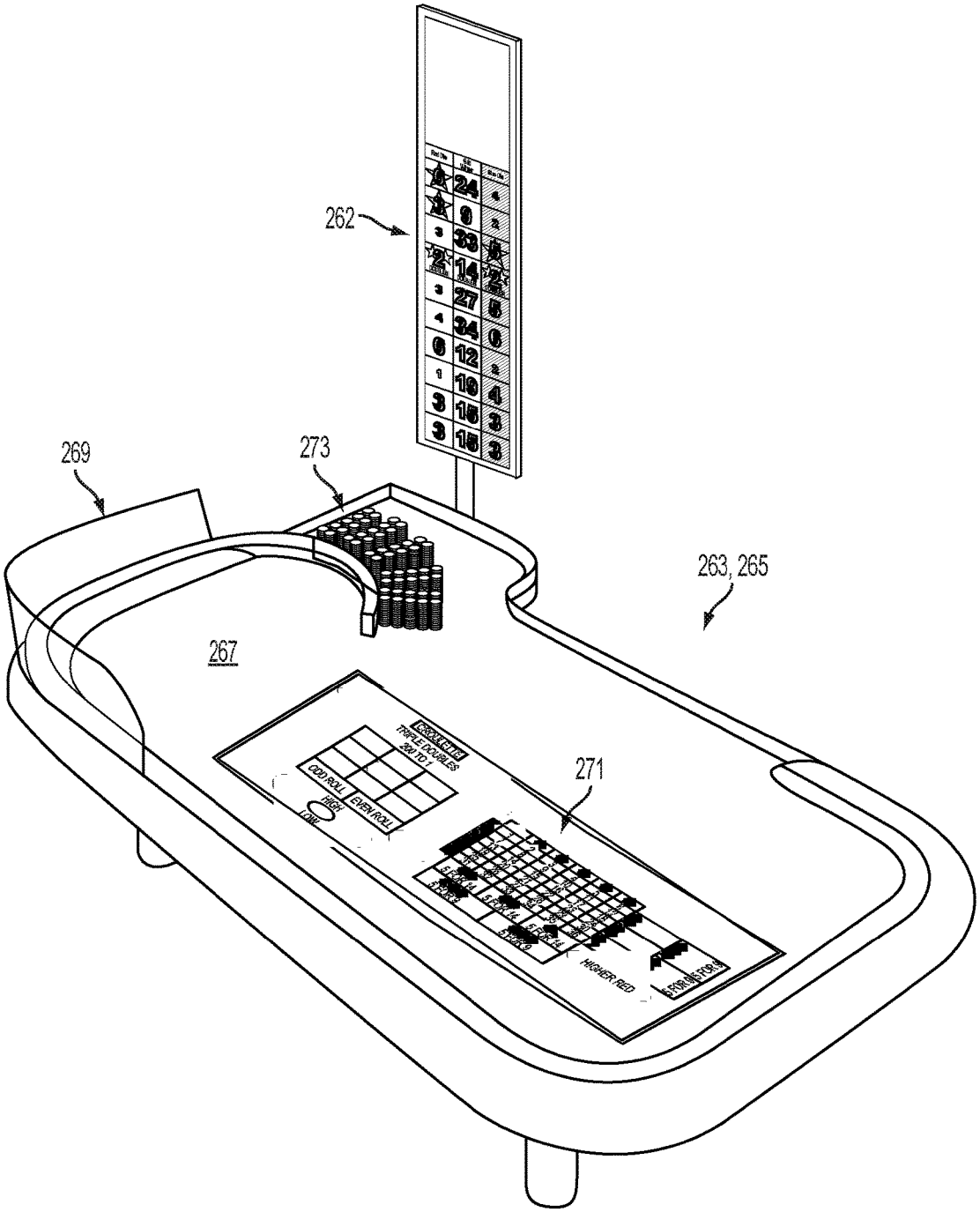
FIG. 21 is an isometric, front view of one embodiment of the gaming table having a single play area with an attention display device.

In one embodiment illustrated in FIG. 21, the gaming device 263 includes a table 265, the gaming system and the attention display device 262 mounted to the table 265. The game table 265 has the shape and size of a conventional, casino-type Roulette game table, which is smaller than the conventional Craps-based table. In the embodiment shown, the Roulette-based table 265 is a modified or converted version of a conventional, casino-type Roulette game table. Through the modification or conversion, the Roulette wheel is removed from the table, leaving a dice throw area 267. Depending upon the embodiment, the Roulette-based table 265 can have the wall extender 269. The wall extender 269 is attachable to the table wall to extend the height of the table wall. As a result, the wall extender 269 provides additional dice bombardment surface area for the dice.

In this embodiment, the game layout 271 is the same as the layout 126 shown in FIG. 13 excluding the left game area 128. Consequently, the layout 271 requires less space than the layout 126. The smaller layout 271 is suitably sized to fit onto the tabletop of the Roulette-based table 265. Referring to FIG. 21, this embodiment has different colored sets of chips 273 at a single denomination level for the different players. For example, three players may play with the colors blue, green and red. The game may include three sets of ten dollar chips in the colors of blue, green and red for the three different players. The different colors facilitate the tracking of the different plays of the different players.

In the embodiments illustrated in FIGS. 19, 20 and 21, the gaming device table includes the attention display device 262 mounted to the table. The attention display device 262 includes a screen which controls pixels to produce images. In another embodiment, the attention display device 262 includes a grid or matrix of light emitting diodes (LEDs) or light sources. In either embodiment, the processor of the gaming system controls the attention display device 262 to generate images, symbols and messages for the players and passersby. The attention display device 262 displays, represents or otherwise indicates a variety of types of information related to the gaming system and the play of the gaming system. This information encourages players and passersby to play, and this information is useful to aid players in playing.

The following sets forth the information provided by one embodiment of the attention display device:

TABLE F

| Type of Information | Purpose | Example |
|---|---|---|
| Grid Historical Information | To display the history of winning grid outcomes | Last 10 Grid Outcomes at Left Side<br>5<br>7<br>23<br>7<br>30<br>7<br>6<br>3<br>14<br>28 |
| Grid Recent Information | To display the results of the most recent grid outcome wager | Bet On: 30<br>Outcome: 5<br>Result: Loss |
| Dice Historical Information | To display the history of dice roll outcomes, differentiated by die color | |

| Last 10 Die Rolls at Left Side | | |
|---|---|---|
| Red | | Blue |
| 3 | | 6 |
| 2 | DOUBLES! | 2 |
| 1 | | 4 |
| 3 | DOUBLES! | 3 |
| 2 | | 5 |
| 2 | | 3 |
| 6 | | 1 |
| 4 | | 2 |

TABLE F-continued

| Type of Information | Purpose | Example | | |
|---|---|---|---|---|
| | | 1<br>5 | DOUBLES! | 1<br>4 |
| Dice Recent Information | To display the results of the most recent dice roll | Just Rolled | | |
| | | Red | | Blue |
| | | 3 | | 6 |
| Dice Competition Information | To display the winning fraction or percentage of the red die versus the blue die | Red Won 7 of Last 10 Rolls<br>Blue Won 3 of Last 10 Rolls | | |
| Attract Information | To attract the attention of passersby and players<br>To entice and entertain players and passersby. | An animation or video, run in loop cycle, showing combative dice with different graphical themes, such as two anthropomorphic animated dice with graphical similarities to two Victorian-era adversaries engaged in a pistol duel. The depicted winner, the red die, coincides with the most recent outcome of the roll of the dice in which the red die was higher than the blue die. | | |
| Two-Time Streak Historical Information | To display the die values of the most recent two-time streak of doubles outcome | Last Doubles Twice<br>3 & 3 | | |
| Award Information | To display the current amount of the progressive jackpot award for achieving a streak of ten doubles dice outcome | Progressive Jackpot for Streak of Ten Doubles<br>$1,404,780 | | |

Figure 22:
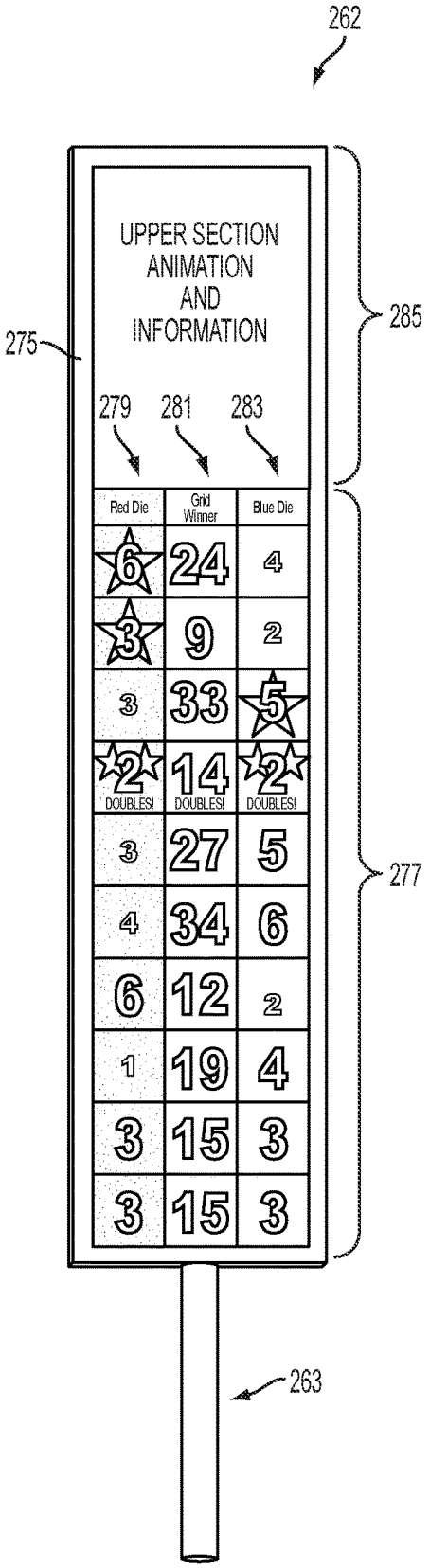
FIG. 22 is an isometric, front view of one embodiment of the attention display device illustrating an example of displayed information.

In one embodiment illustrated in FIG. 22, the attention display device 262 has a front display panel 275, a back display panel (not shown) and a pole 263 for mounting to the table. The back display panel displays the same visual output as the front display panel 275. Therefore, patrons can see the displayed information from more than one direction as they approach the table. The lower section 277 displays red column 279, green column 281 and blue column 283 corresponding to the red die outcome, grid outcome, and the blue die outcome, respectively. Each column shows the history of the applicable outcome in chronological order. The most recent outcome appears at the top of the column, and the oldest outcome appears at the bottom of the column. The example shown displays ten outcomes in each column. It should be appreciated that, depending upon the embodiment, each column can display more than ten outcomes, such as twenty outcomes. Depending upon the embodiment, the order of the columns may change from the example shown.

Upon completion of a dice roll, the winning numbers, including the red die number, the blue die number and the grid number, flash for a period of time on the upper section 285 to alert people as to what has taken place. After a period of time, the flashing numbers are displayed without the flashing effect at their respective places at the top of the three columns in the lower section 277.

At this time, the display device 262 displays an animation depicting a struggle or bout between anthropomorphic dice. The animation reveals the most recent outcome as it pertains to the blue or red die. If, for example, the blue die is greater than the red die, the animation depicts a victorious blue die. In one embodiment, the system includes one set of different, humorous combative cartoon sequences depicting red die victorious over blue die, and the system includes another set of different, humorous combative cartoon sequences depicting blue die victorious over red die. The display device 262 randomly displays one of the sequences to coincide with the winning red or blue die.

From time to time, or when a designated event occurs, the upper section 285 displays text or graphics providing additional information, including, but not limited to, an alert about the occurrence of a doubles roll, an alert about a back to back doubles roll, an alert about a triple doubles roll, a current progressive jackpot total, an odd or even dice total winner or winning number, and an odd or even grid number winner or winning number. In one embodiment, the upper section 285 displays a replay of a live reaction of players actually playing the game and winning, highlighting the level of excitement experienced by players.

Once the current winning number information makes its way to the columns below the main screen, this information maintains the top position and is moved further down the column once the next roll has been made and the new information takes the place of the old thus moving older information further down the column with each subsequent roll.

In the example shown in FIG. 22, the red column depicts the value of the red die rolled by the player in the form of a numeral. If the outcome of the red die is higher than the outcome of the blue die of the same roll, the display device 262 displays the red die value with a size greater than the blue die value. Depending upon the embodiment, the display device 262 can further distinguish the winning red die with a suitable form of distinguishing graphics, such as a large star, multiple stars, a glow effect or a form of eye-catching movement. If the red die outcome is lower than the blue die outcome of the same roll, the display device 262 displays the red die value with a size smaller than the blue die, and the red die value has no graphical distinguishing enhancement.

The blue column depicts the value of the blue die rolled by the player in the form of a numeral. If the outcome of the blue die is higher than the outcome of the red die of the same roll, the display device 262 displays the blue die value with a size greater than the red die value. Depending upon the embodiment, the display device 262 can further distinguish the winning blue die with a suitable form of distinguishing graphics, such as a large star, multiple stars, a glow effect or a form of eye-catching movement. If the blue die outcome is lower than the red die outcome of the same roll, the display device 262 displays the blue die value with a size smaller than the red die, and the blue die value has no graphical distinguishing enhancement.

In one embodiment, the display device 262 displays the winning grid outcomes relatively large in size to draw attention. This grid number may be displayed over a grid graphic which represents a grid, or the grid number may be animated to appear as though it is flying off of the gaming grid, growing in size until it reaches its maximum size and placement within the column.

In the event of a special outcome, such as a doubles roll, a double doubles roll or a triple doubles roll, not only will this occurrence be visible on the upper section 285 for a period of time, but it will be further indicated as part of the recent history of play on the columns in the lower section 277. The indication may include: (i) the text, "double stars" behind the number in the red and blue columns, (ii) the text, "doubles," "double doubles," or "triple doubles" below the numbers in all three columns, or (iii) a suitable symbol representing such outcomes.

Referring back to FIG. 20, in one embodiment, the top of table 261 of gaming device 260 includes a relatively large display device, such as an LCD, having a touch screen. The large display device displays the layout and symbols of the gaming system. Depending upon the embodiment, the dice can be actual objects to be rolled on the large display device, or the dice can be dynamic images generated by the large display device.

Depending upon the embodiment, the gaming system can be incorporated a variety of different types of gaming devices, including, but not limited to, a game play overlay for a table (including, but not limited to, a game layout felt, game layout sticker or label, game layout sheet, game layout template, or other game layout medium), a game board, a game table, a data storage device, such as a compact disk, hard drive or memory chip, a computer, an electronic tablet, a server, a webserver, a website, a smart phone, mobile phone, handheld communication device, mobile game station, video game machine or slot machine.

Figure 23:
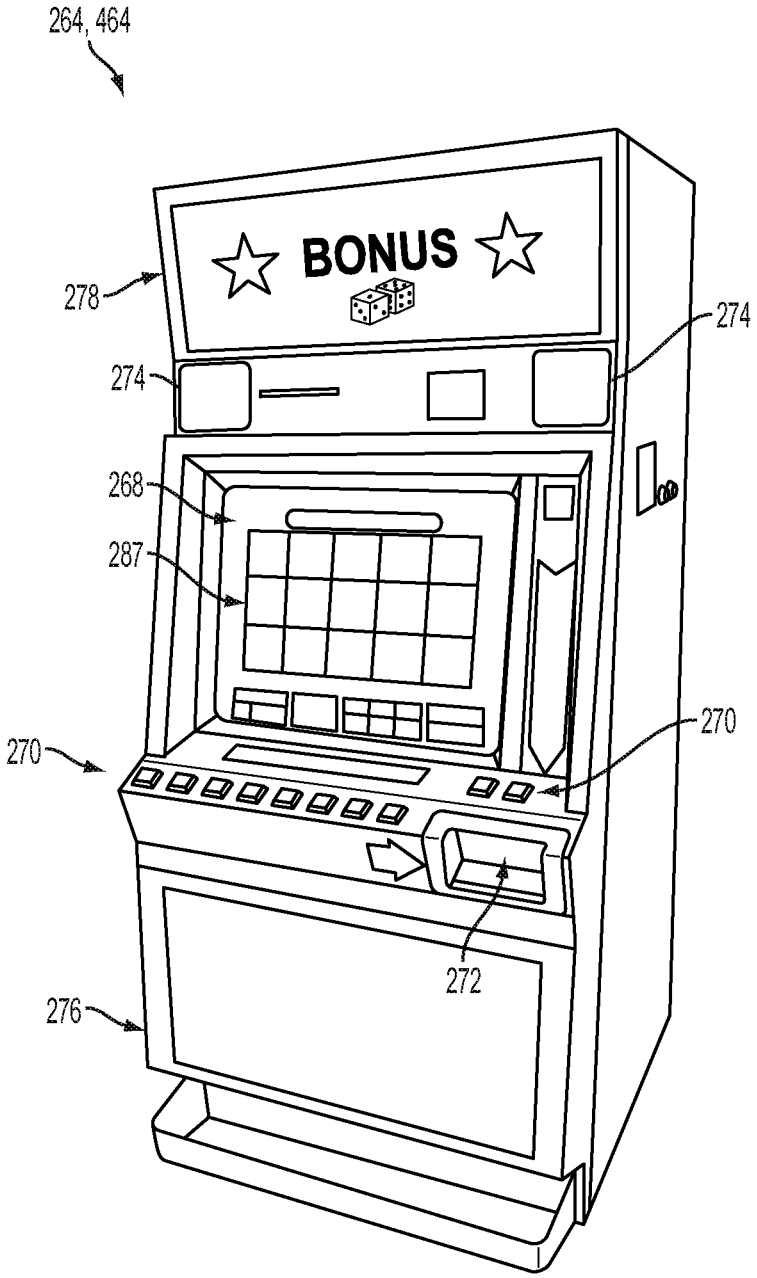
FIG. 23 is an isometric, front view of one embodiment of the gaming device.

Referring to FIG. 23, in one embodiment the gaming system has an electronic form or software form incorporated into the gaming device 264. In this embodiment, the grid and entire game layout is a computer-generated graphical representation displayed by the gaming device 264. Gaming device 264 has a support structure, housing or cabinet 266 which supports a display device 268. The gaming device 264 has a plurality of input devices 270, specifically depressible buttons, including a play button, bet buttons and a cash-out button. The gaming device 264 includes a payment receiver 272 configured to receive cash bills or data cards which store game credits. As shown, the gaming device 264 includes a plurality of speakers 274 to provide audio output related to the game. The base 276 and top 278 of the cabinet 266 include display panels which display illuminated game art and game information.

In one embodiment, the gaming device 264 includes a topper device (not shown) mounted to the top 278. The topper device includes an electromechanical apparatus including moveable, mechanical dice or other multi-sided objects. In operation, the topper device moves or rotates the mechanical dice or objects to draw attention to the gaming device 264.

In one embodiment, the gaming device 264 has a base game and a bonus game. The base game has a plurality of video reels 287 displayed by the display device 268. In one embodiment, the base game includes a video poker game, video blackjack game, video keno, video bingo or any other suitable primary or base game. In the embodiment illustrated in FIG. 23, the base game of the gaming device 264 is a slot game with one or more paylines. The paylines may be horizontal, vertical, circular, diagonal, angled or any combination thereof In this embodiment, the gaming device includes a plurality of five reels 287 in video form with simulated reels and movement thereof. In an alternative embodiment of an electromechanical slot machine, the reels are in electromechanical form with mechanical rotating reels, which are operably coupled with an electronic display of any suitable type. Each reel displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the base game stop spinning if specified types and/or configurations of indicia or symbols occur on an active payline or otherwise occur in a winning pattern, occur on the requisite number of adjacent reels and/or occur in a scatter pay arrangement.

When the player reaches a predetermined bonus triggering event during the base game, the gaming device 264 starts the bonus game. The bonus game includes the gaming system described above. During the bonus game, the gaming device 264 receives wagers and resolves the wagers according to the logic of the gaming system.

Figure 24:
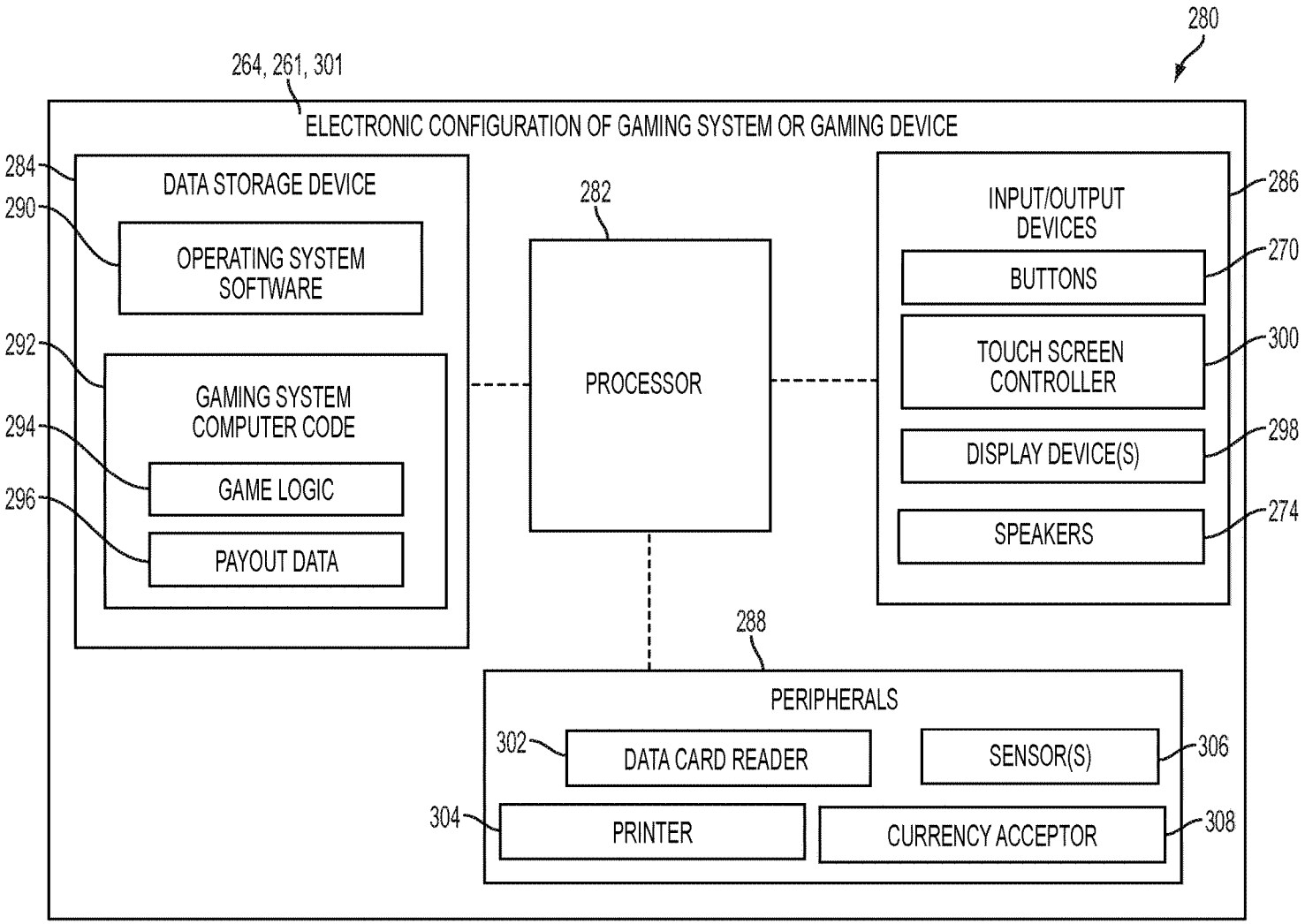
FIG. 24 is a schematic block diagram illustrating the electronic configuration of one embodiment of the gaming system or device.

In one embodiment, the gaming device 264, gaming device 261 or another suitable gaming device 301 has the electronic configuration 280 illustrated in FIG. 24. The electronic configuration 280 includes a central processing unit or processor 282 operatively coupled to a data storage device 284, input/output (I/O) devices 286 and peripherals 288. The data storage device 284 includes operating system software 290 and game logic computer code 292. The gaming system computer code 292 includes game logic 294 and payout data 296. In one embodiment, the data storage device 284 stores image data, event data, player input data, random or pseudo-random number generators, paytable data or information, and applicable game rules that relate to the play of the gaming system. The processor 282 executes the gaming system computer code 292 to operate the game play and regulate wins, losses and payouts. The I/O devices 286 include a plurality of buttons 270 for placing wagers, initiating play and cashing-out. The display device 298 may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, the display device 298 has a touch module, such as an optical touch module, capacitive touch panel or resistive touch panel. The touch module is controlled by the touch screen controller 300 to receive touch inputs from the player.

In one embodiment in which the gaming device includes a table, the gaming device includes a video projector or image projector. The projector is aimed at the surface of the table. In one embodiment, the projector is mounted to the ceiling of the casino, above the table. In another embodiment, the tabletop is clear, and the projector is mounted below the tabletop. In yet another embodiment, an arm is connected to the table, and the projector is mounted to the arm, located above the tabletop.

In either such embodiment, the projector generates an image on the tabletop. The image is a colorful representation of the game layout of the game logic. In one embodiment, the projector is operatively coupled to a database or data storage device. The data storage device stores data files related to a plurality of different game layout images. The different images correspond to the different embodiments of the game logic. Also, the different images include versions associated with different game themes. For example, the different themes can include the colors or mascots of different sports teams, symbols associated with different types of sports, and the characters and scenery associated with different movies or television shows. From time to time, the casino can change the game layout of the table by providing an input to the image projector.

The speakers 274, described above, provide audio output, including alert sounds and music, generated during, before and after the play of the game. The peripherals 288 include a data card reader 302, printer 304, one or more sensors 306, and a currency acceptor 308. The data card reader 302 receives data cards from players and manages the game credits on the cards. The printer 304 prints receipts or slips with purse values for players, after they cash-out. The sensors 306, depending on the embodiment, include cameras, photo sensors, light sensors, motion detectors, speech recognition sensors or microphones, or biometric sensors. In one embodiment, a motion detector triggers an audiovisual output of the gaming device when a passerby enters an area within a designated number of feet from the gaming device.

Figure 25:
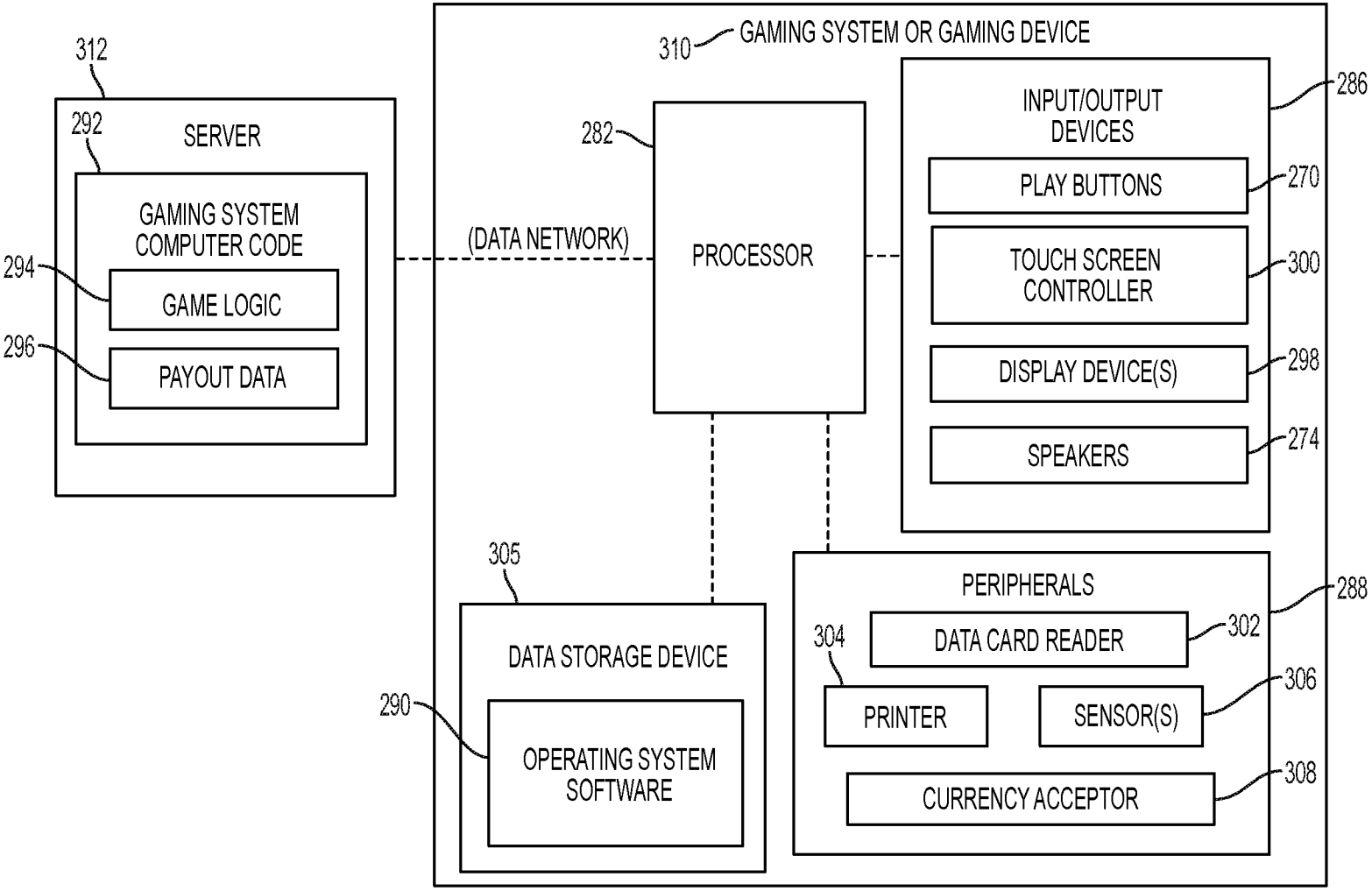
FIG. 25 is a schematic block diagram illustrating the electronic configuration of another embodiment of the gaming system or device.

In the embodiment illustrated in FIG. 25, the gaming device 310 has the processor 282 operatively coupled to data storage device 305, peripherals 288 and I/O devices 286. In this embodiment, the gaming device 310 includes none, or less than all, of the gaming system computer code 292. Instead, part or all of the gaming system computer code 292 is stored within a remote database or server 312 located physically away from the gaming device 310. The server 312 stores the gaming system computer code 292. The processor 282 is operatively coupled to the server 312 through a data network, such as a local area network, a wide area network or the Internet.

It should be appreciated that a gaming device or gaming machine as disclosed herein may be a device that has obtained approval from a regulatory gaming commission or a device that has not obtained approval from a regulatory gaming commission. In one embodiment, the gaming device with the gaming system randomly generates awards or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, the gaming device with the game logic employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, a plurality of gaming devices at one or more gaming sites may be networked to the central server 312 in a progressive configuration, wherein a portion of each wager to initiate a game may be allocated to one or more progressive awards. In one embodiment, a progressive game logic host site computer is coupled to a plurality of the central servers 312 at a variety of mutually remote gaming sites for providing a multi-site linked progressive automated game logic. In one embodiment, a progressive game logic host site computer may serve gaming devices distributed throughout a number of properties at different geographical locations including, for example, different locations within a city or different cities within a state.

Game of Craps

In one embodiment, the gaming system includes some or part of the game rules, layout, logic or data of the conventional, casino Craps game. In another embodiment, the gaming system includes a simplified, reduced, augmented or modified version of some, part or all of the game rules, layout, logic and data of the conventional, casino Craps game.

Basic Play of Craps

The Craps game is played with two dice. Both dice are simultaneously thrown. The player throwing the dice is called the shooter. The following are the dice outcomes for Craps:

(a) Outcomes of 4, 5, 6, 8, 9, 10, called the "place;"
(b) Outcomes of 2, 3, 7, 11, 12, having a special meaning;
(c) The most important outcome, 7;
(d) A Hard Roll, occurring when both dice have the same value; and
(e) A Soft Roll, occurring when the dice values are different.

The basic Craps bets are the "pass line" bet and the "don't pass line" bet. In play, the player makes a "pass line" or "don't pass line" bet. Next, the player throws the dice. This is called the initial or "come out" roll. If the outcome is seven or eleven, the "pass line" bet wins. If the outcome is two or three, the "don't pass line" bet wins. If the outcome is twelve, it is considered a tie and the "don't pass line" bets return to the player. The "pass line" loses and the "don't pass line" is pushed.

An outcome of 4, 5, 6, 8, 9, 10 is referred to as "the point." Once the point is established, a "pass line" bet can be won only if the player or shooter rolls the point again. If the shooter's roll is a seven, then the "pass line" bet loses. The dice are rolled by the shooter until seven or the point is hit.

Craps Table Personnel

At the casino Craps table, there is an individual seated at the center of the table on the pit side. This person is known as the "Boxman," and he/she is in charge of the game. The Boxman settles disputes which may arise. Among the Boxman's other duties is watching the dealers to ensure that they make correct payoffs, and the Boxman monitors for potential cheaters.

Flanking the Boxman on both his/her right and left is a dealer who handles the betting action on his/her half of the table. In the center of the table, opposite the Boxman, is the "Stickman." The Stickman calls out the result of each roll of the dice and retrieves the dice with a long stick which is curved on the end. The Stickman also has the responsibility of booking the proposition bets which are on the layout in the center of the table. When a proposition bet wins, the Stickman authorizes the amount of payment and to whom the bet is paid.

Craps Basic Procedures

Casino Craps tables have various sizes ranging from eight feet to fourteen feet. The maximum number of people who can be accommodated at a Craps table varies, ranging from twelve to twenty. Each player at the table can take a turn at shooting the dice if he/she so desires, and the dice move around the table in a clockwise fashion. When it comes to be a player's turn, if the player wants to throw the dice, he/she must place a bet either on the Pass Line or the Don't Pass Line. It is not mandatory for the player to throw the dice.

The minimum bet for Craps in most casinos is $5 although there are some smaller venues which may have minimum bets as low as $1. As with other casino table games, the minimum bet may vary from table to table. Normal table minimums are $5, $10, $25 and $100. The minimum bet amount is posted on the inside wall of each Craps table.

If a player opts to shoot the dice, then he/she continues to throw them until he/she "seven's out." This term is described below. Then, the dice are offered to the next player to his/her left.

Craps Come Out Roll

When a new shooter gets the dice, his/her first roll is called the "Come Out" roll. Also, if the shooter makes his/her point, the first roll after a made point is also a Come Out roll. If the shooter's Come Out roll is a 2, 3, 7, 11 or 12, then another Come Out roll is made. Come Out rolls continue to be made until a shooter rolls a 4, 5, 6, 8, 9 or 10. When this happens, the shooter is said to have established a point and is no longer making Come Out rolls.

Craps Pass Line

One of the most prominent bets is the "Pass Line." A Pass Line bet is placed squarely in the middle of the area marked "Pass Line" on the layout. It is important to place this bet in the center of this area so that it is not touching a line. Bets placed on the inner line or outside the outer line are different bets.

A Pass Line bet wins if the Come Out roll is a 7 or 11. The player is paid even money or one to one odds on any winning Pass Line bet. When a 7 or 11 is rolled on the Come Out roll, the dice are said to have "Passed." If a 2, 3, or 12 is rolled on the Come Out roll, this constitutes a Craps Roll, and the Pass Line automatically loses, but the shooter does not forfeit the dice.

When something other than a 2, 3, 7, 11 or 12 is rolled on the Come Out roll, that number becomes the shooter's point. The point will always be one of the six "box numbers" (4, 5, 6, 8, 9, 10). If the shooter can then roll his point before rolling a 7, the dice have passed, and he/she wins the Pass Line bet. However, if the player rolls a 7 before rolling the established point, the Pass Line bet loses. The shooter has "sevened out," and his/her roll has ended. Note that other than on the Come Out roll, dice rolls of 2, 3, 11 or 12 have no effect on the Pass Line bet.

Craps Come Bet

A Come Bet is placed in the large area marked "Come." A Come Bet works the same way as a Pass Line bet, but it is made after a Pass Line bet. In other words, the player can only make a Pass Line Bet on a Come Out roll. However, if the player wants to continue to make a Pass Line type bet after a point has been established, then he/she can place his/her bet in the Come area. Just like a Pass Line bet, a Come Bet wins on a roll of 7 or 11 and loses on 2, 3 or 12. If any other number is rolled (4, 5, 6, 8, 9 or 10), the dealer moves the Come Bet to that number on the layout. If that number is rolled again before a 7 is rolled, the Come Bet wins, but if a 7 is rolled first, it loses. Therefore, a Come Bet functions the same as a Pass Line bet except it is made after a point has been established. The Come Bet also pays even money like a Pass Line bet.

Pass Line bets and Come Bets are said to be "contract bets," which means that once the player makes those bets, he/she is not allowed to pick them up. The player is under contract to leave that bet on the table until it is either won or lost.

Pass Line and Come bets are called "do side" bets because the player is betting with the shooter. The player is betting that he/she will either win on his come out roll by rolling a 7 or 11 or subsequently win by making his/her point.

Craps Don't Pass Line Bet and Don't Come Bet

A Don't Pass Line Bet is the opposite of a Pass Line Bet. The Don't Pass Line is the next area inside the Pass Line, and that is where the player places his/her bet if he/she wants to bet against the shooter.

A Don't Pass Line bet loses if the Come Out roll is a 7 or 11, but it wins when the Come Out roll is a Craps roll of 2 or 3. The layout displays, "Bar 12," which means that if the Come Out roll is a 12, the Don't Pass Line Bet does not win, but it does not lose either. For the player betting on Don't Pass or Don't Come, it is as if the roll did not happen. By not paying the Don't Pass or Don't Come bettor on a Craps roll of 12, the house gains its advantage over a Don't player. Otherwise, a player could just bet Don't Pass or Don't Come all of the time and be assured of winning long term since he/she would have an advantage.

After a point is established, the Don't Pass Line Bet wins if a 7 is rolled before the point, and the Don't Pass Line Bet losses if the point is rolled before a 7. So, once a point is established, the odds are in favor of a Don't Pass bettor but are 22% against him/her on the Come Out roll.

Don't Come bets are placed in the little box marked "Don't Come" located in the corner of the layout next to the dealer. The Don't Come bet is exactly like the Don't Pass bet except it is made after the Come Out roll. It wins on a roll of 2 or 3, is barred on a roll of 12, and losses to a 7 or 11. Otherwise, it moves to whatever number is rolled and is placed behind that number on the layout instead of on the number like a regular Come bet. Once a Don't Come bet goes to a number, if that number is rolled again, it losses. If a 7 is rolled before that particular number is rolled again, the Don't Come bet wins. For example, if a Don't Come bet is placed and a 5 is rolled, the dealer places the bet behind the 5. If another 5 rolls before a 7 is rolled, the dealer announces "down behind" and removes the Don't Come bet because it has lost. If the shooter rolls a 7 before another 5 has rolled, the Don't Come Bet wins, and the Don't Come bettor is paid.

Neither the Don't Come bet nor the Don't Pass bet is a contract bet. Therefore, they can be picked up at any time between rolls. However, once a Don't Pass or Don't Come bet has made it past the 7 and 11 and has been established on a box number, the odds are heavily in favor of the Don't player.

Taking and Laying Odds

The laying odds bet is a separate bet which can be made after the point has been established on a Pass Line Bet, Come Bet, Don't Pass Line Bet, or Don't Come Bet. The laying odds bet is paid off at correct odds.

On a Pass Line bet, after the point has been established, the odds bet is placed behind the Pass Line Bet (outside the Pass Line area between the wall of the table and the outer line of the Pass Line area). When a Come bet goes to a box number (4, 5, 6, 8, 9, 10), the dealer stacks the odds bet on top of the Come Bet but slightly askew to differentiate between the original Come bet and the odds bet added afterwards.

It is not mandatory for the player to take odds on his/her Pass Line and Come bets, but it can decrease the house percentage against the player, especially if the casino allows the player to take 5 times odds or 10 or even 20 times odds. By the term 5, 10, or 20 times odds, what is meant is that most casinos allow the player to take odds in the range of 5 to 20 times the amount of the player's original Pass Line or Come Bet. In other words, if the player's Pass line bet is $5, then with 5 times odds, the player would be able to take odds of up to $25 on that bet. If a casino offers 20 times odds, the player could place an odds bet of up to $100 with only a $5 Pass Line or Come bet.

When placing an odds bet after a point has been established or after a Come bet goes to a number, the player is said to be "taking" odds. All odds bets pay according to the odds of a 7 being rolled before that particular number. When playing the do side, the odds of any box number being rolled before a 7, are against the player. Therefore, all odds bets associated with box numbers, pay better than even odds.

A six or an eight box number pays odds of 6 to 5 because the odds are 6 to 5 that a seven will roll before a six or an eight. So, all odds bets placed on six or eight can be in multiples of 5. For example, if the point established on a Pass Line bet is eight, then the player can place the odds bet behind the Pass Line bet with $5, $10, $20 or another multiple of 5. If the player has a $5 Pass Line bet on the eight along with a $20 odds bet, and the shooter rolls the eight and makes his/her point, the player would get paid even money ($5) for his/her Pass Line bet. The player would receive $24 for his/her $20 odds bet.

A winning odds bet placed on the 5 or 9 pays 3 to 2 because there are four combinations that make up a 5 or 9, and there are six combinations that result in a 7. Therefore, six divided by four is 1.5 or 3 to 2. Odds bets for the 5 and 9 can be made in multiples of two.

The odds paid on a four or ten are 2 to 1 since there are three combinations which make up a 4 or 10, and there are six combinations which make a 7.

If the player makes a Don't Pass or Don't Come bets, the player is said to be playing the "Don't Side" because he/she is betting against the shooter. As described above, when playing the "Do Side," the player "takes" the odds, but when playing the "Don't Side," the player "lays the odds" or gives them. Once a shooter has established a point, the odds are in favor of a 7 rolling before any box number. Therefore, the don't bettor must give the odds or else he/she would be assured of being a winner over the long term.

If a player makes a Don't Pass bet, he/she can lay odds by placing his odds bet beside his original Don't Pass bet on the Don't Pass Line. If a player wants to lay odds on a Don't Come bet, he/she simply gives his odds bet to the dealer and tells the dealer that he/she is laying odds on the Don't Come bet, sometimes referred to as a "DC" bet.

Odds on Don't bets are laid in the exact opposite proportions as Do side bets. If the point is six or eight, a player must lay $6 to win $5. The reason is that there are six combinations that produce a 7 and five combinations that produce a 6 or 8. Once a 6 or 8 is established as the point, the odds are 6 to 5 in favor of the Don't bettor that a 7 will roll before a 6 or 8.

Likewise, the player must bet three units to win 2 when laying odds against the 5 or 9. For example, the player must lay $15 to win $10. If the player is laying against a 4 or 10, the player must lay two units to win 1.

All odds bets, whether they are Pass, Don't Pass, Come or Don't Come, are non-contract bets and can be picked up at any time between rolls of the dice. They can also be increased or decreased as long as the increase does not take them above the maximum allowable odds bet or below the minimum. Odds bets may also be turned off, or turned on, at any point between rolls by telling the dealer to turn the player's odds bets on or off. However, if an odds bet is "Off" or not working when its associated box number is rolled, the player only gets paid even money on the associated Pass or Come bet. The player does not get paid on the odds bet. If a 7 rolls, the player does not lose a non-working odds bet on the Pass Line or on a Come bet.

In general, odds bets lose or win, when a 7 rolls. Pass and Come odds lose, and Don't Pass and Don't Come odds win, when a 7 rolls. The exception is when a come out 7 is rolled. In this case, Come bet odds are returned to the player while the Come Bet itself loses. However, a player can tell the dealer to "work" his/her odds on the Come Out. In this case, the Come bet odds will also lose if a 7 rolls, but, conversely it will win and pay correct odds if the Come bet number is rolled.

Place Bets

A "Place Bet" is another type of bet which is considered a Do Side bet because it pays the player better than even money. A Place Bet is made on the box numbers (4, 5, 6, 8, 9 or 10) and can be made at any time by giving the dealer the proper amount of chips and telling the dealer which numbers the player wants to place. A Place Bet is somewhat like a Come bet in that it wins if the number placed is rolled before a 7, and it loses if it is still on the table when a 7 is rolled. The exception is on the Come Out roll. If a come out seven is rolled, it does not affect a Place Bet. There is no win or loss since Place Bets are automatically considered to be "Off" or "Not Working" on Come Out rolls. The player does have the option of instructing the dealer to "Work" his Place Bets on the Come Out. In that case, if any number placed, rolls, it wins but if a 7 is rolled, all of the player's Place Bets lose.

Place Bets are paid at different rates from odds bets. A winning Place Bet on the 6 or 8 pays 7 to 6. Therefore, Place Bets on the 6 or 8 should normally be made in multiples of six while Place Bets on the other box numbers are normally made in multiples of five. Winning Place Bets on the 5 and 9 pay 7 to 5 while the 4 and 10 pay 9 to 5.

Buy Bets

A "Buy Bet" is exactly the same as a Place bet, and all rules that apply to Place bets apply to Buy bets. The difference is that a winning Buy Bet pays correct odds (i.e., 3 to 2 for a Buy bet on the 5 or 9 and 2 to 1 for the 4 and 10). A 5% commission must be paid on all winning Buy bets. It is advantageous to buy the 5 and 9 if the player is making a bet of $25 or more.

Lay Bets

Lay Bets are somewhat like the Don't Side equivalents of Place Bets or Buy Bets. The player may make a Lay Bet against any box number at any time, even on the Come Out roll. Lay Bets are understood to be working at all times unless they are called off or picked up. Lay Bets, like any other Don't bet, may be picked up at any time.

A Lay Bet wins when the 7 rolls before the box number being laid against rolls. However, if the player lays against a number, and that number rolls before a 7, the dealer will announce "down behind," and the player will lose his/her lay bet. For instance, if the player lays against a 9, and the next three rolls are 5, 6, and 7, the player would win his/her lay bet because the 7 rolled before a 9 rolled. However if the next three rolls were 5, 6, and 9, the player would lose the lay bet because a 9 rolled before a 7.

Winning Lay bets pay the proper odds less a 5% commission. So, Lay Bets against the 4 or 10, pay 1 to 2. Bets against the 5 or 9, pay 2 to 3, and bets against the 6 and 8, pay 5 to 6. Therefore, Lay Bets against the 6 and 8 can be made in multiples of six (i.e. $12, $18, $24).

Big 6 and 8

In the corner of the layout next to the Pass Line and the Don't Pass Line, there is a large red 6 and 8. This is sometimes called "Big 6 and 8." It works exactly like a Place bet on the 6 or 8 but instead of paying off at 7 to 6 odds, a winning bet only pays even money.

Field Bets

There is a large area on the layout between the Come area and the Don't Pass Line marked "Field." This is a one roll bet that covers the 2, 3, 4, 9, 10, 11 and 12. If any of those numbers hit on the next roll after the player places his/her Field bet, the player wins. A winning Field bet pays even money except for the 2 and the 12 which pay double. Some casinos pay triple in the Field when a 12 is rolled.

C and E

Further toward the center of the layout, there are two little circles joined by a line. Within these circles are the letters E and C. The "E" is a symbol for the number 11. A one roll bet on the number 11, pays 15 to 1. An often used slang term for this bet is "Yo." When a yo bet is made, the Stickman places it in one of the circles marked E, which corresponds to the player's position at the table.

The small circle marked "C" is where a general bet on Craps is placed. This bet is sometimes called a "Craps Check" or "Any Craps," and it is for one roll. The player is betting that the next roll will be a Craps roll of some kind (i.e., 2, 3, or 12). If the bet wins, it pays 7 to 1.

Any Seven

At the top of the rectangular area in the center of the layout, which contains images of dice combinations, is an area marked "Seven." A player may make a bet that the next roll will be a 7, and it will be placed in this area by the Stickman. If the next roll is a 7, the winning bet will pay 4 to 1. This bet is also known in Craps slang as a "Big Red."

More Proposition Bets

The bets in the center of the layout, some of which have been described above, are known as proposition bets. They carry the highest house edge. Beneath the Any Seven bet in the center of the layout, there are several images of dice combinations which represent special bets that can be made at any time.

Hardways

The first four dice combinations beneath the Any Seven area are the Hardway bets. There is a pair of three's, a pair of four's, a pair of two's, and a pair of five's. They represent the hard six, hard eight, hard four and hard ten, respectively.

Hardway bets are automatically off on the Come Out, so a Come Out 7 does not affect them unless the player calls his hardways "on" or "working" before the Come Out roll. As an example of how hardway bets work, a bet on hard 6 will win if a pair of three's rolls before any other combination of six (4-2 or 5-1) or before the shooter sevens out. If the shooter rolls any other combination adding up to six other than the 3-3, or if he/she sevens out, the hardway bet loses. A lost hardway bet may be replaced at any time.

All of the other hardway bets work the same way as described above. Hard 6 and hard 8, pay 9 to 1 when they win, and hard 4 and hard 10, pay 7 to 1.

Horn Bets

Directly beneath the hardway bets in the layout, there are "Horn Bets." A Horn bet is a one roll bet which covers the two, three, eleven and twelve. Whatever amount the player bets is divided equally among these four bets as long as it is an even amount. So, an $8 horn bet would mean that $2 each was bet on the two, three, eleven and twelve. However, should the player bet an odd amount like $5, for instance, the dealer would place $1 on each number, but the player would also have to indicate upon which number he/he wanted the extra dollar placed.

A Horn bet can be placed at any time between rolls, and it wins if one of the numbers in the Horn group appears on the next roll of the dice. Otherwise, it loses. The payoffs are the same as if the numbers were bet individually. If the two or twelve rolls, the player is paid 30 to 1. If a three, sometimes referred to as "Ace-Deuce," rolls, it pays 15 to 1 as does the eleven.

As indicated above, a player does not have to bet the whole Horn but can bet only on the two or any other single number in the horn. By way of further explanation of terminology, a player who is betting on "Boxcars" or "Midnight" is making a bet on the twelve.

World Bet

A "World Bet" is not generally shown on the layout, but it is exactly the same as the Horn bet and works exactly the same way with the exception that the seven is included in the group of numbers along with the two, three, eleven and twelve. If the seven rolls, it pays 4 to 1 just like an Any Seven bet.

Hop Bet

Even though not shown on the layout, the Hop bet is usually accepted by most casinos. A Hop bet is a one roll bet that a certain combination will appear on the next roll. If a player hops the 3-2, he is betting that on the next roll, a 3 will appear on one of the dice and a 2 on the other.

The Hop bet pays 30 to 1 for a winning bet on the single combinations of 1-1, 2-2, 3-3, 4-4, 5-5 and 6-6. It pays 30 to 1 for all winning combinations, but if the player is betting the 4-3, he/she must also bet the 3-4 because it is impossible to tell whether the winning combination was a 4-3 or 3-4. Therefore, hopping any combination other than the single combinations that make up the two and twelve or the hard four, hard six, hard eight or hard ten, only pays 15 to 1.

Craps Payout Table

The following provides an example of a payout table for the game of Craps:

TABLE G

| Bet Name | Description | Payout (Odds Against Win) |
|---|---|---|
| Pass Line | 7 or 11 on Come Out roll, Point thereafter | 1:1 |
| Don't Pass | 2 or 3 on Come Out roll, 7 thereafter | 1:1 |

TABLE G-continued

| Bet Name | Description | Payout (Odds Against Win) |
|---|---|---|
| Come | 7 or 11 on Come roll, Come Point thereafter | 1:1 |
| Don't Come | 2 or 3 on Come roll, 7 thereafter | 1:1 |
| Field | 2, 3, 4, 9, 10, 11 or 12 on next roll | 2:1 on 2 or 12<br>1:1 on 3, 4, 9, 10 or 11 |
| Big 6 | 6 before 7 | 1:1 |
| Big 8 | 8 before 7 | 1:1 |
| Place 4 to Win | 4 before 7 | 9:5 |
| Place 5 to Win | 5 before 7 | 7:5 |
| Place 6 to Win | 6 before 7 | 7:6 |
| Place 8 to Win | 8 before 7 | 7:6 |
| Place 9 to Win | 9 before 7 | 7:5 |
| Place 10 to Win | 10 before 7 | 9:5 |
| Place Against 4 | 7 before 4 | 5:11 |
| Place Against 5 | 7 before 5 | 5:8 |
| Place Against 6 | 7 before 6 | 4:5 |
| Place Against 8 | 7 before 8 | 4:5 |
| Place Against 9 | 7 before 9 | 5:8 |
| Place Against 10 | 7 before 10 | 5:11 |
| Buy 4 | 4 before 7 | 2:1 after 5% vigorish |
| Buy 5 | 5 before 7 | 3:2 after 5% vigorish |
| Buy 6 | 6 before 7 | 6:5 after 5% vigorish |
| Buy 8 | 8 before 7 | 6:5 after 5% vigorish |
| Buy 9 | 9 before 7 | 3:2 after 5% vigorish |
| Buy 10 | 10 before 7 | 2:1 after 5% vigorish |
| Lay 4 | 7 before 4 | 1:2 less 5% of win |
| Lay 5 | 7 before 5 | 2:3 less 5% of win |
| Lay 6 | 7 before 6 | 5:6 less 5% of win |
| Lay 8 | 7 before 8 | 5:6 less 5% of win |
| Lay 9 | 7 before 9 | 2:3 less 5% of win |
| Lay 10 | 7 before 10 | 1:2 less 5% of win |
| Hard Four | 4 the Hard Way before 7 or Easy 4 | 7:1 |
| Hard Six | 6 the Hard Way before 7 or Easy 6 | 9:1 |
| Hard Eight | 8 the Hard Way before 7 or Easy 8 | 9:1 |
| Hard Ten | 10 the Hard Way before 7 or Easy 10 | 7:1 |
| Any Seven | 7 on next roll | 4:1 |
| Any Craps | 2, 3 or 12 on next roll | 7:1 |
| Horn: 2 Craps | 2 on next roll | 30:1 |
| Horn: 3 Craps | 3 on next roll | 15:1 |
| Horn: 11 (Yo) | 11 on next roll | 15:1 |
| Horn: 12 Craps | 12 on next roll | 30:1 |
| Horn Bet<br>(4-Way Horn) | 2, 3, 11 or 12 on next roll | 27:4 on 2 or 12<br>12:4 on 3 or 11 |
| C: Any Craps | 2, 3 or 12 on next roll | 7:1 |
| E: Eleven (Yo) | 11 on next roll | 15:1 |
| C & E Split | 2, 3, 11 or 12 on next roll | 3:1 on 2, 3 or 12<br>7:1 on 11 |
| Pass Odds | Point before 7, backup to Pass Line bet | 2:1 on 4 or 10 Point<br>3:2 on 5 or 9 Point<br>6:5 on 6 or 8 Point |
| Don't Pass Odds | 7 before Point, backup to Don't Pass bet | 1:2 on 4 or 10 Point<br>2:3 on 5 or 9 Point<br>5:6 on 6 or 8 Point |
| Come Odds | Come Point before 7, backup to Come bet | 2:1 on 4 or 10 Come Point<br>3:2 on 5 or 9 Come Point<br>6:5 on 6 or 8 Come Point |
| Don't Come Odds | 7 before Come Point, backup to Don't Come bet | 1:2 on 4 or 10 Come Point<br>2:3 on 5 or 9 Come Point<br>5:6 on 6 or 8 Come Point |

If the casino pays off a bet at true odds, meaning that there is no built-in house advantage, the casino incorporates a tax known as a "vigorish" as stated in the payout table above.

It should be understood that casinos adopt their own rules for wagering games. Accordingly, the rules for the game of Craps described above can vary from casino to casino.

Game of Roulette

In one embodiment, the gaming system includes some or part of the game rules, layout, logic or data of the conventional, casino Roulette game. In another embodiment, the gaming system includes a simplified, reduced, augmented or modified version of some, part or all of the game rules, layout, logic and data of the conventional, casino Roulette game.

Figure 34:
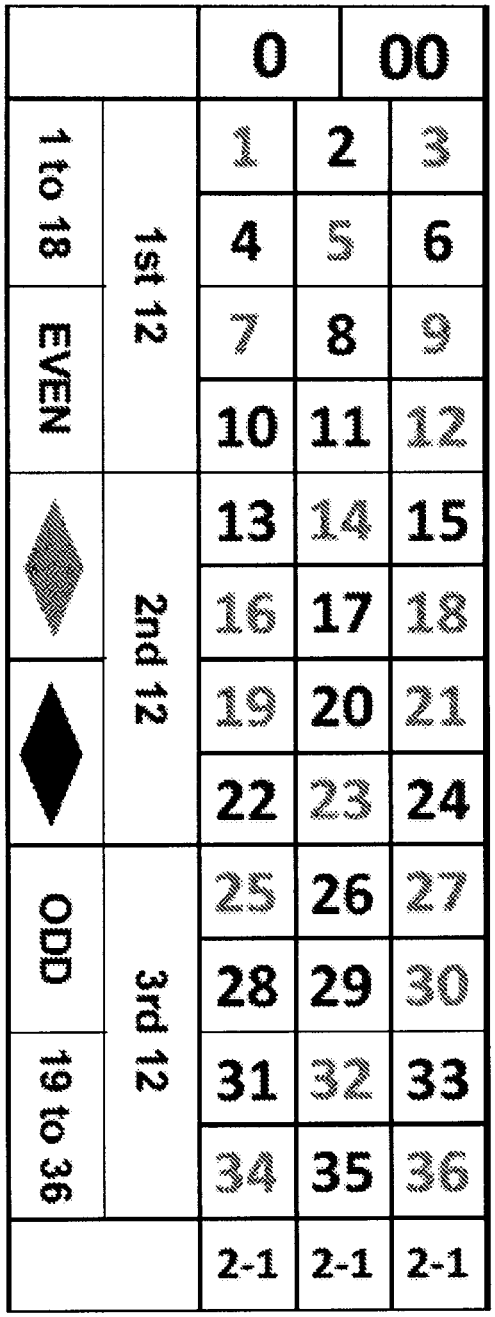
FIG. 34 is a top view of an embodiment of a Roulette betting layout.

The rules for Roulette can vary depending upon the country. The conventional, United States rules are described below. A Roulette wheel consists of thirty-eight slots labeled 1 to 36, zero, and double zero. The Roulette betting layout consists of every individual number as well as a host of "outside" or combinations of numbers. In the layout set forth in FIG. 34 , the even numbers are black, and the odd numbers are red, indicated by gray color. The player can place a chip on any single number, zero, or double zero. The player can also place a chip on a line between two numbers, thereby betting on those two numbers. This is sometimes referred to as a line bet. The player can place a chip on the intersection between the horizontal and vertical lines between four numbers, thereby betting on those four numbers. This is sometime referred to as a corner bet. Also, the player can use the first two columns, shown in FIG. 34, to bet on various groups of outcomes.

For example, the player can place a chip on red to bet that the ball will land in one of the red numbered slots. The player can place a chip on black to bet that the ball will land in one of the black numbered slots. Likewise, the player can place a group bet, betting that the ball will fall within a slot numbered 1 to 18, an even-numbered slot, an odd-numbered slot, a slot numbered 19 to 36, one of the first twelve slots, one of the second twelve slots, or one of the third twelve slots.

After the players make their bets, the dealer spins the wheel, and the ball rolls on the wheel. After several seconds, the ball lands in one of the labeled slots.

The Roulette chips have no value denomination printed on them. The Roulette table has six to eight sets of different colored chips. Each set consists of 300 chips. When a player buys-in, the player receives his/her own color. The player's value is the buy-in amount divided by the number of chips received. The dealer places a token on top of the dealer's stack of that color of chips to indicate the player's value.

The following table displays the available bets, the win (on a "to one" basis), and the probability of winning under United States rules. The house edge on bets is 1/19, or 5.26%, except for one bet. The exception is the 0-00-1-2-3 combination, which carries a house edge of 7.89%.

TABLE I

| Double-Zero Roulette | | | |
|---|---|---|---|
| Bet | Pays | Probability Win | House Edge |
| Red | 1 | 47.37% | 5.26% |
| Black | 1 | 47.37% | 5.26% |
| Odd | 1 | 47.37% | 5.26% |
| Even | 1 | 47.37% | 5.26% |
| 1 to 18 | 1 | 47.37% | 5.26% |
| 19 to 36 | 1 | 47.37% | 5.26% |
| 1 to 12 | 2 | 31.58% | 5.26% |
| 13 to 24 | 2 | 31.58% | 5.26% |
| 25 to 36 | 2 | 31.58% | 5.26% |
| Sixline (6 numbers) | 5 | 15.79% | 5.26% |
| First five (5 numbers) | 6 | 13.16% | 7.89% |
| Corner (4 numbers) | 8 | 10.53% | 5.26% |
| Street (3 numbers) | 11 | 7.89% | 5.26% |
| Split (2 numbers) | 17 | 5.26% | 5.26% |
| Any one number | 35 | 2.63% | 5.26% |

Many high-end casinos in the United States have single-zero wheels. The limits on the single-zero wheels are usually higher than the limits on the double-zero wheels.

It should be understood that casinos adopt their own rules for wagering games. Accordingly, the rules for the game of Roulette described above can vary from casino to casino.

Part II

Figure 26:
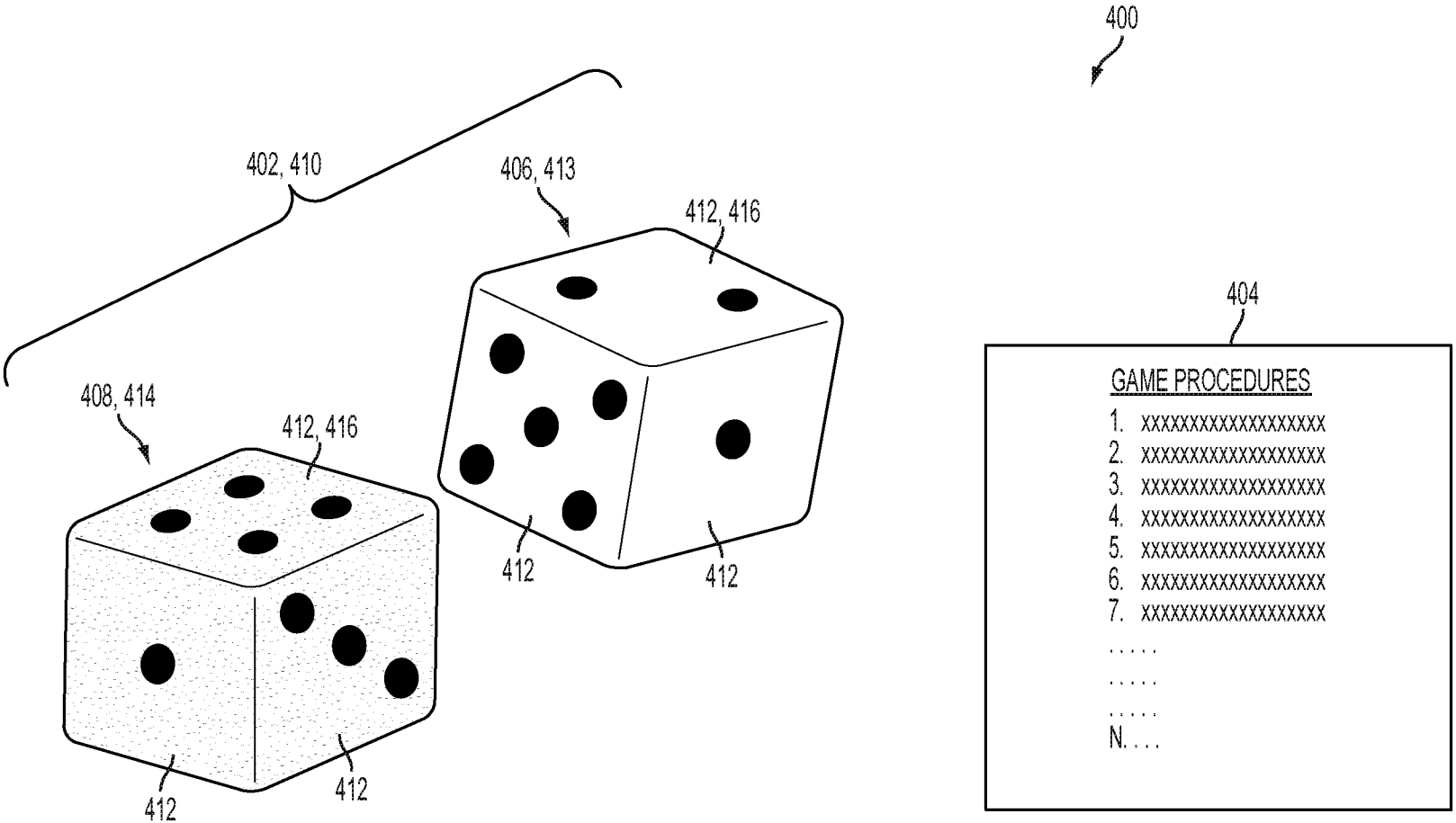
FIG. 26 is an isometric, schematic view of one embodiment of the gaming system.

Referring to FIG. 26, in one embodiment, the game, gaming device or gaming system 400 includes a plurality of outcome generators 402 and a set of game rules or game procedures 404. The outcome generators 402 include outcome generator 406 and outcome generator 408. The outcome generators 406 and 408 are different from each other in some aspect or characteristic. Put another way, the outcome generators 406 and 408 are not identical. In one embodiment, the outcome generators 406 and 408 differ in color though they have the identical shape and size. In another embodiment, at least one of the outcome generators 402 has a symbol or mark which distinguishes it from the other outcome generator 402, though the outcome generators 402 have the identical shape and size. Depending upon the embodiment, the outcome generators 402 can differ in color, size, shape or another visible characteristic.

In one embodiment, each of the outcome generators 402 is rollable, moveable or otherwise operable to indicate, produce or generate an outcome. The outcome generators 402 are independently operable to independently generate their outcomes regardless of whether the outcome generators 402 are operated, or in motion, at the same time or at different times. Depending upon the embodiment, the outcome generators 402 can have a physical or mechanical form, or the outcome generators 402 can have a virtual, graphical or computerized form. For example, the outcome generators 402 can have a computer-generated, virtual or graphical form, such as a three-dimensional, animated image displayable by an electronic display device, such as an LCD-based or LED-based display device.

Depending upon the embodiment, each outcome generator 402 can be a rollable, multi-sided object, a rotatabe wheel or reel, a spinnable spinner, or a meter or measurer operable to measure variable magnitudes, such as distance traveled, weight or force.

In the example shown in FIG. 26, the outcome generators 402 are game playing dice 410 having the identical shape and size. As illustrated, each of the dice 410 has six, differently-marked faces 412. Each side or face 412 has or displays one or more pips or dots. For example, face one has one dot corresponding to an outcome value of one, face two has two dots corresponding to an outcome value of two, face three has three dots corresponding to an outcome value of three, face four has four dots corresponding to an outcome value of four, face five has five dots corresponding to an outcome value of five, and face six has six dots corresponding to an outcome value of six. In one example, outcome generator or blue die 413 has a blue color, and outcome generator or red die 414 has a red color.

The player can toss, throw or roll the dice 410, enabling each one to land with a side facing up. When the dice 410 stop rolling, each die produces an outcome associated with its top side or face-up 416. In the example shown, blue die 413 landed with an outcome of two, and red dice 414 landed with an outcome of four.

In one embodiment, the outcome generators 402 are operable to generate outcomes which are comparable to each other. The comparison of the outcomes results in a competition outcome corresponding to a win, loss, tie or draw. Put another way, some of the outcomes of one of the generators 402 will be superior to, or inferior to, some of the outcomes of the other outcome generator 402. For example, one of the outcome generators 402 will outrank the other outcome generator 402. A generator 402 having a superior outcome corresponds to a winning competition outcome or a win. A generator 402 having an inferior outcome corresponds to a losing competition outcome or a loss. If the player's selected generator 402 outranks the other generator 402, the competition outcome is a win for the player.

The outcome generators 402, in one embodiment, are competitors or competing entities having fans or supporters. For example, the blue die 413 is the blue competitor competing against the red die 414, the red competitor.

In one embodiment, the game procedures 404 are as follows:

(I) A player selects or chooses one of the outcome generators 402. For example, the player may select the blue die 413. In this example, the player's selected blue die 413 will compete against the red die 414.

(II) The player places a base bet, and the player can optionally place a bonus bet.

(A) Regarding the base bet, the base win occurs if the player's selected blue die 413 indicates the superior outcome and the red die 414 indicates the inferior outcome. The player specifies a desired base quantity for the streak of base wins, that is, a quantity of base wins which can occur during a plurality of consecutive operations of the dice 413 and 414. For example, the player can specify a streak quantity of two.

(B) Regarding the bonus bet, the player can specify a desired bonus quantity for a streak extension (e.g., one or more additional base wins within the winning streak), that is, additional consecutive times that the base win could occur. The bonus quantity can be one or more additional base wins. For example, the player may bet that, after the player has achieved a wagered-upon streak of two base wins, the player will win the bonus bet if the player achieves two more consecutive wins, extending the total winning streak to four.

(III) When placing the base bet and optional bonus bet, the player wagers a desired amount of his/her chips, credits, suitable form of monetary value, or fictitious money (e.g., play money). The player can wager one amount for the base bet and a different amount for the bonus bet.

(IV) The payout rate for the gaming system 400 depends upon a paytable of payout amounts associated with competition outcome probabilities. The payout rate increases with the increase in the winning streak quantity wagered upon by the player. The payout rate also increases with the increase in the winning streak extension quantity wagered upon by the player. As the streak quantity increases, the odds of success decreases. As the odds of success decreases, the payout rate increases.

(V) The player or a non-player rolls or otherwise operates the dice 410.

(VI) If the first operation results in a losing competition outcome, the game ends, and the player receives no payout or award.

(VII) If the first operation results in a winning competition outcome, the player or the non-player operates the dice 410 again.

(VIII) The operations are repeated until the player loses or wins the base bet (and any bonus bet), whichever occurs first.

(IX) If the player wins the base bet, the player receives a base award depending upon the paytable.

(X) If the player wins the bonus bet, the player receives a bonus award in addition to the base award. The bonus award depends upon the paytable. Depending upon the embodiment, the bonus award can be a lump sum added to the base award, or the bonus award can be the product of the base award and a suitable multiplier (e.g., 2× or 3×).

Depending upon the embodiment, a streak of competition outcomes can include a plurality back-to-back wins, a plurality of back-to-back losses, a plurality of back-to-back ties or doubles, a sequence of consecutive wins, a sequence of consecutive losses, or a sequence of consecutive ties or doubles. In one embodiment, the occurrence of a tie or dice doubles does not count as part of a streak, does not prevent a streak from starting, and does not break or end a streak.

The game procedures 404 can have different forms depending upon the embodiment. In one embodiment, the game procedures 404 are written instructions, documentation or information in paper, electronic, audio or visual form. In another embodiment, the game procedures 404 include computer-readable instructions, computer code, databases, data sets, data fields or and data files. In such embodiment, the gaming system 400 includes a data storage device or memory device which stores the game procedures 404, such as data storage device 204 or 305.

In one embodiment, the gaming system 400 includes a competition outcome recorder or competition outcome tracker. The competition outcome tracker records or tracks the competition outcomes during the play of the game. As the player progresses from win to win, for example, the outcome tracker records the outcomes.

In one embodiment, the outcome tracker is useful for tracking multiple wagers for multiple streak outcomes. The gaming system 400, in such embodiment, enables the player to simultaneously place different levels of wagers on different levels of competition outcome streaks. For the base bet for example, the player can wager a twenty dollar betting chip on a competition outcome streak of two. At the same time, the player can wager a five dollar betting chip on a competition outcome streak of four. If the player achieves the two streak, the gaming system 400 provides the player with a designated award based on a designated payout rate. If the player also achieves the three streak, the gaming system 400 provides the player with an additional award based on a higher payout rate. In such embodiment, the outcome tracker tracks the competition outcomes relative to the player's progress for the two simultaneous bets. Depending upon the embodiment, the competition outcome tracker can include a paper sheet, electronic document, chart or outcome table. In one embodiment, the competition outcome tracker is incorporated into, and part of, the layout 426 described below.

Figure 27:
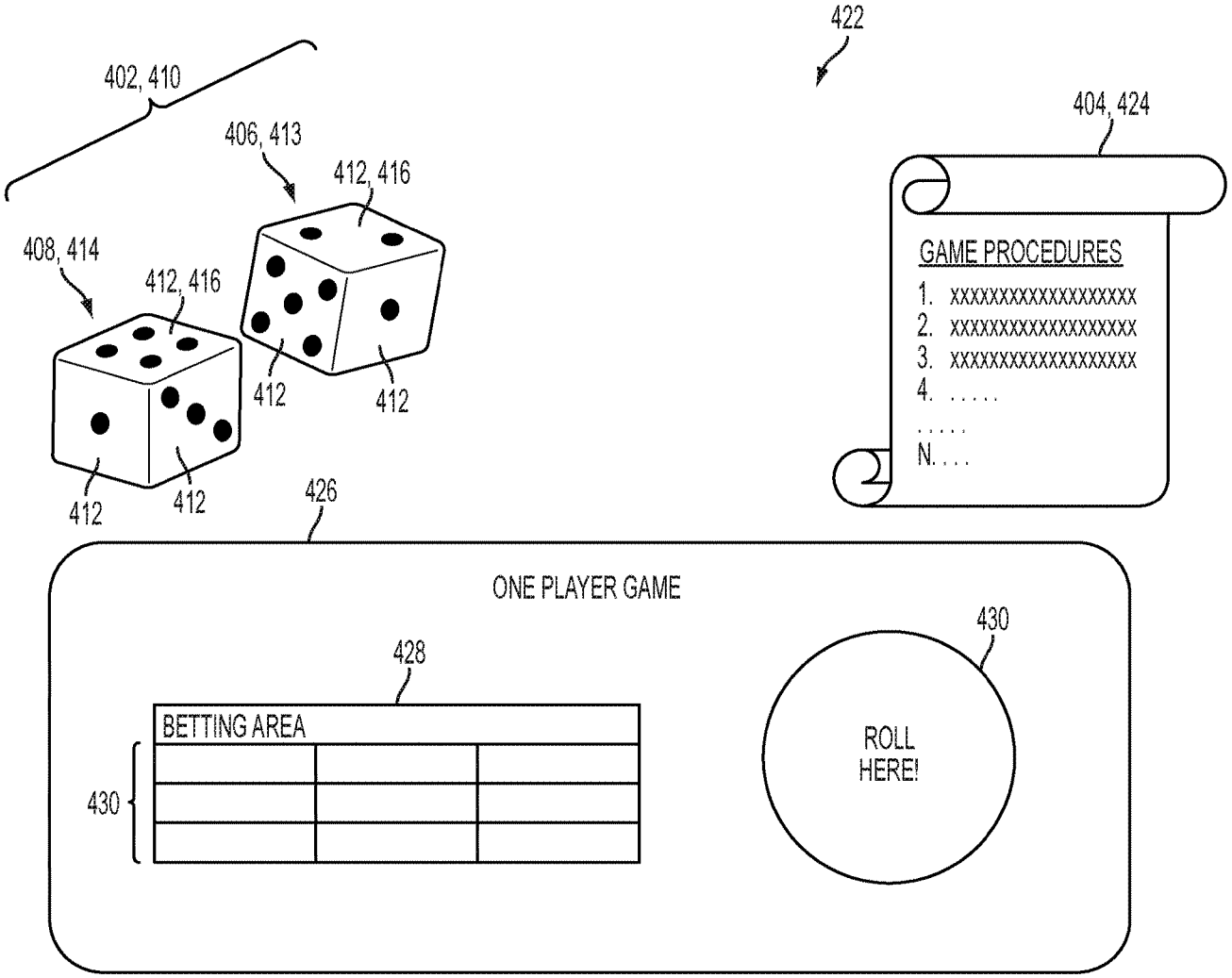
FIG. 27 is an isometric, schematic view of another embodiment of the gaming system.

In one embodiment illustrated in FIG. 27, the gaming system 422 includes: (a) the outcome generators 402; (b) the game information device 424 (e.g., a paper sheet, electronic document, electronic display device or the data storage device 284 illustrated in FIG. 24) which implements, records, stores or displays the game procedures 404; and (c) a one-player game layout 426 having a suitable structure such as a felt material, a layer or a board. The layout 426 has a betting area 428 and an operation area 430 where the generators 402 operate.

The betting area 428 has a plurality of different sections or subareas 430 associated with different types or levels of bets that the player can place. For example, the subareas 430 may include the following betting spots for the base bet: a one-streak quantity betting spot, a two-streak quantity betting spot, a three-streak quantity betting spot, a four-streak quantity betting spot, and a five-streak quantity betting spot. The subareas 430 may also include the following betting spots for the bonus bet: a one extension streak quantity betting spot, a two extension streak quantity betting spot, and a three extension streak quantity betting spot. The player can place betting chips on the desired subareas 430 to place his/her base bet and bonus bet. In one example, the player rolls the dice 410 along, on or within the roll area 432. In operation, the player selects one of the dice 410 as his/her competitor. The player then rolls the dice 410 on one or more occasions. The player has the prospect of achieving a winning streak (and streak extension) against the non-selected die.

Figure 28:
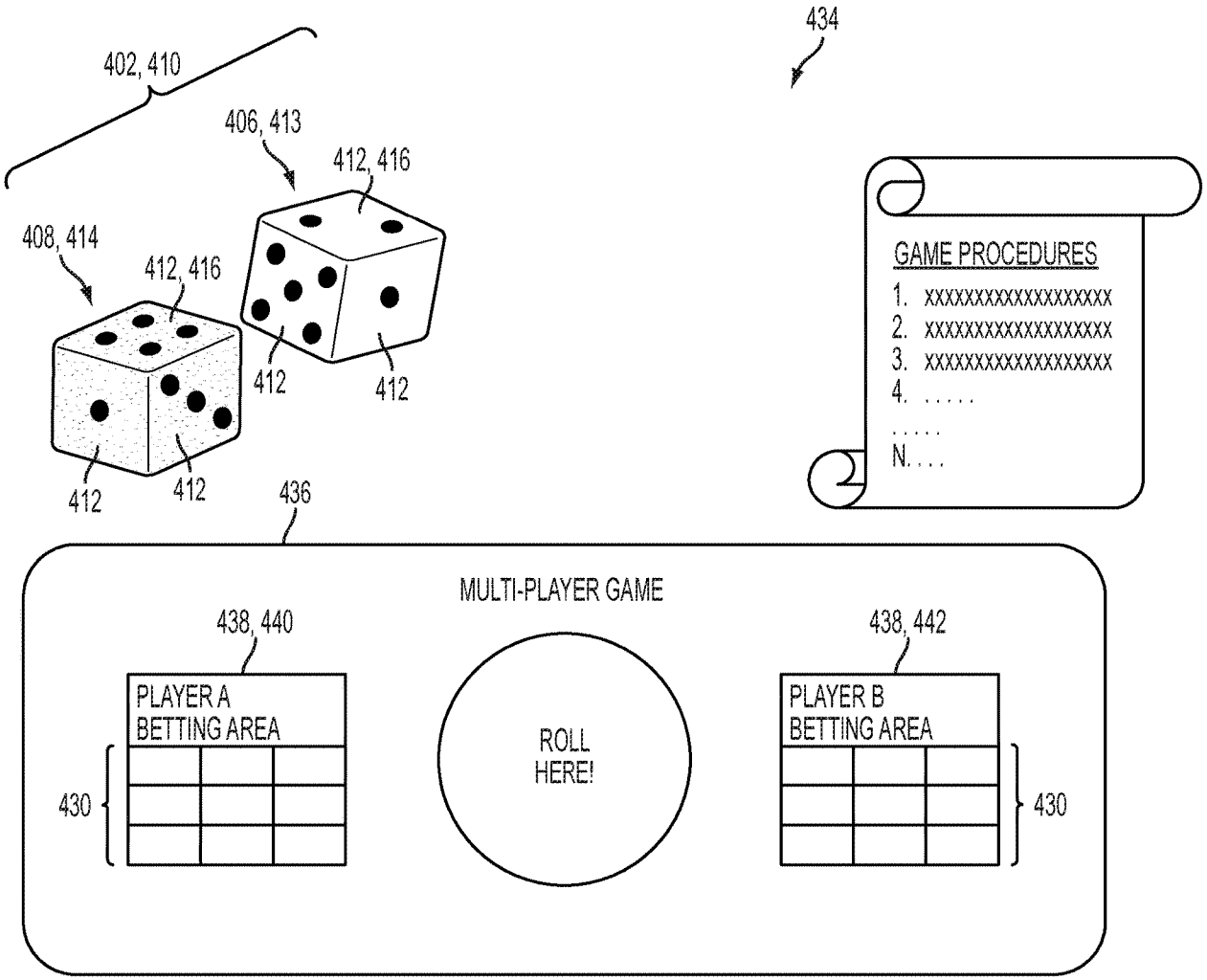
FIG. 28 is an isometric, schematic view of yet another embodiment of the gaming system.

In another embodiment illustrated in FIG. 28, the gaming system 434 includes: (a) the outcome generators 402; (b) the game information device 424; and (c) a two-player or multi-player game layout 436 having a suitable structure such as a felt material, a layer or a board. The layout 436 has betting areas 438 and operation area 430. The betting areas 438 include a left betting area 440 for one player and a right betting area 442 for another player. In the example shown, the betting areas 438 are identical to the betting areas 428 of the one-player layout 126. In this embodiment, the two players compete against each other. In operation, one player selects one of the dice 410 as his/her competitor, and the other player selects another one of the dice 410 as his/her competitor. A non-player, such as a game operator, rolls the dice 410 on one or more occasions. Each player has the prospect of achieving a winning streak (and streak extension) against the other player.

Referring to FIG. 29, in one embodiment, each gaming system 400, 422 and 434 is associated with a competing color theme. The dice 410 differ by a visible color.

In the first example 441, the dice 410 are identical in all characteristics except that one of the dice 410 is red, and the other one of the dice 410 is green.

In the second example 443, each gaming system 400, 422 and 434 has a sword fight theme or a dueling dice theme. In this example, each gaming system 400, 422 and 434 has a sign which displays an image of a blue-colored Lord X swordsman character versus a gold-colored Sir Z swordsman character. The shape of each character incorporates a die shape or die structure combined with legs, arms and a head. In this example, the dice 410 are identical in all characteristics except that one of the dice 410 is blue (corresponding to Lord X), and the other one of the dice 410 is gold (corresponding to Sir Z).

In the third example 444, each gaming system 400, 422 and 434 has a boxing or fighting theme. In this example, each gaming system 400, 422 and 434 has a sign which displays an image of a purple-colored fighter A boxing character versus a yellow-colored fighter B boxing character. The shape of each character incorporates a die shape or die structure combined with legs, arms and a head. In this example, the dice 410 are identical in all characteristics except that one of the dice 410 is purple (corresponding to fighter A), and the other one of the dice 410 is yellow (corresponding to fighter B).

In the fourth example 446, each gaming system 400, 422 and 434 has an American football theme. In this example, each gaming system 400, 422 and 434 has a sign which displays an image of the black and yellow-colored Pittsburgh Steelers® football team versus the blue and orange-colored Chicago Bears® football team. In this example, the dice 410 are identical in all characteristics except that one of the dice 410 is black and yellow (corresponding to the Pittsburgh Steelers® football team), and the other one of the dice 410 is blue and orange (corresponding to the Chicago Bears® football team).

Referring to FIG. 30, in one embodiment, each gaming system 400, 422 and 434 is associated with a competing symbol theme. The dice 410 differ by one or more visible symbols.

In the first example 448, each gaming system 400, 422 and 434 has a sword fight theme or a dueling dice theme. In this example, each gaming system 400, 422 and 434 has a sign which displays an image of a Lord X swordsman character versus a Sir Z swordsman character. In this example, the dice 410 are identical in all characteristics except that one of the dice 410 has, bears or otherwise displays an X (corresponding to Lord X), and the other one of the dice 410 has, bears or otherwise displays a Z (corresponding to Sir Z).

In the second example 450, each gaming system 400, 422 and 434 has a boxing or fighting theme. In this example, each gaming system 400, 422 and 434 has a sign which displays an image of a fighter A boxing character versus a fighter B boxing character. In this example, the dice 410 are identical in all characteristics except that one of the dice 410 has, bears or otherwise displays the letter A (corresponding to fighter A), and the other one of the dice 410 has, bears or otherwise displays the letter B (corresponding to fighter B).

In the third example 452, each gaming system 400, 422 and 434 has an American football theme. In this example, each gaming system 400, 422 and 434 has a sign which displays an image of the Pittsburgh Steelers® football team versus the Chicago Bears® football team. In this example, the dice 410 are identical in all characteristics except that one of the dice 410 has, bears or otherwise displays the Pittsburgh Steelers® team logo (corresponding to the Pittsburgh Steelers® football team), and the other one of the dice 410 has, bears or otherwise displays the Chicago Bears® team logo (corresponding to the Chicago Bears® football team).

Figure 31:
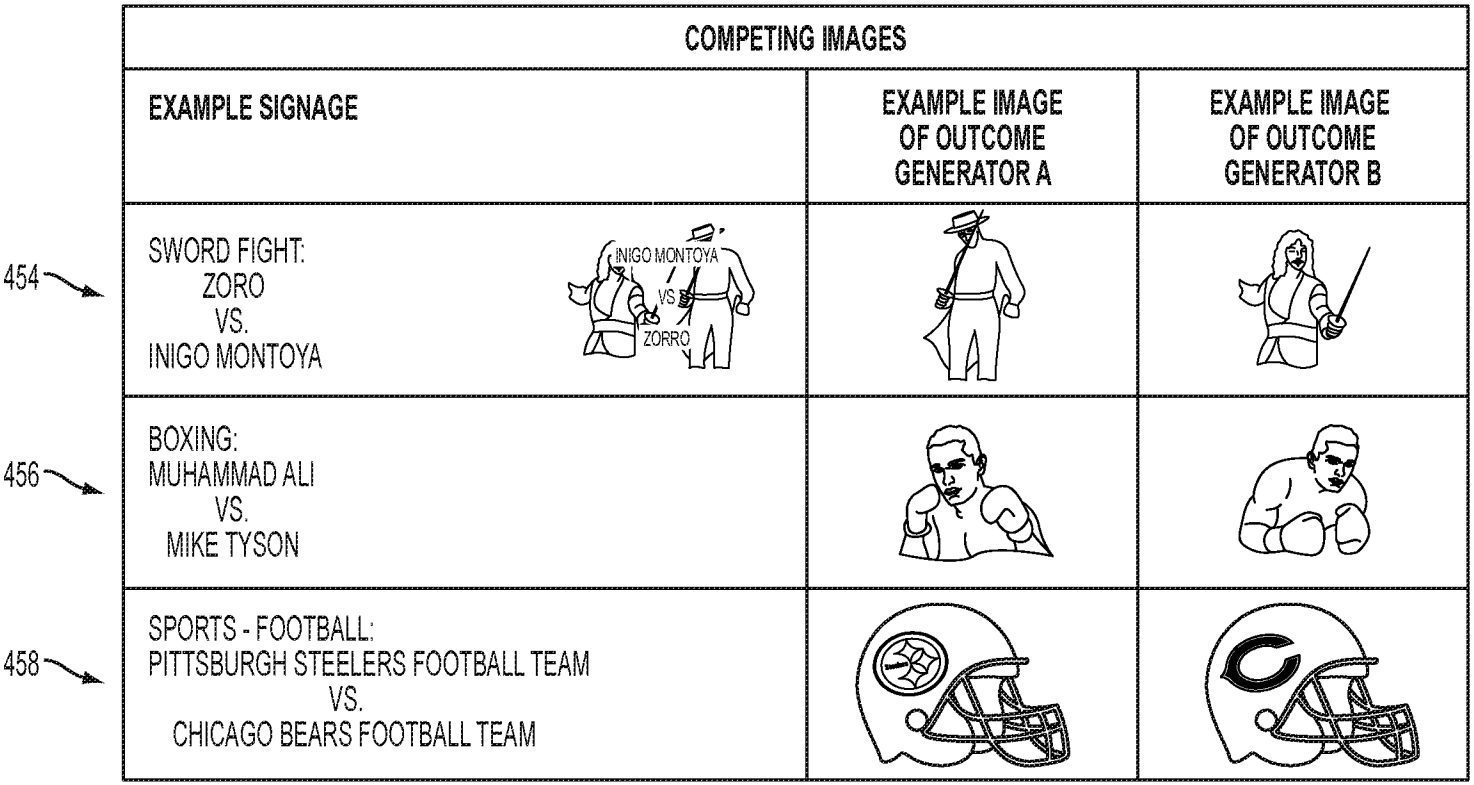
FIG. 31 is a table illustrating competing image examples of one embodiment of the gaming system.

Referring to FIG. 31, in one embodiment, each gaming system 400, 422 and 434 is associated with a competing image theme. The dice 410 differ by one or more visible images.

In the first example 454, each gaming system 400, 422 and 434 has a sword fight theme or a dueling dice theme. In this example, each gaming system 400, 422 and 434 has a sign which displays an image of a Zoro® swordsman character versus an Inigo Montoya swordsman character. In this example, the dice 410 are identical in all characteristics except that one of the dice 410 has, bears or otherwise displays an image of the Zoro® character, and the other one of the dice 410 has, bears or otherwise an image of the Inigo Montoya character.

In the second example 456, each gaming system 400, 422 and 434 has a boxing or fighting theme. In this example, each gaming system 400, 422 and 434 has a sign which displays an image of a Muhammad Ali boxing character versus a Mike Tyson boxing character. In this example, the dice 410 are identical in all characteristics except that one of the dice 410 has, bears or otherwise displays an image of the Muhammad Ali character, and the other one of the dice 410 has, bears or otherwise displays an image of the Mike Tyson character.

In the third example 458, each gaming system 400, 422 and 434 has an American football theme. In this example, each gaming system 400, 422 and 434 has a sign which displays an image of the Pittsburgh Steelers® football team versus the Chicago Bears® football team. In this example, the dice 410 are identical in all characteristics except that one of the dice 410 has, bears or otherwise displays the helmet of the Pittsburgh Steelers® team (corresponding to the Pittsburgh Steelers® football team), and the other one of the dice 410 has, bears or otherwise displays the helmet of the Chicago Bears® team logo (corresponding to the Chicago Bears® football team).

In one embodiment, the possible competition outcomes incorporate elements of the game of baseball. The player has a pitcher role. If the face-up value of the player's selected die is higher than the face-up value of the other die, the player achieves a strike or swing-miss, corresponding to a strikeout or win. If the face-up value of the player's selected die is lower than the face-up value of the other die, the batter receives a ball or hit, corresponding to a loss for the player. If the player achieves a streak of these wins, such as two consecutive strikes, the player wins an award depending upon the streak quantity wagered upon by the player.

In another baseball embodiment, the player can achieve a winning streak even if there are intervening losses. For example, each batter represents an opportunity for the player to strikeout the batter or walk the batter. A strikeout corresponds to a win, and a walk corresponds to a loss. Each roll of the dice 410 results in a strike or ball corresponding to a sub-win or sub-loss, respectively. The repeated rolls, corresponding to repeated pitches, can result in balls or sub-losses before the player eventually achieves a strikeout, corresponding to a win. If the player achieves a streak of these wins, the player wins an award depending upon the streak quantity wagered upon by the player.

In one embodiment, the possible competition outcomes incorporate elements of the game of American football. Each roll of the dice 410 can result in: (a) football winning events, such as a successful pass, a successful run, a broken tackle or a touchdown; or (b) football losing events, such as an interception, a fumble or a failure to advance on fourth down. Depending upon the embodiment, a win can correspond to one or more of such football winning events, and a loss can corresponds to one or more of such football losing events. If the player achieves a streak of these wins, the player wins an award depending upon the streak quantity wagered upon by the player.

In one embodiment, the possible competition outcomes incorporate elements of the game of basketball. Each roll of the dice 410 can result in: (a) basketball winning events, such as a successful shot, a successful layup, a successful dunk, a successful assist or a successful assist; or (b) basketball losing events, such as a missed shot, a turnover or a blocked shot. Depending upon the embodiment, a win can correspond to one or more of such basketball winning events, and a loss can corresponds to one or more of such basketball losing events. If the player achieves a streak of these wins, the player wins an award depending upon the streak quantity wagered upon by the player.

In one embodiment, each gaming system 400, 422 and 434 has an electronic output device operable to generate audio, audiovisual or animation output corresponding to game play events or simulation of game experience, such as crowd sounds. For example, the output device can generate an audio output, "Strike 3, You're Out!" when the player achieves a strikeout win based on a streak of three consecutive strikes.

In one embodiment, the output device displays a plurality of animated, interacting symbols. For example, one symbol can include character A corresponding to one of the dice 410, and another symbol can include character B corresponding to another one of the dice 410. The animation includes the interaction of characters A and B. With each dice 410 roll, the player advances along a winning streak. With each win, the output device modifies the interaction between the characters A and B. This forms an incremental or progressive interaction between the characters A and B. The incremental interaction indicates the winning of one of the dice 410 over another one of the dice 410. For example, in the first roll, a player's blue-orange die may win over a black-yellow die. Upon completion of the first roll, the output device displays a blue-orange Chicago Bears® football character advancing against a black-yellow Pittsburgh Steelers® football team from the zero yard line to the fifty yard line. In the second roll, the player's blue-orange die may win over a black-yellow die again. Upon completion of the second roll, the output device displays the blue-orange Chicago Bears® football character achieving a touchdown against the black-yellow Pittsburgh Steelers® football team. During the animations, the output device generates sounds and images resembling the football game experience, including crowd cheers and announcer's yells.

Figure 32:
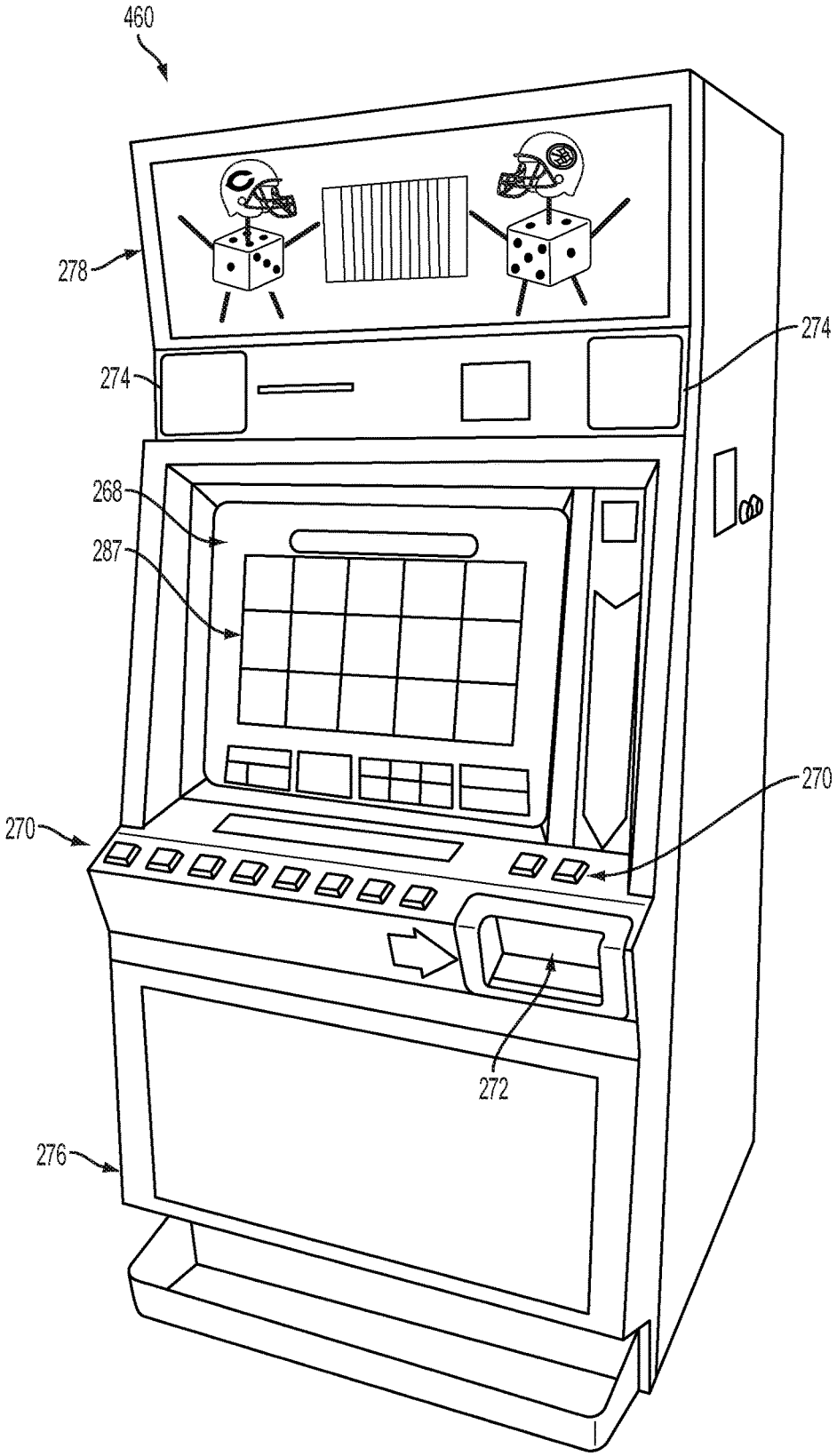
FIG. 32 is a front, isometric view of one embodiment of the gaming device or gaming system.

Referring to FIG. 32, the gaming device or gaming system 460 incorporates the gaming systems 400, 422 and 434. The display device 268 displays the dice 410. The dice 410 are programmable and have a graphical form. In such embodiment, the dice 410 are programmable to display different colors, sports logos or symbols for changing the gaming device themes. In the example shown, the display device 268 displays the rotation of reels 287 for the primary game, and the display device 268 displays the rolling of dice 410 for the bonus game. The top panel 278 includes a display device, such an LCD or LED device. The top panel 278 displays incremental animations of interacting characters corresponding to the competing dice 410. In the example shown, the top panel 278 displays a blue-orange Chicago Bears® football character, a football field, and a black-yellow Pittsburgh Steelers® football character.

Figure 33:
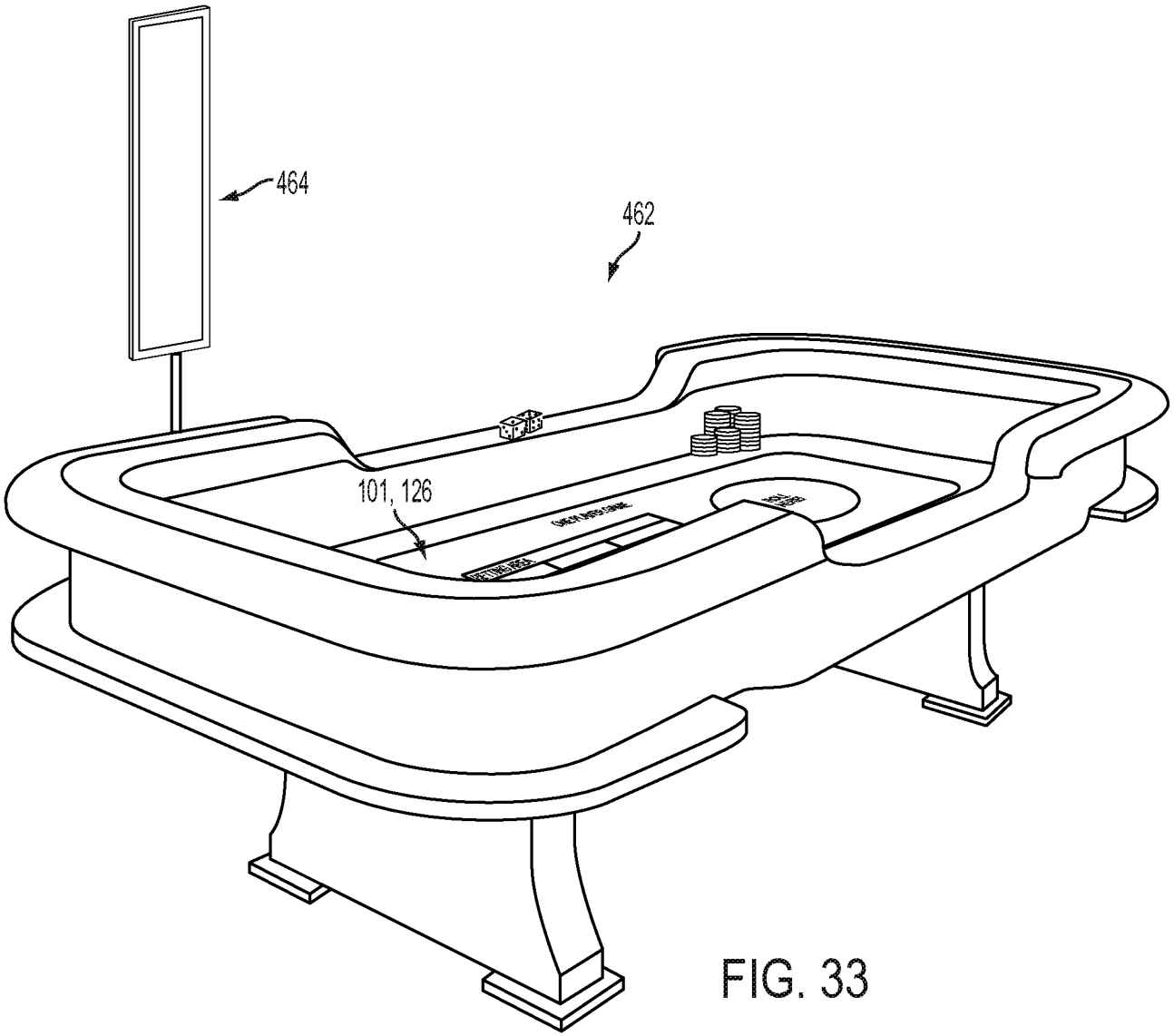
FIG. 33 is a top, isometric view of another embodiment of the gaming device or gaming system.

In one embodiment, each gaming system 400, 422 and 434 is incorporated into, and part of, the gaming table 462 illustrated in FIG. 33. The gaming table 462 has the sign or display device 464 operable to display the signs described above with respect to FIG. 29-31. In one embodiment, the gaming table 462 is the same as table 261 described with respect to FIG. 19 except for the incorporation of gaming system 400, 422 or 434.

In one embodiment, each gaming system 400, 422 and 434 is incorporated into, and part of, the gaming device 464 illustrated in FIG. 23. The display device 268 is operable to display the outcome generators 402 and associated animations. In one embodiment, the gaming device 464 is the same as gaming device 264 described with respect to FIGS. 23-24 except for the incorporation of gaming system 400, 422 and 434. In one embodiment, each one of the gaming systems 400, 422 and 434 has the electronic configuration 280 illustrated in FIG. 24.

In one embodiment, such gaming device 464 includes a kiosk machine, computer or other electronic device which incorporates a camera. Upon an input from the player, the camera takes a photograph of the player and stores the digital photograph data file. The gaming device 464 then incorporates the player's photographic image into one of the graphical dice 210 selected by the player.

In one embodiment, the dice 410 are over-sized compared to the standard-sized playing dice. In another embodiment, one of the dice 410 has one size, and the other one of dice 410 has a larger size. Though differently sized, such dice have the same outcome probabilities.

In a toy or non-wager embodiment, a set of relatively large dice 410, compared to the standard-sized playing dice, have electronic display surfaces, audio output devices or speakers, and a battery holder. For example, the dice sides include LEDs or LCDs to generate different images, including various symbols, colors or characters. Rather than placing monetary-based bets on outcome streaks, the players place predictions on outcome streaks. Streak winners earn game points or fictitious money.

Referring to FIGS. 14 and 24, in one embodiment, the display device 298 displays an image of the game layout 128. In this embodiment, the gaming device 264 incorporates a camera. Upon inputs from the players, the camera takes photographs of the players and stores the digital photograph data files associated with the different players. When a player selects the space or square of a desired grid outcome, such as grid outcome twenty-six, the display device 298 displays the player's photograph or image on such square. The display device 298 performs the same step for the other players. In this way, the gaming device 264 graphically indicates the different bets wagered by the different players on the grid 134. Each player image can also display the amount of the wager placed on the applicable squares within the grid 134.

In another embodiment, the display device 298 displays player icons, player photographs, player symbols or player images of the participating players adjacent to the grid 134. The gaming device 264 is programmed to store graphical output of the players' bet or wager information in association with the player images. When a player touches or "mouses over" his/her player image, the gaming device 264 displays text or images which describe such player's wager information. For example, the display device 298 can display a grid graphical overlay, grid highlight or separate window or popup showing such player's particular position, single bet, line bet or corner bet within the framework of a given grid position or square.

In another embodiment, the gaming system 12 includes electronic chips having built-in display devices and batteries. The gaming device 264 is operable to control the images on the chips through wireless communication. The gaming system 12 also includes a player tracking card or player data card. The gaming device 264 enables each player to provide an input. The input causes the gaming device 262 to cause the desired chips to display the player's photographic image. During the course of a game, the gaming device 262 enables the player to modify or enhance his/her chip image. At the end of the game, the gaming device 262 updates the data on the player data card, storing date associated with the latest version of the player's chip image. When the player starts another game at a later time using his/her card, the gaming device 262 automatically displays the latest image on the chips.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A gaming system comprising:

a data storage device storing a plurality of instructions executable by a processor to:

generate first visual output indicating information related to a competition between a first competitor and a second competitor, wherein a win is based upon a comparison of scores achieved by the first and second competitors;

receive a first wager signal from one or more electronic wager acceptors, wherein the first wager signal corresponds to a first wager on the first competitor by a first wager submitter;

receive a second wager signal from the one or more electronic wager acceptors, wherein the second wager signal corresponds to a second wager on the second competitor by a second wager submitter;

generate second visual output indicating at least part of a grid, wherein the grid comprises:

(a) a plurality of rows comprising an outer row associated with the first competitor;

(b) a plurality of columns comprising an outer column associated with the second competitor; and (c) a plurality of spaces, wherein each one of the spaces is located at an intersection between one of the rows and one of the columns;

associate a first one of the spaces with the first wager submitter;

associate a second one of the spaces with the second wager submitter;

determine one of the rows;

determine one of the columns;

determine a winning intersection of the determined row and the determined column;

determine a base award;

provide the base award to the first or second wager submitter depending upon whether the first or second competitor wins;

determine a bonus award; and provide the bonus award to the first or second wager submitter depending upon whether the winning intersection is located at the first or second space.

2. The gaming system of claim 1, wherein:

the first and second competitors comprise: (a) a plurality of competing outcome generators; (b) plurality of competing dice, wherein a comparison of die values of the dice determines an occurrence of the win; (c) a plurality of competing teams; (d) a plurality of competing sports teams, wherein the competition comprises a sports game; or (e) a plurality of competing characters; and the data storage device stores a plurality of instructions executable by the processor to:

receive a plurality of selection signals corresponding to a plurality of selection inputs from the first and second wager submitters; and determine the first and second spaces depending, at least in part, on the selection signals.

3. A gaming system comprising:

a data storage device storing a plurality of instructions executable by a processor to:

cause at least one display device to indicate information related to a competition between a first competing element and a second competing element, wherein a win is based upon a comparison of scores achieved by the first and second competing elements;

cooperate with one or more input devices to receive a first wager signal from the one or more input devices, wherein the first wager signal corresponds to a first wager on the first competing element by a first wager submitter;

cooperate with the one or more input devices to receive a second wager signal from the one or more input devices, wherein the second wager signal corresponds to a second wager on the second competing element by a second wager submitter;

cause the at least one display device to display at least part of a grid, wherein the grid comprises:

(a) a plurality of rows comprising an outer row associated with the first competing element;

(b) a plurality of columns comprising an outer column associated with the second competing element;

(c) a plurality of spaces, wherein each one of the spaces is located at an intersection between one of the rows and one of the columns;

(d) a plurality of outer row symbols associated with the outer row; and (e) a plurality of outer column symbols associated with the outer column;

associate a first one of the spaces with the first wager submitter;

associate a second one of the spaces with the second wager submitter;

determine one of the outer row symbols;

determine one of the outer column symbols;

determine a winning intersection of:

(a) the outer row comprising the determined outer row symbol; and (b) the outer column comprising the determined outer column symbol;

determine a first monetary value;

provide the first monetary value to the first or second wager submitter depending upon whether the first or second competing element wins;

determine a second monetary value; and provide the second monetary value to the first or second wager submitter depending upon whether the winning intersection is located at the first or second space.

4. The gaming system of claim 3, wherein the first and second competing elements comprise a plurality of competing outcome generators.

5. The gaming system of claim 3, wherein the first and second competing elements comprise a plurality of competing dice, wherein a comparison of die values of the dice determines an occurrence of the win.

6. The gaming system of claim 3, wherein the first and second competing elements comprise a plurality of competing teams.

7. The gaming system of claim 3, wherein the first and second competing elements comprise a plurality of competing sports teams, and the competition comprises a sports game.

8. The gaming system of claim 3, wherein the first and second competing elements comprise a plurality of competing characters.

9. The gaming system of claim 3, wherein the data storage device stores a plurality of instructions executable by the processor to operate a random-based process to determine the first and second spaces.

10. The gaming system of claim 9, wherein the data storage device stores a plurality of instructions executable by the processor to operate a random-based process to:

determine the outer row symbol; and determine the outer column symbol.

11. The gaming system of claim 10, wherein the data storage device stores a plurality of instructions executable by the processor to operate a random-based process to control the competition.

12. The gaming system of claim 3, wherein the data storage device stores a plurality of instructions executable by the processor to:

receive a first selection from the first wager submitter, wherein the first selection corresponds to the first wager submitter's selection of the first space; and associate the first space with the first wager submitter based on the first selection.

13. The gaming system of claim 12, wherein the data storage device stores a plurality of instructions executable by the processor to:

receive a second selection from the second wager submitter, wherein the second selection corresponds to the second wager submitter's selection of the second space; and associate the second space with the second wager submitter based on the second selection.

14. The gaming system of claim 1, wherein each of the one or more electronic wager acceptors comprises one of: (a) an input device configured to be operatively coupled to the processor, wherein the input device is configured to receive a wager input from one of the first or second wager submitters, wherein the wager input corresponds to the first or second wager signal, wherein the wager input comprises human action; ; (b) a payment receiver; (c) a payment receiver configured to receive a cash bill or a data card; (d) a data card reader; (e) a currency acceptor; (f) a button; (g) a depressible button; (h) a bet button; (i) a play button; (j) a mobile input device; (k) a touch module; (l) a touch panel; (m) a touchable element on a touch panel; (n) a means to receive one of the first or second wager signals; or (o) a non-human, electrical element configured to be operatively coupled to the processor.

15. The gaming system of claim 14, comprising at least one payout device operatively coupled to the processor, wherein the at least one payout device is configured to generate output associated with the first and second monetary values.

16. The gaming system of claim 3, wherein each of the one or more input devices comprises one of: (a) a payment receiver configured to be operatively coupled to the processor, wherein the payment receiver is configured to receive a wager input from one of the first or second wager submitters, wherein the wager input corresponds to the first or second wager signals, wherein the wager input comprises human action; (b) a payment receiver; (c) a payment receiver configured to receive a cash bill or a data card; (d) a data card reader; (e) a currency acceptor; (f) an input device configured to be operatively coupled to the processor, wherein the input device is configured to receive a wager input from one of the first or second wager submitters, wherein the wager input corresponds to the first or second wager signal, wherein the wager input comprises human action; (g) a button; (h) a depressible button; (i) a bet button; (j) a play button; (k) a mobile input device; (l) a touch module; (m) a touch panel; (n) a touchable element on a touch panel; (o) a means to receive one of the first or second wager signals; or (p) a non-human, electrical element configured to be operatively coupled to the processor.

17. A gaming system comprising:

a data storage device storing a plurality of instructions executable by a processor to:

cause at least one display device to indicate information related to a competition between a first competing element and a second competing element, wherein a win is based upon a comparison of scores achieved by the first and second competing elements;

receive a first wager communication from one or more electronic wager receivers , wherein the first wager communication corresponds to a first wager on the first competing element, wherein the first wager is submitted by a first wager submitter;

receive a second wager communication from the one or more electronic wager receivers , wherein the second wager communication corresponds to a second wager on the second competing element, wherein the second wager is submitted by a second wager submitter;

cause the at least one display device to display at least part of a grid, wherein the grid comprises:

(a) a plurality of rows comprising an outer row associated with the first competing element;

(b) a plurality of columns comprising an outer column associated with the second competing element; and (c) a plurality of spaces, wherein each one of the spaces is located at an intersection between one of the rows and one of the columns;

associate a first one of the spaces with the first wager submitter;

associate a second one of the spaces with the second wager submitter;

determine one of the rows;

determine one of the columns;

determine a winning intersection of the determined row and the determined column;

provide a first monetary value to:

the first wager submitter if the first competing element wins; and the second wager submitter if the second competing element wins; and provide a second monetary value to:

the first wager submitter if the winning intersection is located at the first space; and the second wager submitter if the winning intersection is located at the second space.

18. The gaming system of claim 17, wherein the grid comprises:

a plurality of outer row symbols associated with the outer row; and a plurality of outer column symbols associated with the outer column, wherein the determined row comprises one of the outer column symbols determined by the processor, wherein the determined column comprises one of the outer row symbols determined by the processor.

19. The gaming system of claim 17, wherein the first and second competing elements comprise: (a) a plurality of competing outcome generators; (b) plurality of competing dice, wherein a comparison of die values of the dice determines an occurrence of the win; (c) a plurality of competing teams; (d) a plurality of competing sports teams, wherein the competition comprises a sports game; or (e) a plurality of competing characters.

20. The gaming system of claim 17, wherein the data storage device stores a plurality of instructions executable by the processor to operate a random-based process to determine the first and second spaces.

21. The gaming system of claim 17, wherein the data storage device stores a plurality of instructions executable by the processor to:

receive a plurality of selection communications from one or more input devices operatively coupled to the processor, wherein the selection communications correspond to a plurality of selection inputs from the first and second wager submitters; and determine the first and second spaces depending, at least in part, on the selection communications.

22. The gaming system of claim 17, wherein each of the one or more wager receivers comprises: (a) a payment receiver configured to be operatively coupled to the processor, wherein the payment receiver is configured to receive a wager input from one of the first or second wager submitters, wherein the wager input corresponds to the first or second wager communication, wherein the wager input comprises human action; ; (b) a payment receiver; (c) a payment receiver configured to receive a cash bill or a data card; (d) a data card reader; (e) a currency acceptor; (f) an input device configured to be operatively coupled to the processor, wherein the input device is configured to receive a wager input from one of the first or second wager submitters, wherein the wager input corresponds to the first or second wager signal, wherein the wager input comprises human action; (g) a button; (h) a depressible button; (i) a bet button; (j) a play button; (k) a mobile input device; (l) a touch module; (m) a touch panel; (n) a touchable element on a touch panel; (o) a means to receive one of the first or second wager communications; or (p) a non-human, electrical element configured to be operatively coupled to the processor.

23. The gaming system of claim 1, wherein the data storage device stores a plurality of instructions executable by the processor to:

receive a plurality of first wager signals from the one or more electronic wager acceptors, wherein each of the first wager signals corresponds to one of a plurality of first wagers on the first competitor by one of a plurality of the first wager submitters;

receive a plurality of second wager signals from the one or more electronic wager acceptors, wherein each of the second wager signals corresponds to one of a plurality of second wagers on the second competitor by one of a plurality of the second wager submitters;

associate each of the first and second wager submitters with one of the spaces;

provide the base award to each of the first wager submitters or each of the second wager submitters depending upon whether the first or second competitor wins; and provide the bonus award to one of the first and second wager submitters who is associated with one of the spaces that is located at the winning intersection.

24. The gaming system of claim 1, wherein:

the first wager signal comprises a first base wager signal;

the first wager comprises a first base wager;

the second wager signal comprises a second base wager signal;

the second wager comprises a second base wager; and the data storage device stores a plurality of instructions executable by the processor to:

receive a first bonus wager signal from the one or more electronic wager acceptors, wherein the first bonus wager signal corresponds to a first bonus wager on the first competitor by the first wager submitter;

receive a second bonus wager signal from the one or more electronic wager acceptors, wherein the second bonus wager signal corresponds to a second bonus wager on the second competitor by the second wager submitter;

determine the base award, wherein the determination of the base award depends at least partially upon the first and second base wagers; and determine the bonus award, wherein the determination of the bonus award depends at least partially upon the first and second bonus wagers.

25. The gaming system of claim 1, wherein the data storage device stores a plurality of instructions executable by the processor to cause a payout of the base award and the bonus award without requiring any additional wager from the first and second wager submitters beyond the first and second wagers.

26. The gaming system of claim 1, wherein the data storage device stores a plurality of instructions executable by the processor to provide the base award and the bonus award without requiring either of: (a) initiation of an additional competition; or (b) an additional wager from the first or second wager submitter.

27. The gaming system of claim 3, wherein the data storage device stores a plurality of instructions executable by the processor to:

cooperate with the one or more input devices to receive a plurality of first wager signals from the one or more input devices, wherein each of the first wager signals corresponds to one of a plurality of first wagers on the first competing element by one of a plurality of the first wager submitters;

cooperate with the one or more input devices to receive a plurality of second wager signals from the one or more input devices, wherein each of the second wager signals corresponds to one of a plurality of second wagers on the second competing element by one of a plurality of the second wager submitters;

associate each of the first and second wager submitters with one of the spaces;

provide the first monetary value to each of the first wager submitters or each of the second wager submitters depending upon whether the first or second competing element wins; and provide the second monetary value to one of the first and second wager submitters who is associated with one of the spaces that is located at the winning intersection.

28. The gaming system of claim 3, wherein:

the first wager signal comprises a first base wager signal;

the first wager comprises a first base wager;

the second wager signal comprises a second base wager signal;

the second wager comprises a second base wager; and the data storage device stores a plurality of instructions executable by the processor to:

cooperate with the one or more input devices to receive a first bonus wager signal from the one or more input devices, wherein the first bonus wager signal corresponds to a first bonus wager on the first competing element by the first wager submitter;

cooperate with the one or more input devices to receive a second bonus wager signal from the one or more input devices, wherein the second bonus wager signal corresponds to a second bonus wager on the second competing element by the second wager submitter;

determine the first monetary value, wherein the determination of the first monetary value depends at least partially on the first and second base wagers; and determine the second monetary value, wherein the determination of the second monetary value depends at least partially on the first and second bonus wagers.

29. The gaming system of claim 3, wherein the data storage device stores a plurality of instructions executable by the processor to cause a payout of the first monetary value and the second monetary value without requiring any additional wager from the first and second wager submitters beyond the first and second wagers.

30. The gaming system of claim 3, wherein the data storage device stores a plurality of instructions executable by the processor to provide the first monetary value and the second monetary value without requiring either of: (a) initiation of an additional competition; or (b) an additional wager from the first or second wager submitter.

31. The gaming system of claim 17, wherein the data storage device stores a plurality of instructions executable by the processor to:

receive a plurality of first wager communications from the one or more electronic wager receivers, wherein each of the first wager communications corresponds to one of a plurality of first wagers on the first competing element, wherein each of the first wagers is submitted by one of a plurality of the first wager submitters;

receive a plurality of second wager communications from the one or more electronic wager receivers, wherein each of the second wager communications corresponds to one of a plurality of second wagers on the second competing element, wherein each of the second wagers is submitted by one of a plurality of the second wager submitters;

associate each of the first and second wager submitters with one of the spaces;

provide a first monetary value to:

the first wager submitters if the first competing element wins; and the second wager submitters if the second competing element wins; and provide a second monetary value to the one of the first and second wager submitters who is associated with the space located at the winning intersection.

32. The gaming system of claim 17, wherein:

the first wager communication comprises a first base wager communication;

the first wager comprises a first base wager;

the second wager communication comprises a second base wager communication;

the second wager comprises a second base wager; and the data storage device stores a plurality of instructions executable by the processor to:

receive a first bonus wager communication from the one or more electronic wager receivers, wherein the first bonus wager communication corresponds to a first bonus wager on the first competing element, wherein the first bonus wager is submitted by the first wager submitter;

receive a second bonus wager communication from the one or more electronic wager receivers, wherein the second bonus wager communication corresponds to a second bonus wager on the second competing element, wherein the second bonus wager is submitted by the second wager submitter;

determine the first monetary value, wherein the determination of the first monetary value depends at least partially on the first and second base wagers; and determine the second monetary value, wherein the determination of the second monetary value depends at least partially on the first and second bonus wagers.

33. The gaming system of claim 17, wherein the data storage device stores a plurality of instructions executable by the processor to cause a payout of the first monetary value and the second monetary value without requiring any additional wager from the first and second wager submitters beyond the first and second wagers.

34. The gaming system of claim 17, wherein the data storage device stores a plurality of instructions executable by the processor to provide the first monetary value and the second monetary value without requiring either of: (a) initiation of an additional competition; or (b) an additional wager from the first or second wager submitter.

* * * * *